US008279035B2

(12) United States Patent
Yoshikawa et al.

(10) Patent No.: US 8,279,035 B2
(45) Date of Patent: Oct. 2, 2012

(54) REACTOR

(75) Inventors: Kouhei Yoshikawa, Osaka (JP); Masayuki Katou, Osaka (JP); Atsushi Itou, Osaka (JP); Shinichiro Yamamoto, Osaka (JP); Hajime Kawaguchi, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 13/259,658

(22) PCT Filed: Feb. 26, 2010

(86) PCT No.: PCT/JP2010/053098
§ 371 (c)(1),
(2), (4) Date: Dec. 16, 2011

(87) PCT Pub. No.: WO2010/110007
PCT Pub. Date: Sep. 30, 2010

(65) Prior Publication Data

US 2012/0092120 A1 Apr. 19, 2012

(30) Foreign Application Priority Data

| | | |
|---|---|---|
| Mar. 25, 2009 | (JP) | 2009-073255 |
| Jul. 31, 2009 | (JP) | 2009-179998 |
| Aug. 25, 2009 | (JP) | 2009-193833 |
| Aug. 31, 2009 | (JP) | 2009-199648 |
| Feb. 26, 2010 | (JP) | 2010-041439 |

(51) Int. Cl.
*H01F 27/02* (2006.01)

(52) U.S. Cl. ..... 336/96

(58) Field of Classification Search ..... 336/55, 336/62, 65, 90, 92, 96, 212, 219
See application file for complete search history.

(56) References Cited

U.S. PATENT DOCUMENTS

| | | | | |
|---|---|---|---|---|
| 2009/0315663 | A1* | 12/2009 | Kiyono et al. | 336/219 |
| 2011/0156853 | A1* | 6/2011 | Kato et al. | 336/192 |
| 2011/0234359 | A1* | 9/2011 | Ono | 336/216 |
| 2012/0126928 | A1* | 5/2012 | Yoshikawa et al. | 336/221 |

FOREIGN PATENT DOCUMENTS

JP 11-288824 10/1999

(Continued)

*Primary Examiner* — Tuyen Nguyen
(74) *Attorney, Agent, or Firm* — McDermott Will & Emery LLP

(57) ABSTRACT

A compact reactor with excellent productivity and heat dissipation is provided. Reactor 1α includes a coil formed by spirally winding a wire 2*w* and a magnetic core 3 having an inside core portion inserted into the coil and an outside core portion 32 coupled to the inside core portion. These core portions form a closed magnetic circuit. The coil is covered with an inside resin portion 4 on the outer circumference thereof to form a coil molded unit 20α with its shape being held. The outer circumference of a combination unit 10 of the coil molded unit 20α and the magnetic core 3 is covered with an outside resin portion 5α. Reactor 1α does not have a case and is thus compact. A surface of the outside core portion 32 on the installation side (core installation surface 32*d*) is exposed form the outside resin portion 5α and is in direct contact with a fixed object, thereby achieving excellent heat dissipation. The provision of the coil molded unit 20α facilitates the handling of the coil during assembly of reactor 1α, thereby achieving good productivity.

23 Claims, 17 Drawing Sheets

(I)

FOREIGN PATENT DOCUMENTS

| | | |
|---|---|---|
| JP | 2004-095570 | 3/2004 |
| JP | 2004-327569 | 11/2004 |
| JP | 2007-027185 | 2/2007 |
| JP | 2007-180224 | 7/2007 |
| JP | 2008-028290 | 2/2008 |
| JP | 2008-041879 | 2/2008 |
| JP | 2008-042051 | 2/2008 |
| JP | 2008-311284 | 12/2008 |
| JP | 2009-026995 | 2/2009 |
| JP | 2009-246219 | 10/2009 |
| WO | WO 2008/152467 A2 | 12/2008 |
| WO | WO 2010/021113 A1 | 2/2010 |

* cited by examiner (I)

(II)

(I)

(II)

(I)

(II)

(I)

(II)

(III)

(I)

(II)

(I)

(II)

(I)

(II)

100:100b, 100c

REACTOR

RELATED APPLICATIONS

This application is the U.S. National Phase under 35 U.S.C. §371 of International Application No. PCT/JP2010/053098, filed on Feb. 26, 2010, which in turn claims the benefit of Japanese Application Nos. 2009-073255, filed on Mar. 25, 2009, 2009-179998, filed on Jul. 31, 2009, 2009-193833, filed on Aug. 25, 2009, 2009-199648, filed on Aug. 31, 2009 and 2010-041439, file don Feb. 26, 2010, the disclosures of which Applications are incorporated by reference herein.

TECHNICAL FIELD

The present invention relates to a reactor for use, for example, as a component of a power conversion apparatus such as a vehicle-mounted DC-DC converter mounted on a vehicle such as a hybrid car. In particular, the present invention relates to a compact reactor with excellent productivity and heat dissipation.

BACKGROUND ART

A reactor is one of components of a circuit performing a voltage step-up operation or step-down operation. For example, Patent Literatures 1 to 3 disclose reactors for use as circuit components of converters mounted on vehicles such as hybrid cars. The reactor typically includes a coil having a pair of coil elements, and an annular magnetic core having the coil elements arranged side by side such that the axial directions of the coil elements are parallel to each other (see, in particular, Patent Literatures 1 and 2).

Patent Literature 1 discloses a reactor including an outer case accommodating an assembly of a coil and a magnetic core, resin filling the inside of the outer case to seal the assembly, and an insulating member interposed between the coil and the magnetic core for insulation therebetween. The insulating member includes a tubular bobbin arranged on the outer circumference of the magnetic core and a pair of frame-like members arranged on opposite end surfaces of the coil. The coil sandwiched by the frame-like members is accommodated in a bracket-shaped inner case, which is then accommodated in the outer case. Patent Literature 3 discloses a reactor including a resin portion that covers an outer circumference of an assembly of a coil and a magnetic core. In use, these conventional reactors are installed on a fixed object such as a cooling base such that the coil heated with application of current can be cooled.

CITATION LIST

Patent Literature

PTL 1: Japanese Patent Laying-Open No. 2008-028290

PTL 2: Japanese Patent Laying-Open No. 2004-327569

PTL 3: Japanese Patent Laying-Open No. 2007-180224

SUMMARY OF INVENTION

Technical Problem

Improvement in productivity is desired for conventional reactors.

Generally, before being assembled into a reactor, a coil, as it is, cannot retain its shape and expands or contracts. Therefore, in assembly of the reactor, it is difficult to handle the coil having an instable shape, leading to reduction of productivity of a reactor. In particular, if a coil having a relatively large gap between adjacent turns due to spring back is arranged in a magnetic core, as it is, the coil arrangement portion in the magnetic core is long, thereby increasing the size of the reactor. Then, in order to reduce the size of the reactor, the reactor may be assembled with the coil compressed to a desired length, resulting in poor assembly workability. The components and steps are many in the case where a coil is sandwiched between a pair of frame-like members and accommodated in an inner case to retain the coil in a compressed state, as described in Patent Literature 1. Neither Patent Literature 2 nor 3 sufficiently considers the handling of coils. In view of the foregoing, improvement in workability and in productivity is desired.

On the other hand, it is difficult to further reduce the size of a reactor having a case.

Recently, size reduction and weight reduction is desired for components mounted on vehicles such as hybrid cars. The provision of the outer case as described in Patent Literature 1 makes further size reduction difficult. Although the omission of the case reduces the size as described in Patent Literature 2, for example, protection from the external environment such as dust or corrosion and mechanical protection such as strength cannot be achieved because the coil and the magnetic core are exposed.

In addition, reactors with excellent heat dissipation are desired.

As described in Patent Literature 3, size reduction and protection of the assembly can be achieved by omitting a case and covering the outer circumference of the assembly of the coil and the magnetic core with resin. However, covering the entire circumference of the coil and magnetic core leads to reduction in heat dissipation. Here, in a reactor having a case, the case, made of metal such as aluminum, can be used as a heat dissipation path. It is desired to develop reactors with excellent heat dissipation even without such cases.

The present invention therefore aims to provide a compact reactor with excellent productivity and heat dissipation.

Solution to Problem

The present invention proposes to omit a case and to cover the outer circumference of a combination unit of a coil and a magnetic core with resin in order to mainly achieve size and weight reduction, protection from the external environment, mechanical protection, and electrical protection. The present invention also proposes to use a molded unit as a coil with its shape retained by resin different from the resin covering the outer circumference of the combination unit in order to mainly improve workability and productivity. Furthermore, the present invention proposes to devise the shape of the magnetic core and to define a resin covered region that covers the outer circumference of the combination unit in a specific range in order to mainly improve heat dissipation.

The reactor of the present invention includes a coil formed by spirally winding a wire, and a magnetic core on which the coil is arranged. The magnetic core includes an inside core portion inserted into the coil and an outside core portion coupled to the inside core portion and on which the coil is not arranged. These core portions form a closed magnetic circuit. The reactor includes a coil molded unit having the coil and an inside resin portion covering the outer circumference of the coil to hold its shape, and an outside resin portion covering at least part of the outer circumference of a combination unit of the coil molded unit and the magnetic core. Then, a surface (hereinafter referred to as a core installation surface) of the outside core portion of the magnetic core that serves as an installation side when the reactor is installed satisfies the following requirements (1) and (2).

(1) The core installation surface protrudes from a surface of the inside core portion that serves as an installation side.

(2) The core installation surface is exposed from the outside resin portion.

The reactor of the present invention having the configuration described above has a case-free structure not having a case thereby achieving size reduction and weight reduction while the outside resin portion and the inside resin portion can protect the coil and the magnetic core from the external environment, mechanically protect them, and electrically protect the coil.

In addition, since the reactor of the present invention includes the coil molded unit for holding the shape of the coil with the constituent resin of the inside resin portion, the coil does not expand or contract during assembly, so that the handling of the coil is easy, resulting in good assembly workability of the reactor. The inside resin portion can enhance the insulation between the coil and the magnetic core and can hold the compressed state of the coil, so that the tubular bobbin, frame-like member, or inner case as described above can be omitted, and the number of components and assembly steps can be reduced. In this respect, the reactor of the present invention is excellent in productivity.

In the reactor of the present invention, part of the magnetic core (core installation surface) is exposed from the outside resin portion. Therefore, when the reactor is installed on a fixed object such as a cooling base, the magnetic core can be in direct contact with the fixed object. Therefore, the reactor of the present invention can release heat of the magnetic core directly to the fixed object, and is thus excellent in heat dissipation. Although being exposed from the outside resin portion, the core installation surface is covered with the fixed object when the inventive reactor is installed on the fixed object, thereby achieving protection from the external environment and mechanical protection.

In addition, the core installation surface of the outside core portion is shaped to protrude from the surface on the installation side of the inside core portion, which reduces the size of the magnetic core, thus contributing to size reduction of the reactor. In a magnetic core in which the outer circumferential surface of the outside core portion and the outer circumferential surface of the inside core portion are coplanar, if the shape of the outside core portion is modified, with the volume unchanged, such that the core installation surface of the outside core portion protrudes from the inside core portion, the length in the coil axial direction of the reactor can be reduced as shown in FIG. 3 of Patent Literature 2. Accordingly, the installation area of the reactor on a fixed object such as a cooling base can be reduced. In this respect, the reactor of the present invention is compact.

According to a manner of the present invention, a surface (core installation surface) of the outside core portion of the magnetic core that serves as an installation side when the reactor is installed is coplanar with a surface (hereinafter referred to as a molded unit installation surface) of the coil molded unit that serves as an installation side when the reactor is installed. These surfaces are exposed from the outside resin portion.

In this configuration, when the reactor is installed on a fixed object such as a cooling base, the magnetic core as well as the coil molded unit can come into direct contact with the fixed object. Therefore, heat of the coil generating a large amount of heat can be efficiently released to a fixed object such as a cooling base. The reactor in this manner is further excellent in heat dissipation. In addition to the magnetic core, part of the coil molded unit is also exposed from the outside resin portion and directly supported on the fixed object. Therefore, the reactor in this manner is installed on the fixed object more stably with the increased contact area with the fixed object.

The coil included in the reactor of the present invention typically includes only one coil (element) or includes a pair of coil elements. In the case of a pair of coil elements, the coil elements may be arranged side by side such that the axial directions thereof are parallel to each other. Here, the inside resin portion may have a depression at a portion that covers a gap between the coil elements and that serves as the installation side when the reactor is installed.

The outer shape of the inside resin portion of the coil molded unit may be selected from a variety of shapes and may be a similar shape conforming to the outer shape of the coil or a non-similar shape. For example, in the state in which the coil elements are arranged side by side, the outer shape of the portion of the inside resin portion that covers the gap between the coil elements may be a flat plane extending between the coil elements or a shape having a depression along the gap between the coil elements. In particular when the molded unit installation surface of the coil molded unit is exposed from the outside resin portion, the provision of the depression increases the surface area of the inside resin portion as compared with the flat plane, thereby enhancing the heat dissipation performance. When the molded unit installation surface of the coil molded unit is covered with the outside resin portion, the provision of the depression increases the surface area of the inside resin portion as compared with the flat plane, thereby enhancing the contact between the outside resin portion and the coil molded unit. In addition, the depression provided in the inside resin portion can be used, for example, as a groove at which a resin injection gate for molding the outside resin portion is arranged.

According to a manner of the present invention, the inside resin portion may have an interposed resin portion interposed between the coil and the inside core portion. A cushion member may be provided which is interposed between the interposed resin portion and the inside core portion and does not cover the outside core portion.

When the reactor of the present invention is used in a vehicle-mounted component for vehicles such as cars, considering the use environment and the operation temperature, for example, it is desired that the reactor should be usable in a temperature range approximately from the possibly lowest temperature of the use environment: −40° C. to the highest temperature reached when the coil is excited: 150° C. The present inventors then produced a coil molded unit having a pair of coil elements and performed a heat cycle test in the above-noted temperature range for this reactor having the coil molded unit. As a result, it was found that there is no problem when the temperature of the reactor is increased but the following phenomenon may occur when the temperature is decreased.

(1) A crack may occur in the portion of the inside resin portion that is interposed between the inside core portion and the coil (hereinafter the region between the inside core portion and the coil is referred to as the interposed region, and the resin in the interposed region is referred to as the interposed resin portion).

(2) When a similar heat cycle test is conducted only for a molded unit formed by molding only the coil with the inside resin portion in the absence of the inside core portion, no crack occurs in the resin portion of the molded unit on the inner circumferential side of the coil.

As a result of consideration of the cause of the phenomenon as described above, it is concluded that the coefficient of linear expansion of the inside core portion is smaller than the coefficient of linear expansion of the inside resin portion, so that the contraction of the inside resin portion is inhibited by the presence of the inside core portion at a temperature drop of the reactor, causing formidable stress to act on the interposed resin portion, resulting in a crack. Then, it is proposed to provide a cushion member to alleviate the stress acting on the interposed resin portion at a temperature drop of the reactor. When the reactor in this manner is subjected to the heat cycle as described above, the cushion member provided between the interposed resin portion and the inside core portion alleviates the inhibition of contraction of the interposed resin portion by the inside core portion in particular at a temperature drop of the reactor. Therefore, the reactor in this manner can effectively prevent a crack in the interposed resin portion. Furthermore, since the outside core portion is not covered with a cushion member, even the reactor in this manner has sufficient heat dissipation performance.

The constituent material of the cushion member preferably has Young's modulus smaller than the constituent resin of the inside resin portion.

In this configuration, the cushion member reliably functions as a cushion for preventing excessive stress from acting on the interposed resin portion.

As a specific example of the cushion member, at least one kind may be selected from a heat-shrinkable tube, a cold-shrinkable tube, a mold layer, a coating layer, and a tape winding layer.

If the cushion member is a heat-shrinkable tube, the outer circumferential surface of the inside core portion is reliably covered in conformity with the outer circumference, and separation of the cushion member from the inside core portion can be prevented. If the cushion member is a cold-shrinkable tube, the operation of heating the tube is not necessary when the tube is attached to the inside core portion. The inside core portion can be easily covered with the cushion member only by fitting the cold-shrinkable tube on the outer circumference of the inside core portion. If the cushion member is a mold layer, the cushion member excellent in thickness uniformity can be easily formed by molding resin on the outer circumferential surface of the inside core portion. In particular, in the case of a mold layer, even a resin having poor heat shrinkage or cold shrinkage property can be used as the constituent resin of the cushion member, so that the constituent resin of the cushion member can be selected from a wide variety of options. If the cushion member is a coating layer, the outer circumference of the inside core portion can be covered with the cushion member with a simple operation of, for example, applying the constituent material of the cushion member on the outer circumference of the inside core portion. If the cushion member is a tape winding layer, the outer circumference of the inside core portion can be covered with the cushion member more easily by winding a tape material around the outer circumference of the inside core portion.

According to a manner of the present invention, a positioning portion may be provided which is integrally formed in the inside resin portion and is used to position a combination unit of the coil molded unit and the magnetic core with respect to a molding die when the outside resin portion is formed using the molding die. The positioning portion is used for positioning with respect to the molding die and is thus at least partially not covered with the outside resin portion.

In forming the outside resin portion, it is sometimes difficult to accurately arrange the combination unit of the coil molded unit and the magnetic core at a predetermined location in the molding die. Even when it is arranged at the predetermined location, it is sometimes difficult to keep the location while the outside resin portion is being formed. For example, it is possible that a support member such as a pin, press jig, or bolt is separately prepared, and the combination unit arranged in the molding die is supported by the support member to keep the arranged state at the predetermined location. However, in this case, the step for arranging the support member is added, leading to reduction of productivity of the reactor. In addition, the portion of the combination unit that is in contact with the support member is not covered with the outside resin portion, so that the coil (molded unit) or the magnetic core is partially exposed. Thus, the number of the exposed portions is increased. Therefore, the outside resin portion cannot sufficiently provide mechanical protection or protection from the external environment, or the appearance is deteriorated. For example, resin may be buried in the exposed portions, but in this case, the number of steps increases to further reduce productivity of the reactor.

By contrast, in the manner including the positioning portion integrally formed in the inside resin portion, the combination unit can be easily positioned in the molding die only by fitting the positioning portion in the molding die, and in addition, the state in which the combination unit is arranged at the predetermined location can be kept reliably during molding of the outside resin portion. Therefore, according to this manner, a separate support member for positioning is not necessary, thereby eliminating the step of arranging the support member, resulting in good productivity of the reactor.

The fitting of the positioning portion in the molding die can reliably keep the state in which the combination unit is arranged at the predetermined location in the molding die, so that the outside resin portion can be formed accurately.

Furthermore, because of the provision of the positioning portion in the inside resin portion itself, in this manner, an exposed portion (a contact portion with the support member) is not provided in which the coil molded unit or the magnetic core is not covered with the outside resin portion as is the case with when the support member is separately used. Therefore, in this manner, the coil and the magnetic core are substantially entirely covered with the inside resin portion and the outside resin portion, thereby achieving sufficient mechanical protection of the coil and the magnetic core and protection from the external environment. Although part of the positioning portion (for example, only one surface, or one surface and a region in the vicinity thereof) is not covered with the outside resin portion and is exposed, it is formed of the inside resin portion. Therefore, even if part of the coil is present in the inside of the constituent resin of the positioning portion, mechanical protection of the coil and protection from the external environment can be achieved reliably because the coil is covered with the inside resin portion.

The positioning portion is provided at any given location in the inside resin portion, and the shape and number thereof is not limited. Typical examples are a projection and a protrusion, either one or more than one. In a molding die for forming the outside resin portion, a concave groove is provided, in which the projection or protrusion is fitted. The combination unit can be positioned easily in the molding die by fitting the projection or protrusion in the concave groove. The portion of the positioning portion that is fitted in the mating groove in the molding die is not covered with the outside resin portion and is exposed.

The whole positioning portion may be formed only with the constituent resin of the inside resin portion. In this case, the positing portion can be easily formed in a variety of shapes, sizes, numbers. Alternatively, the positioning portion may include part of the coil in the inside thereof. For example, when the coil includes a pair of coil elements and a coil coupling portion coupling the coil elements with each other, and when the coil coupling portion is provided to protrude from the turn formation surface of the coil elements, the positioning portion may be formed at a portion of the inside resin portion that covers the coil coupling portion. When the coil coupling portion protrudes from the turn formation surface and the inside resin portion is provided to conform to this shape, the portion that covers the coil coupling portion (hereinafter referred to as the coupling portion covering portion) protrudes from the other portion of the inside resin portion. When at least part of the coupling portion covering portion is used as the positioning portion, the concave portion for forming the coupling portion covering portion in the molding die for the inside resin portion can serve as a concave portion for forming the positioning portion at the same time, thereby eliminating the need for separately providing a concave portion for the positioning portion in the molding die. Furthermore, since the coupling portion covering portion itself serves as the positioning portion, a separate protrusion serving as a positioning portion is not present, and therefore, the outer shape of the coil molded unit tends to be simple. Therefore, the handling of the coil molded unit is easy. Furthermore, the positioning portion hardly impairs the appearance of the reactor. In another manner, a positioning portion only formed with the constituent resin of the inside resin portion and a positioning portion containing part of the coil may be both provided.

According to a manner of the present invention, a notched corner portion may be provided at a ridge line formed with an inner end surface of the outside core portion that is opposed to an end surface of the coil molded unit and an adjacent surface connected to the inner end surface, for introducing the constituent resin of the outside resin portion into between the end surface of the coil molded unit and the inner end surface of the outside core portion.

If the constituent resin of the outside resin portion does not sufficiently fill between the coil molded unit and the magnetic core (in particular, the outside core portion) to produce an empty hole, the mechanical protection of the coil molded unit and the magnetic core and the electrical protection may become insufficient. Therefore, the constituent resin of the outside resin portion preferably fills between the coil molded unit and the magnetic core with no gap in order to enhance the contact with the combination unit of the coil molded unit and the magnetic core or to enhance the insulation between the coil molded unit and the magnetic core. Considering improvement of productivity of the reactor, in molding of the outside resin portion, it is desired to quickly fill the gap between the coil molded unit and the magnetic core with the constituent resin of the outside resin portion. In particular when thermosetting resin is used as the constituent resin of the outside resin portion, the resin has to fill quickly before setting.

On the other hand, in order to reduce the size of the reactor, it is desired to minimize the clearance between the coil molded unit and the magnetic core. In order to reduce the size of the coil, for example, it is possible that a coil is compressed in the axial direction such that the adjacent turns are brought closer to each other almost in contact with each other, and the outer circumference of the compressed coil is covered with an inside resin portion to form a coil molded unit. In such a reactor having such a coil molded unit, when the outside resin portion is formed, it is difficult to quickly fill the gap between the coil molded unit and the magnetic core with the constituent resin of the outside resin portion through the clearance and the gap between turns. In a coil molded unit including a pair of coil elements, it is sometimes difficult to quickly fill the gap between the coil elements with the constituent resin of the outside resin portion partly because the distance between the adjacent coil elements is reduced for size reduction, or partly because the constituent resin of the inside resin portion is present between the coil elements.

For example, when it is assumed that resin is injected on the outer circumference of the assembly of the coil and the magnetic core described in Patent Literature 2, the outside core portion is opposed to the end surface of the coil, and the gap between the end surface of the coil and the outside core portion is very narrow. Therefore, it is very difficult to quickly fill the gap between the coil and the magnetic coil with resin through this gap.

By contrast, in the foregoing manner in which the notched corner portion is provided at the ridge line formed with the inner end surface of the outside core portion that is opposed to the end surface of the coil molded unit and the adjacent surface connected with this inner end surface, the constituent resin of the outside resin portion can be guided in between the coil molded unit and the magnetic core through the notched corner portion. In other words, the notched corner portion improves the filling performance of the constituent resin of the outside resin portion, so that the constituent resin can quickly fill between the coil molded unit and the magnetic core, thereby reversibly preventing an empty hole. In particular, in the manner in which the coil includes a pair of coil elements, even when the gap between the coil elements is narrow as described above, the guidance of the notched corner portion allows sufficient filing with the constituent resin of the outside resin portion.

The shape of the notched corner portion can be selected as appropriate. For example, it may be formed by rounding the ridge line.

By rounding the ridge line formed of the inner end surface and the adjacent surface, the notched corner portion can be formed in such a shape that conforms to the ridge line of the inner end surface and the adjacent surface and that facilitates distribution of the constituent resin of the outside resin portion. Therefore, the constituent resin can be easily introduced from the notched corner portion into between the coil molded unit and the magnetic core.

In another manner, a relatively small gap of not less than 0.5 mm and not more than 4 mm may be provided between the inner end surface of the outside core portion that is opposed to the end surface of the coil molded unit and the end surface of the coil molded unit. In this manner, while the reactor is compact, the constituent resin of the outside resin portion is easily introduced between the end surface of the coil molded unit and the inner end surface of the outside core portion, so that the constituent resin is sufficiently present in the gap. In addition to the provision of the relatively small gap, when the magnetic core has the notched corner portion, the constituent resin of the outside core portion can fill between the end surface of the coil molded unit and the inner end surface of the outside core portion even more easily, resulting in good productivity of the reactor.

Advantageous Effects of Invention

The reactor of the present invention is compact, excellent in productivity with ease of handling of the coil, and excellent in heat dissipation.

BRIEF DESCRIPTION OF DRAWINGS

FIG. 4 shows another manner of the coil molded unit, in which FIG. 4(I) is a front view schematically showing an example having a heat dissipation plate and FIG. 4(II) is a perspective view schematically showing an example having a concave groove on an inner circumference.

FIG. 5 is a perspective view showing another manner of the coil molded unit and schematically showing an example having a concave groove on an outer circumference, in which FIG. 5(I) shows an example in which the coil is partially exposed and FIG. 5(II) shows an example having a concave groove with the coil not exposed.

FIG. 10 is an illustration showing an assembly procedure of the reactor in the second embodiment, in which FIG. 10(I) shows a state before a cushion member is attached to an inside core portion and FIG. 10(II) shows a state after the cushion member is attached to the inside core portion.

FIG. 11 is an illustration showing an assembly procedure of the reactor in the second embodiment, in which FIG. 11(I) shows a state in which the inside core portions having the cushion members attached and the coil are combined and FIG. 11(II) shows a state in which the inside core portions and the coil in FIG. 11(I) are molded with an inside resin portion.

FIG. 12 is an illustration showing an assembly procedure of the reactor in the second embodiment, in which FIG. 12(I) shows a state in which outside core portions and terminal fittings are combined with the coil molded unit and FIG. 12(II) shows a state in which the coil molded unit, the outside core portions, and the terminal fittings are combined together.

FIG. 16 shows a magnetic core included in the reactor in the modification of the second embodiment, in which FIG. 16(I) is a perspective view of the outside core portion having a notched corner portion rectangular in cross section, FIG. 16(II) is a perspective view of the outside core portion having a notched corner portion rectangular in cross section, and FIG. 16(III) is a plan view of the outside core portion shown in FIG. 16(I) and FIG. 16(II).

DESCRIPTION OF EMBODIMENTS

Figure 1:
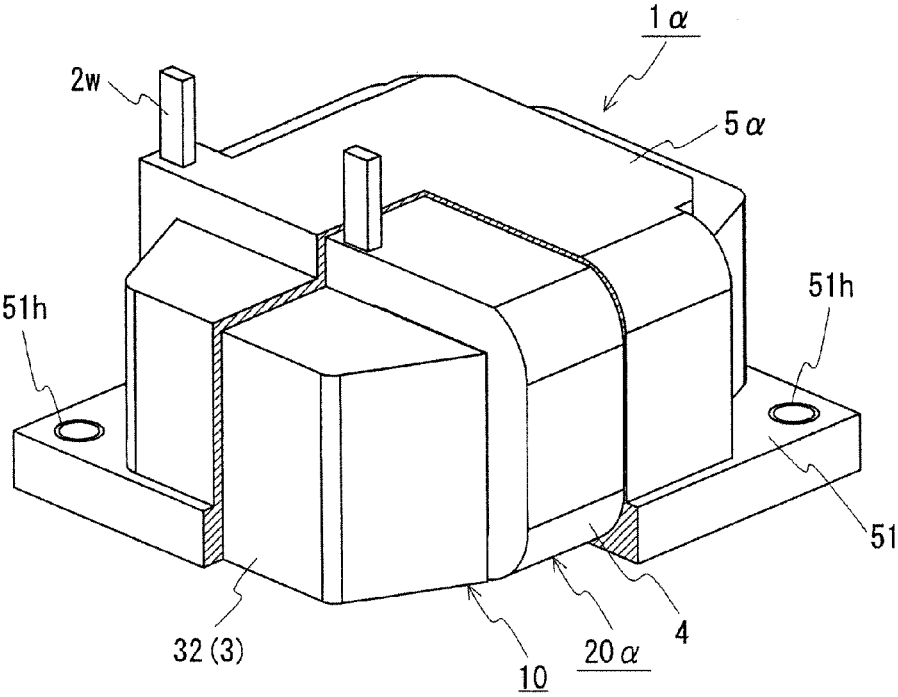
FIG. 1(I) is a perspective view schematically showing a reactor in a first embodiment arranged on a fixed object, and FIG. 1(II) is a perspective view schematically showing the reactor as viewed from an installation surface side.
Figure 1:
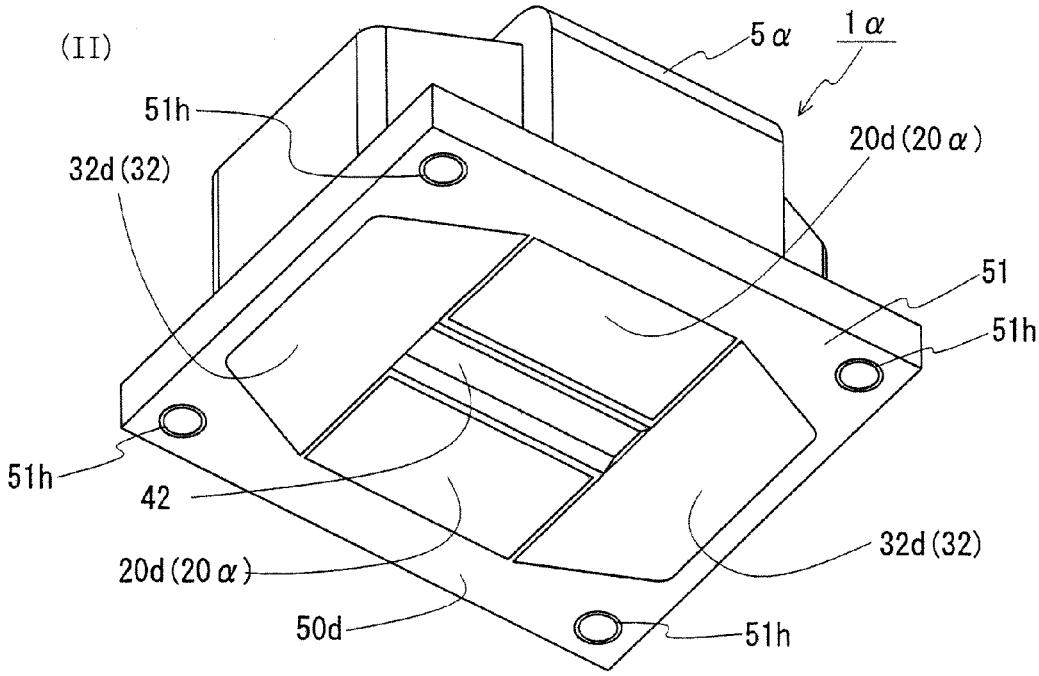

In the following, a reactor according to embodiments of the present invention will be described in detail with reference to the figures. In the figures, the same parts are denoted with the same reference numerals. In the reactor and its components in the following embodiments and the reactor and its components in modifications, the installation side on which the reactor is installed is referred to as the bottom side and the opposing side is referred to as the top side.

First Embodiment

Figure 2:
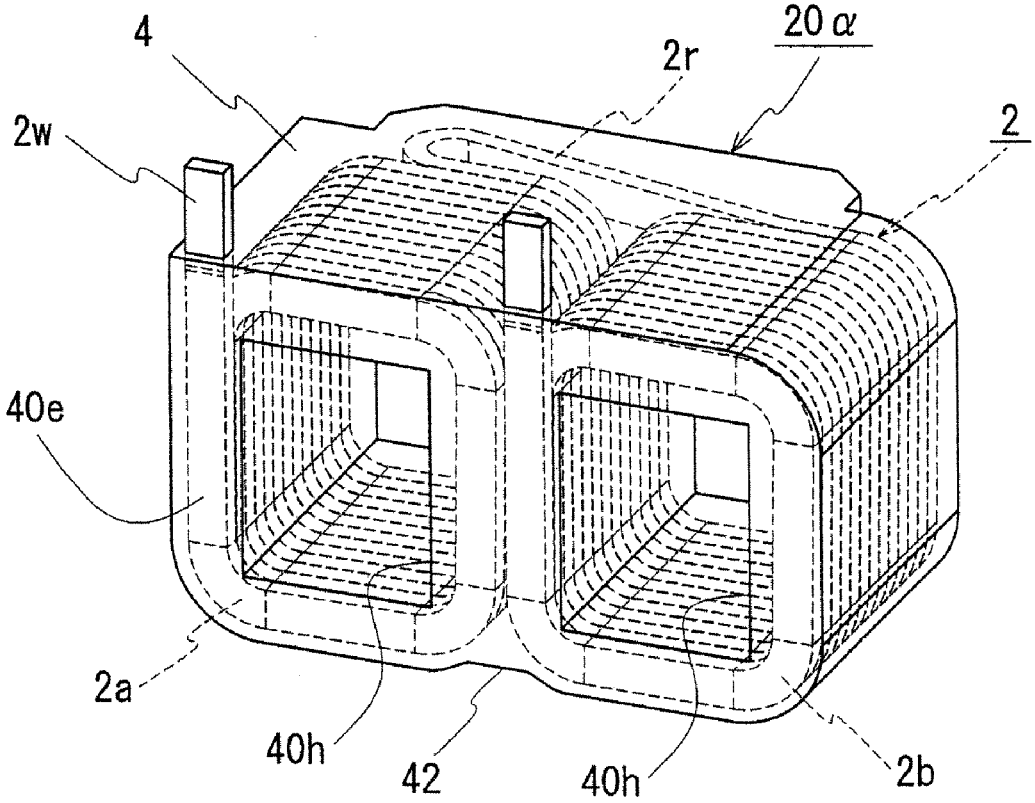
FIG. 2 is a perspective view schematically showing a coil molded unit included in the reactor in the first embodiment.

In the following, referring to FIG. 1 to FIG. 3, a reactor 1α in a first embodiment will be described. In FIG. 1(I), an outside resin portion is partially cut away to reveal a coil molded unit and a magnetic core present inside the outside resin portion.

Reactor 1α is used, for example, as a component of a DC-DC converter of a hybrid car. In this case, reactor 1α is used directly installed on a fixed object (not shown) such as a cooling base made of metal (typically, aluminum) having a coolant circulation path inside thereof. Reactor 1α is installed with a flat surface shown in FIG. 1(II) serving as an installation surface.

Reactor 1α includes a coil 2 (FIG. 2) formed by winding a wire 2*w* and an annular magnetic core 3 on which coil 2 is arranged. Coil 2 is covered with an inside resin portion 4 on the outer circumference thereof to form a coil molded unit 20α. Reactor 1α further includes an outside resin portion 5α which covers the outer circumference of a combination unit 10 of coil molded unit 20α and magnetic core 3. Reactor 1α is characterized by the manner of the coil (coil molded unit 20α), the shape of magnetic core 3, and a covered region of outside resin portion 5α. Each configuration will be described in more detail below.

<Combination Unit>

Magnetic core 3 is described with reference to FIG. 3 as necessary. Magnetic core 3 has a pair of inside core portions 31 on which coil molded unit 20α is arranged, and a pair of outside core portions 32, exposed from coil molded unit 20α, on which coil molded unit 20α is not arranged. Here, each inside core portion 31 is shaped like a rectangular parallelepiped, and each outer core portion 32 is shaped like a prism having a pair of trapezoidal surfaces. Magnetic core 3 is formed such that outside core portions 32 are arranged to sandwich inside core portions 31 arranged apart from each other, and an end surface 31*e* of each inside core portion 31 and an inner end surface 32*e* of each outside core portion 32 are joined to form an annular shape. These inside core portions 31 and outside core portions 32 form a closed magnetic circuit when coil 2 is excited.

Inside core portion 31 is a stacked unit formed by alternately stacking core pieces 31*m* made of a magnetic material and gap materials 31*g* typically made of a non-magnetic material. Outside core portion 32 is a core piece made of a magnetic material. A formed body using magnetic powder or a stack of a plurality of magnetic thin plates having insulating coatings can be used for each core piece.

Examples of the formed body are a powder compact using powder of soft magnetic materials such as iron-group metals such as Fe, Co, Ni, Fe-based alloys such as Fe—Si, Fe—Ni, Fe—Al, Fe—Co, Fe—Cr, Fe—Si—Al, rare earth metals, and amorphous magnetic materials, a sintered body formed by press-forming and thereafter sintering the aforementioned powder, and a molded hardened body formed by, for example, injection-molding or casting-molding a mixture of the aforementioned powder and resin. Another example of the core piece may be a ferrite core which is a sintered body of metal oxide. The formed body can readily form a magnetic core in a variety of solid shapes.

For the powder compact, powder of the soft magnetic material having an insulating coat on a surface thereof may be suitably used. In this case, the compact is obtained by firing the formed powder at a temperature below the heat-resistance temperature of the insulating coat. For example, the soft magnetic material having an insulating coat as follows can be used.

A soft magnetic material includes a plurality of composite magnetic particles each having a metal magnetic particle, an insulating coat surrounding the surface of the metal magnetic particle, and a composite coat surrounding the outside of the insulating coat. The composite coat may have a heat-resistant protection coat surrounding the surface of the insulating coat and a flexible protection coat surrounding the surface of the heat-resistant protection coat. Alternatively, the composite coat may be a mixed coat of a heat-resistant protection coat and a flexible protection coat, where the surface side of the composite coat includes a greater amount of the constituent material of the flexible protection coat than the constituent material of the heat-resistant protection coat, and the boundary side of the composite coat with the insulating coat includes a greater amount of the constituent material of the heat-resistant protection coat than the constituent material of the flexible protection coat.

The soft magnetic material having the specific composite coat as described above is excellent in moldability, since the surface of the composite magnetic particle is covered with the flexible protection coat having predetermined flexibility. In addition, since the soft magnetic material includes the flexible protection coat having a flexing characteristic, the flexible protection coat is less likely to be cracked even under pressure during forming. In other words, the flexible protection coat can effectively prevent the heat-resistant protection coat and the insulating coat from being damaged by pressure in press forming. Therefore, with the soft magnetic material described above, the insulating coat of the composite magnetic particle functions well, thereby sufficiently preventing eddy current flowing between the particles. Furthermore, since the insulating coat is protected by the heat-resistant protection coat, the insulating coat is less likely to be damaged even when subjected to heat treatment at a high temperature after forming. This makes it possible to increase the heating temperature in firing. Therefore, the soft magnetic material can reduce hysteresis loss of the powder compact obtained by high-temperature heat treatment.

The insulating coat above includes, for example, at least one kind selected from a group including phosphorous compounds, silicon compounds, zirconium compounds, and aluminum compounds. The presence of the insulating coat including the compound above with excellent insulation performance effectively prevents eddy current flowing between the metal magnetic particles. When the average thickness of the insulating coat is not less than 10 nm and not more than 1 μm, the following effects can be achieved. (1) Tunnel current flowing in the insulating coat is prevented, and an increase of eddy current loss resulting from the tunnel current is thus prevented. (2) Demagnetizing field, which may be caused when the distance between the metal magnetic particles is too large, can be prevented, thereby preventing an increase of hysteresis loss resulting from the occurrence of demagnetizing field. (3) A reduction of saturation magnetic flux density of the powder compact can be prevented, which may be caused when the volumetric ratio of the insulating coat in the soft magnetic material is too small. Furthermore, when the average thickness of the composite coat is not less than 10 nm and not more than 1 μm, damage to the insulating coat can be prevented effectively. In addition, the following effects are brought about: an increase of eddy current loss is prevented by the prevention of demagnetizing field as in (2) above, and a reduction of saturation magnetic flux density of the powder compact can be prevented, which may be caused when the volumetric ratio of the composite coat in the soft magnetic material is too small, as in (3) above.

If the heat-resistant protection coat includes an organic silicon compound wherein the siloxane bridge density is greater than 0 and equal to or smaller than 1.5, the heat-resistant protection coat can have excellent heat resistance because the compound itself is excellent in heat resistance. This manner is preferable in that when the Si content in the heat-resistant protection coat increases after thermal decomposition of the compound to form an Si—O compound, the contraction is small without a rapid decrease of electrical resistance.

When the flexible protection coat includes a material excellent in flexibility, for example, at least one kind selected from a group including silicone resin, epoxy resin, phenol resin, and amide resin, damage to the heat-resistant protection coat and the insulating coat due to pressure in press forming can be effectively prevented. Alternatively, the flexible protection coat may include silicone resin, where the Si content in the boundary-side region of the composite coat with the insulating coat is greater than the Si content in the surface-side region of the composite coat. Since the Si content in the heat-resistant protection coat is greater than the Si content in the flexible protection coat, the composite coat is configured such that the constituent material of the flexible protection coat locally exists in the surface-side region. Because of this configuration, the flexible protection coat prevents damage to the heat-resistant protection coat and the insulating coat due to pressure during press forming, making the insulating coat to function well thereby sufficiently preventing eddy current flowing between the composite magnetic particles.

On the other hand, an example of the thin plate as described above is a thin plate made of a magnetic material such as amorphous magnetic material, permalloy, or silicon steel. When the entire magnetic core is formed of a stack unit, the magnetic core is likely to have high magnetic permeability and high saturation magnetic flux density, and high mechanical strength.

The material of the inside core portion and the material of the outside core portion may be different. For example, when the inside core portion is a powder compact or a stack as described above and the outside core portion is a molded hardened body as described above, it is likely that the saturation magnetic flux density of the inside core portion is higher than that of the outside core portion, and the adjustment of inductance of the magnetic core as a whole is easy. Here, each core piece is a powder compact of iron or soft magnetic powder such as steel containing iron. In particular, the soft magnetic powder including a heat-resistant protection coat and a flexible protection coat on the outer circumference of the insulating coat as described can be used suitably.

Gap material 31*g* is a plate-like material arranged in a gap provided between core pieces 31*m* for adjustment of inductance and is formed of a material having magnetic permeability lower than that of the core piece, such as alumina, glass epoxy resin, or unsaturated polyester, typically a non-magnetic material (including an air gap). The core pieces and the gap materials are integrally joined, for example, by adhesive or fixed by a tape.

The number of core pieces and gap materials can be selected as appropriate such that reactor 1α has desired inductance. The shapes of the core piece and the gap material can be selected as appropriate.

The outer circumferential surface of inside core portion 31 and the outer circumferential surface of outside core portion 32 are not coplanar. Specifically, when reactor 1α is installed on a fixed object, the surface of outside core portion 32 that serves as the installation side (hereinafter referred to as core installation surface 32*d*, that is, the bottom surface in FIGS. 1 and 3) protrudes from the surface of inside core portion 31 that serves as the installation side (see FIG. 9 described later). The height of outside core portion 32 (the length in the direction vertical to the surface of the fixed object in a state in which reactor 1α is installed on the fixed object (here, the direction orthogonal to the axial direction of coil 2, and the vertical direction in FIGS. 1 and 3) is adjusted such that core installation surface 32*d* of outside core portion 32 is coplanar with the surface of coil molded unit 20α that serves as the installation side (hereinafter referred to as molded unit installation surface 20*d*, that is, the bottom surface in FIGS. 1 to 3). Therefore, magnetic core 3 is in the shape of a letter H in a perspective view seen from the side surface in the state in which reactor 1α is installed. In the state in which outside core portions 31 and outside core portions 32 are joined together, the side surfaces of outside core portion 32 (the front and back surfaces in the drawing sheet of FIG. 3) protrude outward from the side surfaces of inside core portion 31. Therefore, magnetic core 3 is in the shape of a letter H, in a perspective view seen either from the top surface or the bottom surface in the state in which reactor 1α is installed. Magnetic core 3 having such a three-dimensional shape is readily formed when being formed as a powder compact, and in addition, that portion of outside core portion 32 which protrudes from inside core portion 31 can be used for a magnetic flux path.

[Coil Molded Unit]

(Coil)

Coil molded unit 20α is described with reference to FIG. 2 as necessary. As shown in FIG. 2, coil molded unit 20α includes a coil 2 having a pair of coil elements 2α, 2*b* formed by spirally winding a single continuous wire 2*w* without a joined portion, and an inside resin portion 4 covering the outer circumference of coil 2 to retain the shape. Coil elements 2*a*, 2*b* have the same turns and each have the approximately rectangular shape as viewed from the axial direction (end surface shape). Coil elements 2*a*, 2*b* are arranged side by side such that the axial directions are parallel with each other, and are coupled by a coil coupling portion 2*r* formed by folding part of wire 2*w* in the shape of a U at the other end side (the back side in the drawing sheet of FIG. 2) of coil 2. In this configuration, the winding direction of coil elements 2*a* and 2*b* is the same.

Wire 2*w* is suitably a coated wire having an insulating coat made of an insulating material on the outer circumference of a conductor made of a conductive material such as copper or aluminum. Here, the conductor is formed of a flat wire of copper. A coated flat wire having an enamel insulating coat is used. Here, the aspect ratio (the ratio between width and thickness: width/thickness) of the cross section of the flat wire is 1.5 or more. A typical example of the insulating material forming the insulating coat is polyamide-imide. The thickness of the insulating coat is preferably not less than 20 μm and not more than 100 μm. As the thickness increases, pin holes can be reduced thereby enhancing the insulating performance. Coil elements 2*a*, 2*b* are each formed like a hollow prism by edge-wise winding the coated flat wire. Other than a flat wire, the conductor of wire 2*w* may have a variety of cross-sectional shapes such as a circle, oval, and polygon. The flat wire readily forms a coil with a high space factor as compared with when a round wire having a circular cross section is used.

The opposite ends of wire 2*w* forming coil 2 are extended as appropriate from a turn formation portion at one end side (the front side in the drawing sheet of FIG. 2) of coil 2 and are drawn to the outside of inside resin portion 4. Here, the opposite ends of wire 2*w* are further drawn to the outside of outside resin portion 5α as described later (FIG. 1(I)). The opposite ends of wire 2*w* drawn out are connected to terminal fittings (not shown) made of a conductive material, at the conductor portion exposed by stripping off the insulating coat. An external device (not shown) such as a power source feeding power to coil 2 is connected through the terminal fittings. The conductor portion of wire 2*w* is connected with the terminal fitting, for example, by welding such as TIG welding. The terminal fitting is usually fixed to a terminal base (not shown). In reactor 1α, the terminal base can be arranged above the drawn wire 2*w* in FIG. 1(I), or arranged on the side surface of reactor 1α through wiring as appropriate, or otherwise may be arranged on a fixed object.

[Inside Resin Portion]

Coil elements 2*a*, 2*b* are covered with inside resin portion 4 on the outer circumference thereof, so that the shape of coil 2 is fixed. Coil elements 2*a*, 2*b* are each held in a compressed state by the constituent resin of inside resin portion 4 such that the constituent resin is continuously present from one end side to the other end side. Here, inside resin portion 4 generally covers the entire coil 2 in conformity with the shape of coil 2, except for the opposite ends of wire 2*w*. The thickness of the portion of inside resin portion 4 that covers the turn formation portions of coil elements 2*a*, 2*b* is substantially uniform and is preferably about 1 mm to 10 mm. The portion that covers coil coupling portion 2*r* is shaped so as to extend out in the axial direction of the coil (FIG. 3).

The inner circumferences of coil elements 2*a*, 2*b* are also covered with the constituent resin of inside resin portion 4 and have hollow holes 40*h* formed of the constituent resin. Inside core portion 31 (FIG. 3) of magnetic core 3 (FIG. 3) is inserted into each hollow hole 40*h*. The thickness of the constituent resin of inside resin portion 4 is adjusted such that inside core portions 31 are arranged at the respective appropriate locations on the inner circumferences of coil elements 2*a*, 2*b*. In addition, the shape of hollow hole 40*h* conforms to the outer shape (here, a rectangular parallelepiped) of inside core portion 31. Therefore, the constituent resin of inside resin portion 4 present on the inner circumferences of coil elements 2*a*, 2*b* ensures insulation between coil elements 2*a*, 2*b* and inside core portions 31 and functions as a positioning portion for inside core portion 31.

Here, in inside resin portion 4 of coil molded unit 20α, the surface on the side from which the ends of wire 2*w* are drawn out is formed like a flat plane. The shape of the installation side opposed to this flat plane has a curved surface portion in conformity with the outer shape of coil elements 2*a*, 2*b*. More specifically, inside resin portion 4 has a depression 42 at a part that covers a gap having a triangular cross section formed between coil elements 2*a* and 2*b*. Here, depression 42 has a trapezoidal shape in cross section and extends over the entire region from one end surface 40*e* to the other end surface 40*e* of coil molded unit 20α (FIG. 1(II)) in the axial direction of coil 2. The shape, formation region, depth, number, etc. of depression 42 can be selected as appropriate. For example, a plurality of relatively small depressions may be provided. Of course, a flat plane without depression 42 may be formed.

The constituent resin of inside resin portion 4 has heat resistance to such a degree that does not soften at the highest temperature reached by the coil and the magnetic core when reactor 1α having coil molded unit 20α is used. A material capable of transfer-molding or injection-molding can be suitably used. In particular, a material with excellent insulation performance is preferable for insulation between coil 2 and inside core portion 31. Specifically, thermosetting resin such as epoxy, or thermoplastic resin such as polyphenylene sulfide (PPS) resin or liquid crystal polymer (LCP) can be suitably used. Here, epoxy resin is used. Epoxy resin has relatively high rigidity and good heat conductivity so as to protect coil 2 well and provide good heat dissipation. Epoxy resin is also excellent in insulation. Thus, the use of epoxy resin as the constituent resin of inside resin portion 4 ensures high reliability of insulation between coil 2 and inside core portion 31. Furthermore, when a resin mixed with filler made of at least one kind of ceramics selected from silicon nitride, alumina, aluminum nitride, boron nitride, mullite, and silicon carbide is used as the constituent resin of inside resin portion 4, heat of coil 2 is easily released, resulting in a reactor with even more excellent heat dissipation performance.

<Outside Resin Portion>

Reactor 1α is configured such that combination unit 10 formed by combining coil molded unit 20α and magnetic core 3 is covered with outside resin portion 5α on the outer circumference thereof, except for the ends of wire 2*w*, part of magnetic core 3, and part of coil molded unit 20α, as shown in FIG. 1. Here, outside resin portion 5α is formed by transfer-molding epoxy resin or unsaturated polyester after fabrication of combination unit 10. With outside resin portion 5α, coil molded unit 20α and magnetic core 3 can be handled as an integral unit. One surface of outside core portion 32 of magnetic core 3, namely, core installation surface 32*d*, and one surface of coil molded unit 20α, namely, molded unit installation surface 20*d* are exposed from outside resin portion 5α as shown in FIG. 1(II). Here, outside resin portion 5α is formed such that that surface of outside resin portion 5α which serves as the installation side (hereinafter referred to as resin installation surface 50*d*) when reactor 1α is installed on a fixed object is coplanar with core installation surface 32*d* and molded unit installation surface 20*d*. Therefore, when reactor 1α is installed on a fixed object, core installation surface 32*d*, molded unit installation surface 20*d*, and resin installation surface 50*d* all come into contact with the fixed object.

Here, outside resin portion 5α is shaped to generally conform to the outer shape of combination unit 10, except that a certain region of the installation side including resin installation surface 50*d* is formed in the shape of a rectangle. In other words, when reactor 1α is two-dimensionally viewed, the constituent resin of outside resin portion 5α is present even at the place where combination unit 10 is not present. Here, outside resin portion 5α has flange portions 51 which form the four corners of the above-noted rectangle protruding outward from the outline of combination unit 10. Each flange portion 51 has a through hole 51*h* into which a bolt (not shown) for fixing reactor 1α to the fixed object is mounted.

The number, formation places, shape, size (for example, thickness) of flange portions 51 can be selected as appropriate. For example, the flange portion can be provided in such a manner as to protrude from the side of coil 2 or the side of outside core portion 32 or in such a manner that the bottom surface of the flange portion does not form the resin installation surface. For example, in the state of being installed on the fixed object, the bottom surface of the flange portion is located higher than core installation surface 32*d*, and a bolt may be mounted on a surface different from a surface of the fixed object in contact with core installation surface 32*d*. The provision of flange portions 51 at the four corners of the rectangle can reduce the installation area of reactor 1α including flange portions 51.

Through hole 51*h* may be formed of the constituent resin of outside resin portion 5α or may be formed with a tube made of a different material. The tube has excellent strength when a metal pipe made of a metal such as brass, steel, or stainless steel is used, thereby preventing creep deformation of the resin. Here, through hole 51*h* is formed by arranging a metal pipe. The number of through holes 51*h* can be selected as appropriate. Either of a through hole that is not threaded and a threaded screw hole can be used as through hole 51*h*.

The portion excluding flange portions 51 of outside resin portion 5α has a uniform thickness and the average thickness is preferably 1 mm to 10 mm. The thickness of each portion, the region covering combination unit 10, and the shape of outside resin portion 5α can be selected as appropriate. For example, not only core installation surface 32*d* of outside core portion 32 and molded unit installation surface 20*d* of coil molded unit 20α but also part of outside core portion 32 and part of coil molded unit 20α may not be covered with the constituent resin of the outside resin portion and be exposed, or the entire resin installation surface may not be coplanar with core installation surface 32*d* and molded unit installation surface 20*d*. Here, in the outer circumference of coil 2 (excluding the ends of wire 2*w*) and magnetic core 2, when a region that is covered with at least one of inside resin portion 4 and outside resin portion 5α is large, protection from the external environment, mechanical protection, and electrical protection are ensured. When the average thickness of outside resin portion 5α is relatively thin, it is expected that heat of coil 2 and magnetic core 3 can be easily released.

Other than epoxy resin and unsaturated polyester described above, for example, urethane resin, PPS resin, polybuthylene terephthalate (PBT) resin, or acrylonitrile butadiene styrene (ABS) resin may be used as the constituent resin of outside resin portion 5α. The constituent resin of outside resin portion 5α may be the same as or different from the constituent resin of inside resin portion 4 of coil molded unit 20α. When the constituent resin of outside resin portion 5α contains filler made of ceramics as described above, heat dissipation performance is further enhanced. In particular, the heat conductivity of outside resin portion 5α is preferably 0.5 W/m·k or more, more preferably 1.0 W/m·k or more, in particular 2.0 W/m·k or more, because heat dissipation performance is excellent. When the constituent resin of outside resin portion 5α contains filler of glass fiber, the mechanical strength, in particular, is improved. Depending on the material of the constituent resin of outside resin portion 5α, vibrations caused by excitation of the coil can be absorbed, so that the effect of preventing noise can be expected.

<Assembly Procedure of Reactor>

Reactor 1α including the configurations above can be fabricated mainly through the following steps (1) to (3):

(1) a first molding step of molding inside resin portion 4 on coil 2 to form coil molded unit 20α, (2) an assembly step of combining coil molded unit 20α with magnetic core 3 to form combination unit 10, and (3) a second molding step of molding outside resin portion 5α on combination unit 10 to form reactor 1α.

(1) First Molding Step: Production of Coil Molded Unit

First, a single wire 2*w* is wound to form coil 2 in which a pair of coil elements 2*a* and 2*b* are coupled by coil coupling portion 2*r*. Coil molded unit 20α having this coil 2 can be produced using a molding die (not shown) as follows.

The molding die can be configured with a pair of a first die and a second die which can be opened and closed. The first die has an end plate located at one end side of coil 2 (the side from which the ends of wire 2*w* are drawn out in FIG. 2), and a core in the shape of a rectangular parallelepiped inserted into the inner circumference of each of coil elements 2*a*, 2*b*. The second die has an end plate located on the other end side of the coil (the coil coupling portion 2*r* side in FIG. 2), and a circumferential sidewall covering the circumference of coil 2. Furthermore, here, as the first and second dies, a plurality of rods are provided which can be advanced and receded inside the die by a driving mechanism. These rods can press the end surfaces of coil elements 2*a*, 2*b* (the surfaces where the turn formation portions are annularly shown) as appropriate to compress coil elements 2*a*, 2*b* and can hold coil 2 in the molding die at a predetermined position. Here, eight rods in total are used to press approximately the corner portions of coil elements 2*a*, 2*b*. Since it is difficult to press coil coupling portion 2*r* with a rod, a portion below coil coupling portion 2*r* is pressed by a rod. The rods have sufficient strength against compression of coil 2 and heat resistance against heat during molding of inside resin portion 4, and are preferably as thin as possible in order to reduce the number of portions of coil 2 that are not covered with inside resin portion 4.

Coil 2 is arranged in the molding die such that a certain gap is formed between the surface of the molding die and coil 2. At the state in which coil 2 is arranged in the molding die, coil 2 is not yet compressed with a gap formed between the adjacent turns.

Next, the molding die is closed, and the core of the first die is inserted into the inner circumference of each coil element 2*a*, 2*b*. Here, the distance between the core and the inner circumference of coil element 2*a*, 2*b* is generally uniform over the entire circumference of the core. The combination unit of coil 2 and inside core portion 31 may be arranged in the molding die such that the axial direction of coil 2 extends in the horizontal direction. However, when it is arranged in the molding die such that the axial direction of coil 2 extends in the vertical direction, it is easier to coaxially arrange coil 2 and inside core portion 31 than the arrangement in the horizontal direction. In the case of arrangement in the vertical direction, the arrangement in the molding die is easy even when core pieces 31*m* and gap members 31*g* are not fixed by adhesive but are integrated using the constituent resin of the inside resin portion.

Next, coil elements 2*a*, 2*b* are compressed by advancing the rods into the molding die. This compression results in a reduced gap between the adjacent turns of coil elements 2*a*, 2*b*. Since coil elements 2*a*, 2*b* are pressed by the rods, coil 2 can be held stably at a predetermined position in the molding die. When coil 2 is not compressed with its free length being kept, it is not necessary to press so hard as to compress, as long as coil 2 can be held by the rods. A predetermined distance may be kept between coil elements 2*a* and 2*b*, for example, by arranging an appropriate pin (not shown) between coil elements 2*a* and 2*b*.

Thereafter, the constituent resin of inside resin portion 4 is poured into the molding die from a resin injection port. Once the poured resin sets to some extent and the compressed state of coil 2 can be held by the resin, the rods can be receded from the inside of the molding die. After the injected resin sets, the molding die is opened to remove coil molded unit 20α with coil 2 compressed and held in a predetermined shape.

A plurality of small holes (see FIG. 11(II) described later) formed at the portions pressed by the rods can be left as they are because they are to be filled with outside resin portion 5α. Alternatively, preferably, they can be filled with insulating resin or closed by affixing an insulating tape or the like, so that the insulation between coil 2 and outside core portion 32 is enhanced. When depression 42 is formed, the molding die has a projection for forming depression 42. The basic method of producing the coil molded unit as described above can also be applied to the embodiment described later or modifications.

(2) Assembly Step: Production of Combination Unit

Figure 3:
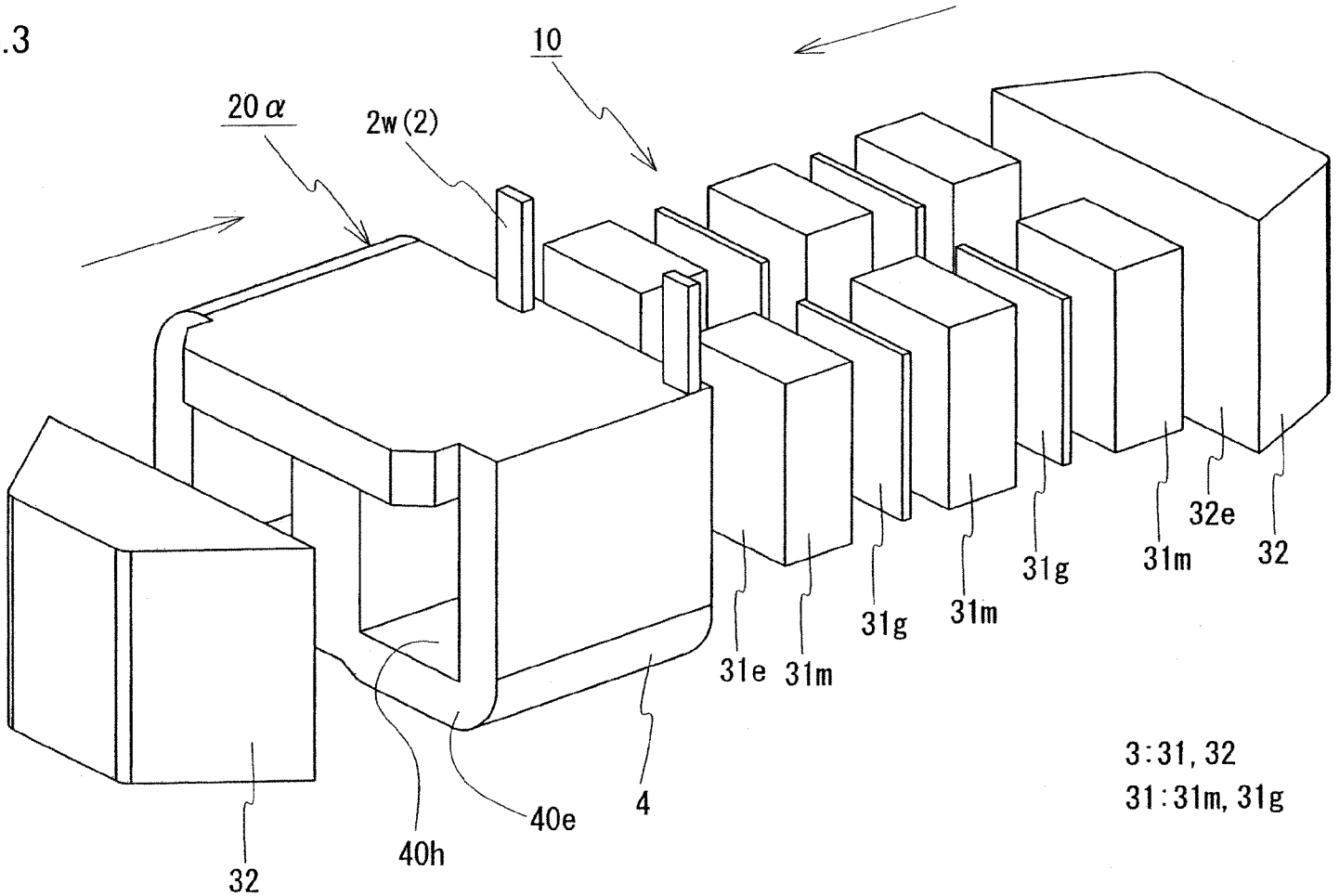
FIG. 3 is an exploded perspective view illustrating an assembly procedure of a combination unit of the coil molded unit and a magnetic core included in the reactor in the first embodiment.

As shown in FIG. 3, inside core portion 31 is formed by fixing core pieces 31*m* and gap materials 31*g*, for example, by adhesive. Then, the formed inside core portions 31 are inserted and arranged in hollow holes 40*h* of coil molded unit 20α produced as described above. Hollow holes 40*h* are formed at a predetermined thickness with the constituent resin of inside resin portion 4 of coil molded unit 20α as described above, and therefore, inside core portions 31 inserted in hollow holes 40*h* are arranged at appropriate positions in coil elements 2*a*, 2*b* (FIG. 2). Then, outside core portions 32 are arranged such that opposite end surfaces 40*e* of coil molded unit 20α are sandwiched between inner end surfaces 32*e* of a pair of outside core portions 32, and the inner end surfaces 32*e* of outside core portion 32 are joined with end surfaces 31*e* of inside core portion 31, for example, by adhesive. This step results in combination unit 10. In the resulting combination unit 10, core installation surface 32*d* (FIG. 1) of outside core portion 32 is coplanar with molded unit installation surface 20*d* (FIG. 1) of coil molded unit 20α as described above.

(3) Second Molding Step: Molding of Outside Resin Portion

A molding die (not shown) having a cavity in a predetermined shape is prepared, and the resulting combination unit 10 is accommodated in the molding die. Outside resin portion 5α is molded such that core installation surface 32*d* of outside core portion 32, molded unit installation surface 20*d* of coil molded unit 20α, and the ends of wire 2*w* are exposed. Flange portions 51 are formed on the installation side of outside resin portion 5α, and through holes 51*h* are formed at the same time. In the case where metal pipes are used, through holes 51*h* can be formed by insertion-molding the metal pipes or by molding through holes with resin and thereafter inserting metal pipes into the through holes. This step results in reactor 1α.

The resulting reactor 1α is placed on a fixed object such as a cooling base and fixed to the fixed object by inserting and screwing bolts into through holes 51*h* and bolt holes provided in the fixed object. The provision of heat dissipation grease or a heat dissipation sheet between the installation surface of reactor 1α and the fixed object as appropriate can reduce heat resistance between the installation surface of reactor 1α and the fixed object.

<Effects>

While reactor 1α is compact and lightweight because of the case-free structure not having a metal case, it includes the covering of a double-layer structure of inside resin portion 4 and outside resin portion 5α, thereby achieving protection of coil 2 and magnetic core 3 from the external environment, mechanical protection, and electrical protection. In particular, when the constituent resin of inside resin portion 4 is formed of a resin having excellent heat dissipation performance and outside resin portion 5α is formed of a resin resistant to shock, the reactor has both high heat dissipation performance and high mechanical strength.

With the use of coil molded unit 20α in reactor 1α, coil 2 does not expand or contract, making it easy to handle coil 2 during assembly, resulting in good assembly workability. In addition, with the use of coil molded unit 20α, an insulating member such as a tubular bobbin or an inner case can be omitted while insulation between coil 2 and magnetic core 3 is ensured and the compressed state is kept. Therefore, the number of components as well as the steps of arranging the components can be reduced. Therefore, reactor 1α is excellent in productivity.

Furthermore, reactor 1α is configured such that core installation surface 32*d* of outside core portion 32 is exposed from outside resin portion 5α and core installation surface 32*d* comes into contact with the fixed object when reactor 1α is installed on the fixed object such as a cooling base. With this configuration, heat of magnetic core 3 can be efficiently transferred to the fixed object. Therefore, reactor 1α is excellent in heat dissipation. In particular, reactor 1α is configured such that, in addition to core installation surface 32*d* of outside core portion 32, molded unit installation surface 20*d* of coil molded unit 20α is exposed from outside resin portion 5α, and installation surfaces 32*d* and 20*d* are coplanar in contact with the fixed object. With this configuration, heat of coil 2 can be efficiently transferred to the fixed object as well. Therefore, reactor 1α is further excellent in heat dissipation. In addition, reactor 1α has depression 42 on the installation side of coil molded unit 20α and is thus excellent in heat dissipation because of the large surface area of inside resin portion 4.

Since core installation surface 32*d* of outside core portion 32 is shaped to protrude from the surface on the installation side of inside core portion 31, the coil axial length of magnetic core 3 can be shortened in reactor 1α, assuming that it has the same volume as a magnetic core in which an outside core portion and an inside core portion are coplanar. Therefore, reactor 1α is compact since the area (projection area) of the surface supported on the fixed object can be reduced.

As described above, reactor 1α is compact and is excellent in productivity and heat dissipation. In addition, in reactor 1α, core installation surface 32*d* of outside core portion 32, molded unit installation surface 20*d* of coil molded unit 20α, and resin installation surface 50*d* of outside resin portion 5α are coplanar, so that the installation surface of reactor 1α has a flat shape (flat plane). Then, magnetic core 3, coil molded unit 20α, and outside resin portion 5α are directly supported on the fixed object. Therefore, reactor 1α has a large contact area with the fixed object and can be installed stably on the fixed object.

Furthermore, reactor 1α is excellent in handleability since coil molded unit 20α and magnetic core 3 are integrated by outside resin portion 5α.

Furthermore, flange portion 51 of outside resin portion 5α has through hole 51*h*, so that a bolt is inserted into through hole 51*h* and screwed into the fixed object, which eliminates the need for a member, other than the bolt, for anchoring reactor 1α to the fixed object. Reactor 1α can be installed easily.

(Modification 1-1)

Figure 4:
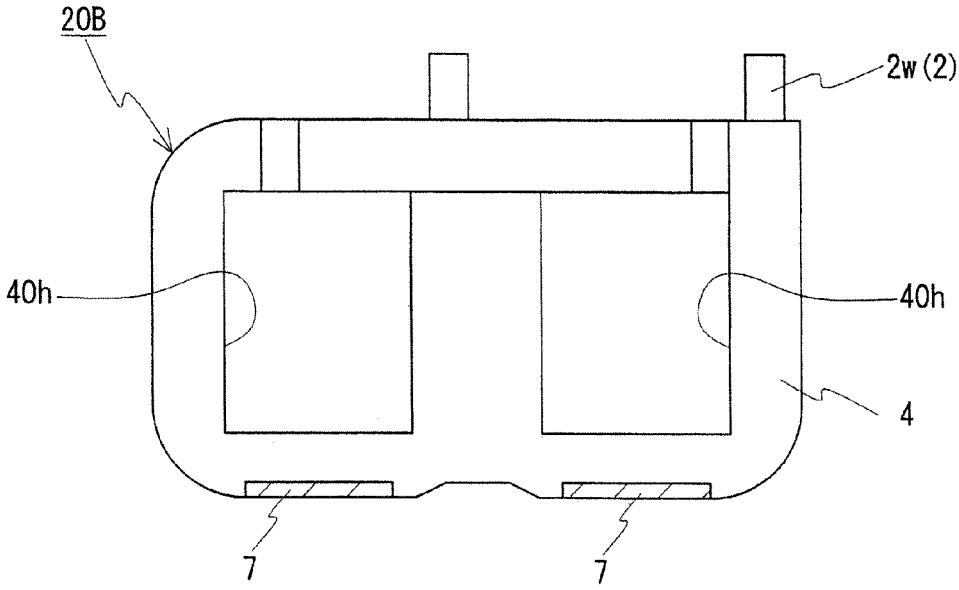
Figure 4:
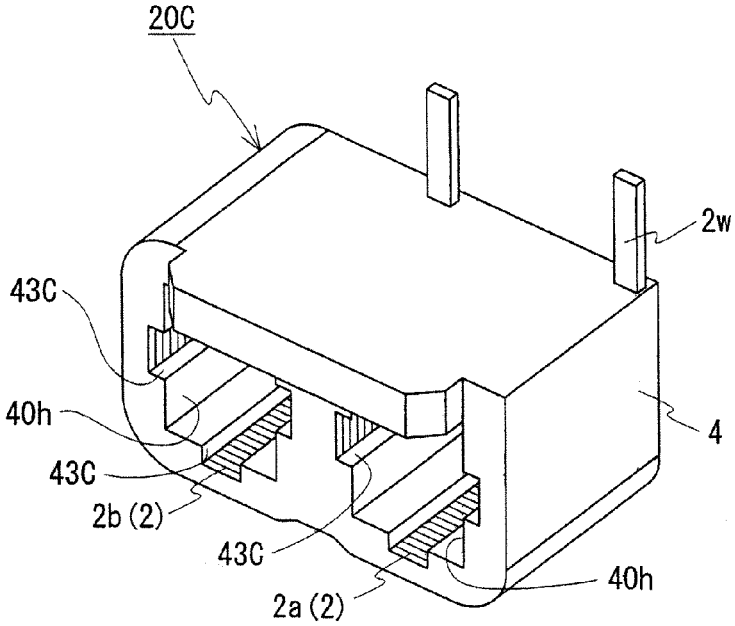
Figure 5:
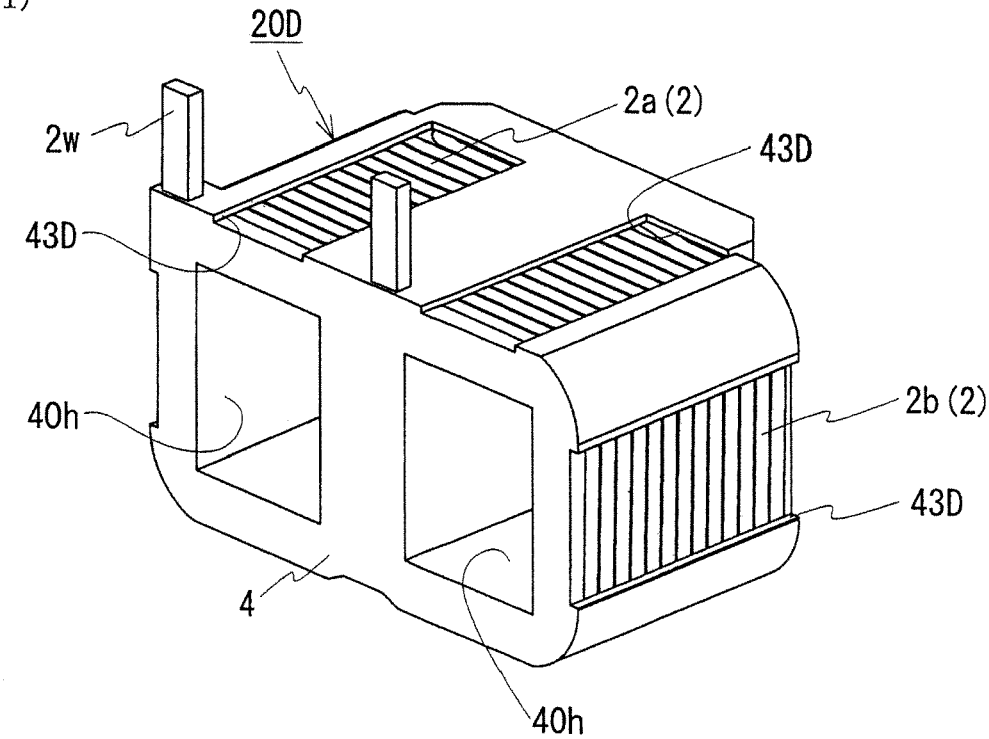
Figure 5:
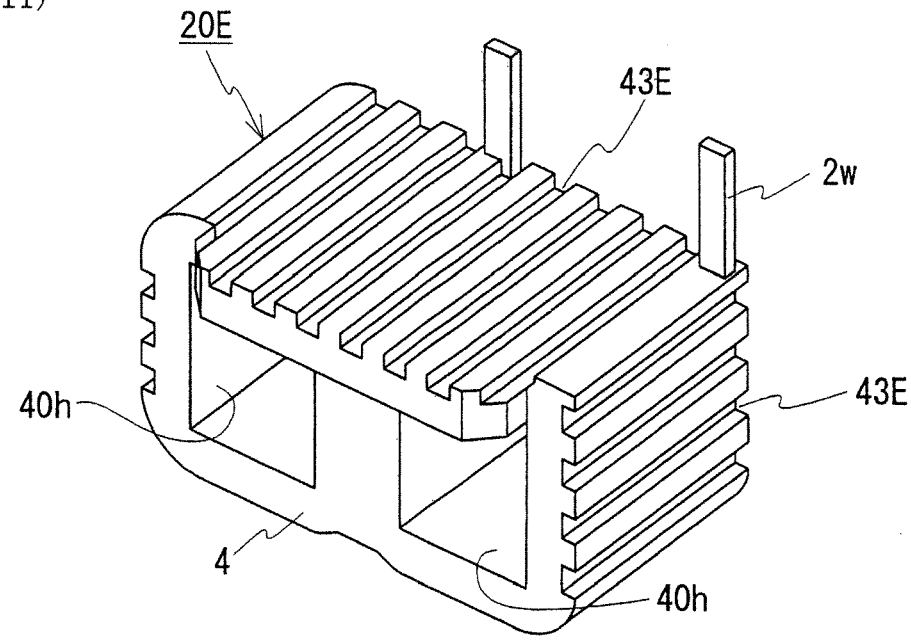

In the following, referring to FIGS. 4 and 5, modifications of the coil molded unit will be described. FIG. 4 and FIG. 5(II) show the state the coil molded unit is arranged such that the coil coupling portion for coupling the coil elements faces the front side of the drawing sheet.

In place of coil molded unit 20α in the first embodiment, for example, as shown in FIG. 4(I), a coil molded unit 20B can be configured to include a heat dissipation plate 7 on the installation side (the lower side in FIG. 4(I)) on which coil molded unit 20B is installed. Heat dissipation plate 7 may be fixed to the coil molded unit by a fixing member such as adhesive (in particular, one with good heat conductivity) or a bolt. However, when it is integrated with coil molded unit 20B by the constituent resin of inside resin portion 4, the fixing member and the fixing step are not necessary. Here, two heat dissipation plates 7 are prepared and are arranged in contact with the outer circumferential surfaces on the installation side of the coil elements. Each heat dissipation plate 7 has one surface in contact with the coil element and has the other end exposed from inside resin portion 4 to form a molded unit installation surface. Alternatively, the coil molded unit may be formed to include one heat dissipation plate having such a size that can be sufficiently in contact with the coil elements. Then, the reactor may be configured such that the molded unit installation surface formed of the one large heat dissipation plate and the core installation surface of the outside core portion are coplanar, and these installation surfaces are in contact with a fixed object such as a cooling base.

The constituent material of heat dissipation plate 7 may be selected from a variety of materials excellent in heat conductivity, in particular, a material with heat conductivity of 3 W/m·k or more, particularly 20 W/m·k or more, and preferably 30 W/m·k or more. Specifically, the examples are metal materials such as aluminum (236 W/m·k), aluminum alloy, copper (390 W/m·k), copper alloy, silver, silver alloy, iron, austenite stainless steel (for example, SUS304: 16. 7 W/m·k), and nonmetal materials such as ceramics of, for example, silicon nitride ($Si_3N_4$): about 20 W/m·k-150 W/m·k, alumina ($Al_2O_3$): about 20 W/m·k-30 W/m·k, aluminum nitride (AlN): about 200 W/m·k-250 W/m·k, boron nitride (BN): about 50 W/m·k-65 W/m·k, silicon carbide (SiC): 50 W/m·k-130 W/m·k (the numerical values are typical values of heat conductivity).

The heat dissipation plate made of ceramics is lightweight and is mostly excellent in electrical insulation so as to be able to electrically insulate the coil. Among the ceramics as described above, silicon nitride can be suitably used because the heat conductivity is high and the bending strength is superior to that of alumina, aluminum nitride, and silicon carbide. The heat dissipation plate made of the ceramics above can be manufactured by forming and thereafter sintering powder, and can be easily formed in a variety of sizes and shapes. Commercially available heat dissipation plates may be used.

On the other hand, the heat dissipation plate made of metal material has high heat dissipation performance. When the heat dissipation plate made of metal material is configured to be in direct contact with the coil, at least that portion of the heat dissipation plate which is in contact with the coil is preferably provided with a coat made of insulating material such as the above-noted ceramics, thereby ensuring electrical insulation from the coil. The coat can be formed, for example, by deposition such as PVD or CVD.

Heat dissipation plate 7, which is arranged near the coil, is preferably formed of non-magnetic material considering the magnetic characteristic. The heat dissipation plate may be formed of inorganic material of one kind selected from the above-noted metal materials and nonmetal materials such as the above-noted ceramics, or may be formed of a combination of different kinds of materials so that the heat characteristic is partially different.

With coil molded unit 20B, heat of coil 2 can be efficiently transferred to a fixed object such as a cooling base through heat dissipation plate 7 excellent in heat conductivity. Therefore, the reactor having such coil molded unit 20B is further excellent in heat dissipation. In particular, even higher frequencies and larger current are desired in reactors for use in components mounted on vehicles such as hybrid cars and electric cars, and heat generation of the coils is expected to increase, in response to such demand. Therefore, it can be expected that the above-noted reactor capable of efficiently releasing heat of the coil, which becomes hot more easily than the magnetic core, is suitably used in the vehicle-mounted components. When the heat dissipation plate described above is arranged not only at the installation surface of the reactor but also at any given place such as the side surface of the reactor or the surface opposed to the installation surface, the heat dissipation performance can be further enhanced.

(Modification 1-2)

In the configuration described in the first embodiment, the entire surfaces of the inner circumferences of coil elements 2*a*, 2*b* are covered with the constituent resin of inside resin portion 4. As long as a predetermined insulation distance between coil 2 and the magnetic core is ensured and the constituent resin of inside resin portion 4 is present so as to allow the positioning as described in the first embodiment, the entire surfaces of the inner circumferences of coil elements 2*a*, 2*b* may not be covered with the constituent resin of inside resin portion 4. In other words, the inner circumferential surfaces of coil elements 2*a*, 2*b* may be partially exposed from the constituent resin of inside resin portion 4. For example, in a coil molded unit 20C shown in FIG. 4(II), concave grooves 43C extending along the axial direction of coil 2 are formed at the top, bottom, right, and left, in total, four places in inside resin portion 4 that covers the inner circumference of each coil element 2*a*, 2*b*. The depth of each concave groove 43C corresponds to a predetermined insulation distance between coil 2 and the magnetic core, and the parts of coil elements 2*a*, 2*b* that are not covered with the constituent resin of inside resin portion 4 are exposed at the places where concave grooves 43C are formed. In order to obtain such coil molded unit 20C, the core as described above has projections for forming concave grooves 43C, that is, has a cross section in the shape of a cross.

Concave groove 43C can be used as a channel of the constituent resin of the outside resin portion when the outside resin portion is molded, and in addition, can increase the contact area between the resin and coil molded unit 20C. Therefore, the contact between coil molded unit 20C and the outside resin portion can be enhanced. Furthermore, even when coil elements 2*a*, 2*b* are partially exposed as described above, the exposed portions are covered with the constituent resin of the outside resin portion, thereby enhancing the insulation between coil 2 and the magnetic core.

(Modification 1-3)

In the configuration described in the first embodiment, the outer circumferential surface of coil 2 is substantially entirely covered with the constituent resin of inside resin portion 4, and the outer shape of inside resin portion 4 is formed with a smooth surface. In place of coil molded unit 20α in the first embodiment, for example, as shown in FIG. 5(I), a coil molded unit 20D may be configured to include concave grooves 43D on the outer circumference of inside resin portion 4. Here, concave grooves 43D are formed along the axial direction of coil 2 on the right and left side surfaces and top surface in FIG. 5(I). At the places where concave grooves 43D are formed, parts of coil elements 2*a*, 2*b* (part of one side surface and part of the top surface) that are not covered with the constituent resin of inside resin portion 4 are exposed. The depth of concave groove 43D can be selected as appropriate. For example, as in concave grooves 43E provided in a coil molded unit 20E shown in FIG. 5(II), the depth is such that the coil elements are not exposed. The width of concave groove 43E is smaller than that of concave groove 43D in coil molded unit 20D shown in FIG. 5(I). A plurality of concave grooves 43E are provided on each of the top surface and side surfaces of coil molded unit 20E. In order to obtain such coil molded units 20D, 20E, for example, projections for forming concave grooves 43D, 43E may be provided on the inside of the circumferential sidewall of the second die.

Concave grooves 43D, 43E can be used as channels of the constituent resin of the outside resin portion when the outside resin portion is molded, and in addition, can increase the contact area between the resin and coil molded units 20D, 20E. Therefore, the contact between coil molded units 20D, 20E and the outside resin portion can be enhanced. Furthermore, the modification 1-3 may be combined with the modification 1-2, that is, the coil molded unit may have concave grooves both on the inner and outer circumferences of the coil molded unit. Such coil molded unit can further improve the contact with the outside resin portion.

(Modification 1-4)

In the configuration described in the first embodiment, coil elements 2*a*, 2*b* are formed from a single wire 2*w* and covered with inside resin portion 4. The coil elements may be produced from separate wires, and the ends of the wires forming the coil elements may be joined, for example, by welding to form an integrated coil, which is covered with the inside resin portion. In this case, because of the absence of the coil coupling portion, the coil elements are easily pressed when the inside resin portion is molded.

Alternatively, the coil elements produced from separate wires are each provided with an inside resin portion to form a coil element molded unit. One end portions of the wires protruding from the coil element molded units are joined together, for example, by welding to form an integrated coil molded unit. In this case, because of the absence of the coil coupling portion as described above, and because only one coil element is included in formation of a coil molded unit, the coil element can be easily pressed, for example, when the inside resin portion is molded. This leads to excellent productivity of the molded unit. In this manner, one molding die can be shared in production of two coil element molded units, thereby reducing manufacturing costs.

(Modification 1-5)

In the configuration described in the first embodiment, core installation surface 32*d* of outside core portion 32 is in contact with a fixed object such as a cooling base. A heat dissipation plate may be interposed between the core installation surface exposed from the outside resin portion and the fixed object. Inorganic materials such as a variety of metal materials and nonmetal materials described in the modification 1-1 may be used as the material of the heat dissipation plate. When this heat dissipation plate is fixed by the constituent resin of the outside resin portion, a fixing member such as adhesive or bolt is not necessary, thereby reducing the number of components and improving the productivity of the reactor. This heat dissipation plate can efficiently transfer heat of the magnetic core and heat of the coil transferred to the magnetic core, to the fixed object such as a cooling base. Therefore, the reactor having this heat dissipation plate is even further excellent in heat dissipation.

Not only the core installation surface but also the entire installation surface of the reactor may be formed with a heat dissipation plate. For example, reactor 1α in the first embodiment may be configured to have a heat dissipation plate which covers core installation surfaces 32*d* of outside core portions 32, molded unit installation surface 20*d* of coil molded unit 20α, and resin installation surface 50*d* of outside resin portion 5α. In such a manner, it is possible to efficiently dissipate heat not only from coil 2 which easily becomes hot but also from magnetic core 3 and outside resin portion 5α which may become hot due to heat generated in coil 2. Thus, the heat dissipation performance is even more excellent. In particular, in this case, the material of the heat dissipation plate may be partially different. For example, the portion of the heat dissipation plate that is in contact with molded unit installation surface 20*d*, which is likely to become hottest, may be formed of a material having high heat conductivity, and the portion that is in contact with resin installation surface 50*d*, which is assumed to have a relatively low temperature, may be formed of a material having relatively low heat conductivity. Alternatively, the portion of the heat dissipation plate that is in contact with the resin portion (such as resin installation surface 50*d*) may be formed of metal material and the portion that is in contact with the metal portion (such as core installation surface 20*d*) may be formed of nonmetal material. The heat dissipation plate may be fixed by the constituent resin of the outside resin portion, or the heat dissipation plate may have through holes and be fixed together with reactor 1α to the fixed object by bolts for fixing reactor 1α. The through holes of the heat dissipation plate may be provided at the locations corresponding to through holes 51*h* in flange portions 51 of outside resin portion 5α when reactor 1α is placed on the heat dissipation plate.

Alternatively, in place of the heat dissipation plate, a coat made of the aforementioned ceramics is deposited on the reactor-installed surface of the fixed object, for example, by PVD or CVD, so that the coat is interposed between the installation surface of the reactor such as the core installation surface and the fixed object, thereby enhancing the heat dissipation performance.

(Modification 1-6)

In the configuration described in the first embodiment, outside resin portion 5α has flange portions 51 and through holes 51*h* for fixing reactor 1α to a fixed object. Alternatively, the flange portions and through holes may not be provided, and a fixing member may be used separately. As an example of the fixing member, a bracket-shaped member includes a pair of foot portions and an elastic portion which is arranged to couple the foot portions with each other and presses the surface (the top surface in FIG. 1(I)) opposed to the surface on the installation side of the reactor. At the tip end of the foot portion, a flange with a bolt hole is provided. Screwing a bolt into the bolt hole of the bracket-shaped member causes the elastic portion to press the reactor against the fixed object, and this pressing force fixes the reactor securely thereby enhancing the contact between the reactor and the fixed object.

The bracket-shaped member is preferably formed of metal such as stainless steel such as SUS304, SUS316, considering strength, elasticity, corrosion resistance, and the like, and can be formed, for example, by bending a metal strip as appropriate. More specifically, the flange portion can be formed by bending a metal strip into a bracket shape and further bending the tip end portions of a pair of foot portions in the shape of an L, and the elastic portion can be formed by bending the portion extending between the foot portions in the shape of an arc. One or more fixing member may be used.

(Modification 1-7)

In another manner, the magnetic core may include a bolt hole to fix the reactor. This eliminates the need for the fixing member described in the modification 1-6 and reduces the number of components. This bolt hole is provided at a portion other than the inside core portion, that is, in the outside core portion, so that the magnetic characteristics are less likely to be affected. In addition, a protrusion portion is provided in the outside core portion at a portion away from the inside core portion, and a bolt hole is provided in the protrusion portion. Then, the magnetic characteristics are further less likely to be affected. The magnetic core having such a complicated shape can be easily formed as a powder compact. The bolt hole may be either a through hole not threaded or a threaded screw hole.

(Modification 1-8)

In the configuration described in the first embodiment, inside core portion 31 and coil molded unit 20α are different members. However, the inside core portion and the coil molded unit may be integrally molded. In this case, the inside core portion is produced in advance, and in forming the coil molded unit, the inside core portion is arranged in place of the core arranged in the coil element. Then, the coil and the inside core portion can be integrated by the inside resin portion, simultaneously with molding of the inside resin portion. In this manner, the step of fitting the inside core portion in the coil molded unit can be omitted, thereby further improving productivity of the reactor.

(Modification 1-9)

In particular, when the coil molded unit contains the inside core portion as described in the modification 1-8, the inside resin portion and the outside resin portion are molded at a temperature higher than the use temperature of the reactor. If the thermal expansion coefficient of the magnetic core, the thermal expansion coefficient of the inside resin portion, and the thermal expansion coefficient of the outside resin portion are $\alpha_c$, $\alpha_{pi}$, and $\alpha_{po}$, respectively, the molding temperature may satisfy $\alpha_c<\alpha_{pi}\leqq\alpha_{po}$ and $\alpha_{pi}\leqq\alpha_{po}$. In particular, preferably, $\alpha_c<\alpha_{pi}\leqq\alpha_{po}$ and more preferably, $\alpha_c<\alpha_{pi}<\alpha_{po}$ is satisfied.

The present inventors produced a reactor in which the constituent resin of the outside resin portion is molded on the outer circumference of the combination unit of the coil molded unit containing the inside core portion and the outside core portion. Conducting a heat cycle test in the use temperature range (for example, −40° C. to 150° C.) of the reactor, the present inventors found that separation or a gap may occur between the outside resin portion and the member contained in the outside resin portion.

In this respect, when the inside resin portion and the outside resin portion are molded at a temperature higher than the reactor use temperature (the maximum use temperature, for example, 150° C.), and in addition, with such a molding temperature, the thermal expansion coefficients of the magnetic core, the inside resin portion, and the outside resin portion satisfy the specific relation as mentioned above, then the outside resin portion, which is heat-shrunken easier than the magnetic core or the inside resin portion, tends to shrink more than the magnetic core and the inside resin portion, in the use temperature range (for example, 150° C. or lower) during use of the reactor. Therefore, the outside resin portion can be kept in good contact with the magnetic core and the inside resin portion. This prevents separation or a gap between the outside resin portion and the magnetic core (in particular, the outside core portion) as well as between the outside resin portion and the inside resin portion.

Conversely, when the thermal expansion coefficients of the magnetic core, the inside resin portion, and the outside resin portion do not satisfy the aforementioned specific relation, that is, they satisfy $\alpha_c\geqq\alpha_{po}$ or $\alpha_{pi}>\alpha_{po}$, the magnetic core and the inside resin portion tend to shrink more than the outside resin portion as the temperature is lower in the use temperature range of the reactor. Therefore, when the heat cycle is repeatedly applied in the use temperature range of the reactor, the outside resin portion cannot follow the shrinkage deformation of the magnetic core and the inside resin portion, which may cause separation or a gap between the outside resin portion and the magnetic core (in particular, the outside core portion) as well as between the outside resin portion and the inside resin portion.

In the present modification 1-9, a resin that hardens or sets at a temperature higher than the use temperature of the reactor is selected as the constituent resin of the inside resin portion and the outside resin portion. Furthermore, in order to keep the contact state between the magnetic core, the inside resin portion, and the outside resin portion in the use temperature range of the reactor, the material is selected such that the thermal expansion coefficients of those three portions satisfy $\alpha_c<\alpha_{po}$ and $\alpha_{pi}\leqq\alpha_{po}$.

Thermosetting resin, for example, phenol resin, unsaturated polyester resin, epoxy resin, can be used as the resin that satisfies the requirements above. The general molding (hardening) temperature of the above-noted resin, and the thermal expansion coefficient at this molding temperature are as follows: phenol resin: 150° C. to 200° C., $15\times10^{-6}$/K to $35\times10^{-6}$/K, unsaturated polyester resin: 150° C. to 200° C., $5\times10^{-6}$/K to $30\times10^{-6}$/K, epoxy resin: 140° C. to 190° C., $5\times10^{-6}$/K to $100\times10^{-6}$/K. The thermal expansion coefficients of the inside resin portion and the outside resin portion can be adjusted by changing the kind of resin and the material and content of filler made of the aforementioned ceramics. On the other hand, the thermal expansion coefficient of the magnetic core at 150° C. to 200° C. is, for example, as follows: a powder compact of powder of soft magnetic material: $10\times10^{-6}$/K to $12\times10^{-6}$/K, a stack of silicon steel plates: $12\times10^{-6}$/K to $15\times10^{-6}$/K.

Test Example

A reactor including a coil molded unit was manufactured using epoxy resin containing alumina filler as the constituent resin of the inside resin portion and unsaturated polyester containing glass fiber filler as the constituent resin of the outside resin portion. A heat cycle test was carried out on this reactor to determine the state of the resin.

The basic configuration of the reactor used in the heat cycle test was similar to that of reactor 1α in the first embodiment, and the coil molded unit containing the inside core portion as described in the modification 1-8 was used.

The molding condition of the inside resin portion was set such that the molding temperature was 170° C. The thermal expansion coefficient $\alpha_{pi}$ at this molding temperature of the inside resin portion was $13\times10^{-6}$/K. The molding condition of the outside resin portion was set such that the molding temperature was 170° C. The thermal expansion coefficient $\alpha_{po}$ at this molding temperature of the outside resin portion was $19\times10^{-6}$/K. A powder compact of powder made of soft magnetic material was used for the magnetic core. The thermal expansion coefficient $\alpha_c$ of this magnetic core at the molding temperature (170° C.) was $12\times10^{-6}$/K. That is, this reactor satisfies $\alpha_c<\alpha_{pi}<\alpha_{po}$ at the molding temperature (170° C.). The heat cycle test was carried out up to 100 cycles in the temperature range of −40° C. to 150° C., assuming the actual use environment of the reactor.

As a result, separation or a gap was not found between the outside resin portion and the outside core portion of the magnetic core as well as between the outside resin portion and the inside resin portion. Separation or a gap was not found either between the inside resin portion and the inside core portion of the magnetic core.

When coil molded unit 20α and inside core portion 31 are different members as in reactor 1α in the first embodiment, the thermal expansion coefficient of the magnetic core, the thermal expansion coefficient of the inside resin portion, and the thermal expansion coefficient of the outside resin portion may also satisfy the relation of $\alpha_c<\alpha_{po}$ and $\alpha_{pi}\leqq\alpha_{po}$.

(Modification 1-10)

In the manner described in the first embodiment, the opposite ends of wire 2*w* forming coil 2 are drawn out in the same direction (upward in FIG. 1) and at the same height. In this coil 2, when a terminal base (not shown) for fixing the terminal fittings connected to the ends of wire 2*w* is brought closer to the place where the wire is drawn out, the arrangement place of the terminal base is limited to the top portion of reactor 1α in FIG. 1. On the other hand, when it is assumed that the terminal base is arranged at a place other than the top portion of reactor 1α, the wiring path to the terminal base tends to be longer, depending on the location of the terminal base. Here, there may not be sufficient space for installing long wiring since other equipment or components are often arranged in the surrounding of the reactor. Therefore, the opposite ends of the wire forming the coil may be drawn out in a direction different from that of the first embodiment, or may be drawn out in directions different from each other, or may be drawn out at different heights, depending on the arrangement location of the terminal base, so as to shorten the wiring path to the terminal base as much as possible.

Specifically, in a coil including a pair of coil elements 2*a*, 2*b* coupled in parallel with each other, the ends of the wire forming coil elements 2*a*, 2*b* can be drawn out to the sides of coil elements 2*a*, 2*b*. For example, the following coils 2A to 2H shown in FIG. 6 and FIG. 7 can be used in place of coil 2 in the first embodiment.

In coil 2A shown in FIG. 6(I), a beginning end 21 and a terminal end 22 of wire 2*w* forming coil 2A are drawn out to the sides of coil elements 2*a*, 2*b* (outward in the parallel arrangement direction) in different directions. Here, beginning end 21 of wire 2*w* is drawn outward of one coil element 2*a* (to the left side), and terminal end 22 is drawn outward of the other coil element 2*b* (to the right side), so that beginning end 21 and terminal end 22 are present to the left and right, respectively, of coil elements 2*a* and 2*b*. Beginning end 21 and terminal end 22 are drawn out in the horizontal direction orthogonal to the axial direction of coil 2A and are arranged at the same height as the top portion of turns of coil 2A.

In the reactor having coil 2A, the terminal base connected to the end of wire 2*w* can be provided at a place other than the top portion of the reactor, thereby increasing degree of freedom of arrangement of the terminal base. The terminal base does not have to have such an integrated configuration that both beginning end 21 and terminal end 22 of wire 2*w* are fixed to one terminal base. For example, beginning end 21 and terminal end 22 of wire 2*w* each can be connected to an independent terminal base. Therefore, the size of the individual terminal base can be reduced as compared with when beginning end 21 and terminal end 22 are fixed to one terminal base. Furthermore, the ends of wire 2*w* are drawn out to the left and right directions of coil elements 2*a*, 2*b*, wherein the terminal base (not shown) for the beginning end 21 is arranged on the left side of coil element 2*a*, and the terminal base for terminal end 22 is arranged on the right side of coil element 2*b*, thereby shortening the wiring path of wire 2*w* drawn out from coil 2A to the terminal base.

It is noted that in coils 2A, and 2B to 2E described later, coil coupling portion 2*r* is located higher than the upper surface of turns of coil 2A (2B-2E). Specifically, coil coupling portion 2*r* is projected upward from the turns by about half the width of the coated flat wire. With this configuration, in coil 2A (2B to 2E), as compared with coil 2 in reactor 1α in the first embodiment, that is, coil 2 having coil coupling portion 2*r* formed coplanar with the turns, an extra space corresponding to the height about half the width of the coated flat wire is formed below coil coupling portion 2*r*. The height (upper surface) of the outside core portion can be raised within the range of this space, and the thickness of the outside core portion (the size of the magnetic core in the axial direction of the coil) can be reduced, accordingly. Therefore, the reactor including the magnetic core having the outside core portion with a small thickness is compact in which the projection area of the reactor as viewed from above can be reduced, if the volume is equivalent to that of magnetic core 3 of reactor 1α in the first embodiment.

Figure 6:
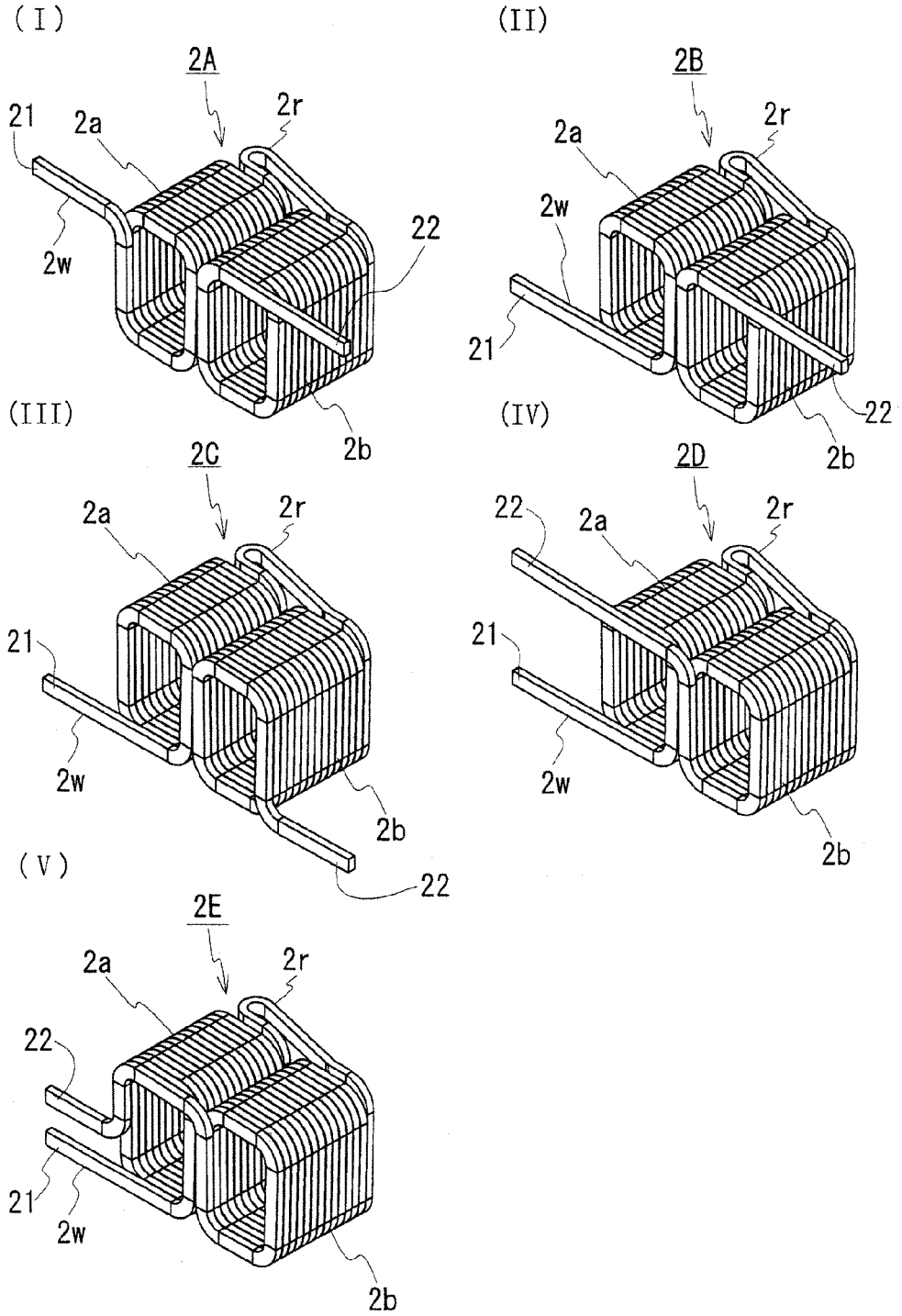
FIG. 6 is a perspective view showing another manner of the coil and showing a manner in which the ends of wire that forms the coil are drawn out to the side of the coil.

Alternatively, coil 2B shown in FIG. 6(II) is similar to coil 2A in FIG. 6(I) in that terminal end 22 of coil element 2*b* is drawn out to the right side at the lower portion of coil element 2*b*. However, coil 2B is different from coil 2A in that beginning end 21 of coil element 2*a* is drawn out to the left side at the lower portion of coil element 2*a*.

More specifically, in coil 2B, beginning end 21 and terminal end 22 of wire 2 are drawn out in different directions on the sides of coil 2B, that is, to the left and right, and the height of beginning end 21 and the height of terminal end 22 are different. Therefore, beginning end 21 and terminal end 22 of wire 2*w* can be connected to the respective independent terminal bases, and in addition, the arrangement heights of the terminal bases can be varied, for example, such that the terminal base for beginning end 21 is arranged at the lower portion of the side of coil 2B while the terminal base for terminal end 22 is arranged at the upper portion of the side of coil 2B. Therefore, the degree of freedom of arrangement of the terminal base can be further increased. In addition, the degree of freedom of the wiring path of wire 2*w* drawn out from coil 2B to the terminal base can be improved.

Alternatively, coil 2C shown in FIG. 6(III) is similar to coil 2B in FIG. 6(II) in that beginning end 21 of coil element 2*a* is drawn out to the left side at the lower portion of coil element 2*a*. However, coil 2C differs from coil 2B in that terminal end 22 of the other coil element 2*b* is drawn out to the right side at the lower portion of coil element 2*b*.

More specifically, in coil 2C, beginning end 21 and terminal end 22 of wire 2*w* are drawn out in different directions on the sides of coil 2C, that is, to the left and right, and the height of beginning end 21 is equal to the height of terminal end 22. Therefore, beginning end 21 and terminal end 22 of wire 2*w* can be connected to the respective independent terminal bases, and in addition, the terminal base for beginning end 21 and the terminal base for terminal end 22 are arranged at the lower portion on the sides of coil 2C. Therefore, the degree of freedom of arrangement of the terminal base can be increased. In addition, the degree of freedom of the wiring path of wire 2*w* drawn out from coil 2C to the terminal base can be improved.

Alternatively, coil 2D shown in FIG. 6(IV) is similar to coil 2B in FIG. 6(II) in that beginning end 21 of coil element 2*a* is drawn out to the left side at the lower portion of coil element 2*a*. However, coil 2D differs from coil 2B in that terminal end 22 of the other coil element 2*b* is drawn out to the left side at the upper portion of coil element 2*b*.

More specifically, in coil 2D, beginning end 21 and terminal end 22 of wire 2*w* are drawn in the same direction on the side of coil 2D, that is, to the left side, and the height of beginning end 21 and the height of terminal end 22 are different. Therefore, beginning end 21 and terminal end 22 of wire 2*w* can be connected to the respective independent terminal bases, and these terminal bases can be arranged in parallel in the height direction. Alternatively, when beginning end 21 and terminal end 22 of wire 2*w* are connected to one terminal base, the terminal base can be structured so as to be elongated in the height direction. This allows for installation of the terminal base even when the installation space of the terminal base is small in the plane direction.

Alternatively, coil 2E shown in FIG. 6(V) is similar to coil 2D in FIG. 6(IV) in that beginning end 21 of coil element 2*a* and terminal end 22 of coil element 2*b* are drawn out to the left side at the lower portion of one coil element 2*a*. However, coil 2E differs from coil 2D in that terminal end 22 of the other coil element 2*b* is drawn out at the middle in the height direction of coil element 2*a*.

More specifically, in coil 2E, beginning end 21 and terminal end 22 of wire 2*w* are drawn out in the same direction on the side of coil 2E, that is, to the left side, and the height of beginning end 21 and the height of terminal end 22 are different while beginning end 21 and terminal end 22 are close to each other. Therefore, in coil 2E, similar to coil 2D in FIG. 6(IV), beginning end 21 and terminal end 22 of wire 2*w* may be connected to the respective independent terminal bases, or beginning end 21 and terminal end 22 may be connected to one terminal base, and the installation space of the terminal base(s) in the height direction can be reduced.

On the other hand, in coil 2F shown in FIG. 7(I), the winding directions of a pair of coil elements 2*a* and 2*b* arranged in parallel are opposite to each other, and coil elements 2*a* and 2*b* are formed of separate wires 2*w*. In other words, coil element 2*a* is wound leftward from the front side toward the back in the drawing sheet in FIG. 7(I), and coil element 2*b* is wound rightward from the front side toward the back in FIG. 7(I). Coil coupling portion 2*r* coupling coil elements 2*a* and 2*b* extends from the other end side of one coil element 2*a* (the back side in the drawing sheet in FIG. 7(I)) to one end side of the other coil element 2*b* (the front side in the drawing sheet in FIG. 7(I)), and is formed by welding together the other end of wire 2*w* of one coil element 2*a* and one end of wire 2*w* of the other coil element 2*b*. Here, the one end side of wire 2*w* of the other coil element 2*b* is extended and bent as appropriate to reach the other end side of one coil element 2*a* thereby connecting to the other end of wire 2*w* pulled upward from the turn of coil element 2*a*.

Then, in coil 2F, one end (beginning end 21) of one coil element 2*a* is drawn out to the left side of coil element 2*a* at the upper portion of the one end side (the front side in the drawing sheet in FIG. 7(I)) of coil element 2*a*, and the other end (terminal end 22) of the other coil element 2*b* is drawn out to the right side of coil element 2*b* at the upper portion on the other end side (the back side in the drawing sheet in FIG. 7(I)) of coil element 2*b*.

In other words, in coil 2F, the ends of wires 2*w* of coil 2F are drawn to the left and right and also drawn at locations shifted in the axial direction of coil 2F (here, the positions shifted in the front-back direction). Therefore, the degree of freedom in arrangement of the terminal base connected to each end of wires 2*w* is increased. Furthermore, coil 2F has coil elements 2*a*, 2*b* independently formed and coil coupling portion 2*r* formed by welding, and therefore, the formability of the coil is excellent.

Figure 7:
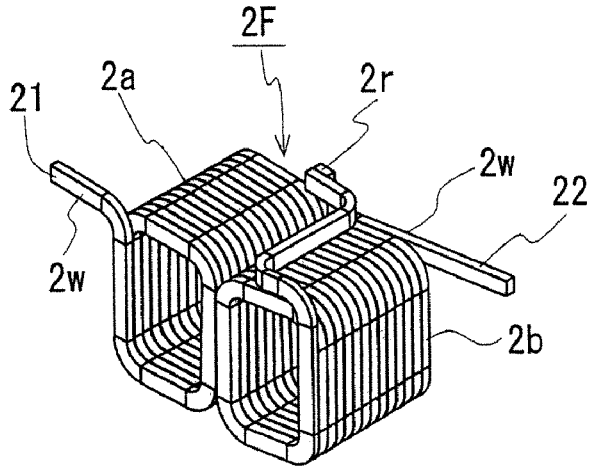
FIG. 7 is a perspective view showing another manner of the coil and showing a manner in which the ends of wire that forms the coil are drawn out to the side of the coil.
Figure 7:
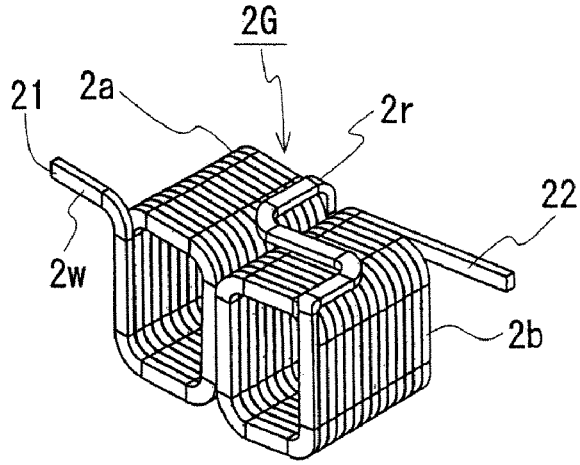
Figure 7:
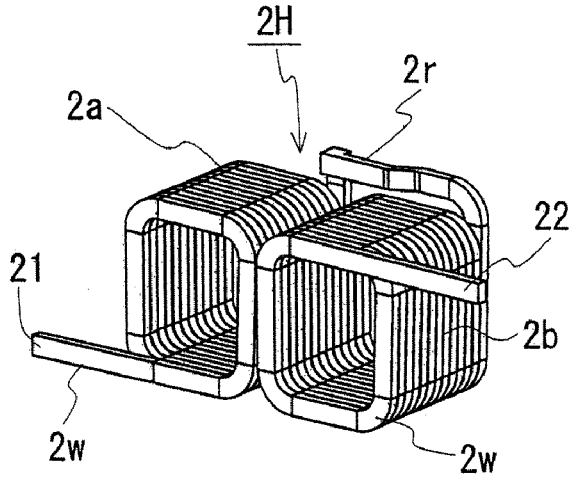

Coil 2G shown in FIG. 7(II) is similar to coil 2F in FIG. 7(I) in that the winding directions of a pair of coil elements 2*a* and 2*b* arranged in parallel are opposite to each other. However, coil 2G differs from coil 2F in that coil elements 2*a*, 2*b* are formed of a single continuous wire 2*w*. More specifically, in coil 2G, the other end side of one coil element 2*a* is bent and extended as appropriate toward the one end side of the other coil element 2*b* to continuously form coil element 2*b*. Therefore, coil coupling portion 2*r* is also formed of the above-noted single continuous wire 2*w*.

Then, also in this coil 2G, one end (beginning end 21) of one coil element 2*a* is drawn out to the left side of coil element 2*a* at the upper portion on the one end side (the front side in the drawing sheet in FIG. 7(II)) of coil element 2*a*, and the other end (terminal end 22) of the other coil element 2*b* is drawn out to the right side of coil element 2*b* at the upper portion on the other end side (the back side in FIG. 7(II)) of coil element 2*b*.

Also in this coil 2G, similar to coil 2F shown in FIG. 7(I), the ends of wire 2*w* of coil 2G are drawn out to the left and right and drawn at locations shifted in the front-back direction of coil 2G, thereby increasing the degree of freedom of arrangement of the terminal bases connected to the ends of wire 2*w*. In coil 2G, it is not necessary to weld individual coil elements 2*a*, 2*b*.

Coil 2H shown in FIG. 7(III) is similar to coil 2B in FIG. 6(II) in that beginning end 21 of one coil element 2*a* is drawn out to the left side at the lower portion of coil element 2*a* and terminal end 22 of the other coil element 2*b* is drawn out to the right side at the upper portion of coil element 2*b*. However, coil 2H differs from coil 2B in that coil elements 2*a*, 2*b* are formed of separate wires 2*w*. Coil coupling portion 2*r* is formed by welding together the other end of wire 2*w* of one coil element 2*a* and the other end of wire 2*w* of the other coil element 2*b*. Here, the other end side of wire 2*w* of the other coil element 2*b* is extended and bent as appropriate to reach the other end side of one coil element 2*a* thereby connecting to the other end of wire 2*w* pulled upward from the turn of coil element 2*a*. In this manner, even when coil elements 2*a*, 2*b* formed of separate wires 2*w* are welded together, the ends of coil elements 2*a*, 2*b* can be drawn out to the sides of coil 2H.

In another manner, the direction in which the end of the wire forming the coil is drawn out may not be along the parallel arrangement direction of the coil elements but may be inclined with respect to the parallel arrangement direction. The end of the wire drawn out from the turn of the coil may be bent and drawn out. For example, when the ends of wire of a pair of coil elements are drawn in the same direction on the side of the coil, the ends of the coils may be bent as appropriate so as to be arranged in parallel at the same height.

The foregoing modifications 1-1 to 1-10 may be combined. The foregoing modifications 1-1 to 1-10 can be also applied as appropriate to the second embodiment and modifications thereof described below.

Second Embodiment

In the following, referring to FIG. 8 to FIG. 13, a reactor 1β according to a second embodiment will be described. The basic configuration of reactor 1β is similar to reactor 1α according to the first embodiment. Specifically, reactor 1β includes a coil molded unit 20β (FIG. 9, FIG. 11) having coil 2 (FIG. 9, FIG. 11) formed by winding wire 2*w* (FIG. 9, FIG. 11) and inside resin portion 4 (FIG. 9, FIG. 11) covering the outer circumference of coil 2, and magnetic core 3 (FIG. 9) having inside core portions 31 (FIG. 9, FIG. 10) inserted into coil 2 and outside core portions 32 (FIG. 9) coupled to inside core portions 31 to form a closed magnetic circuit, and an outside resin portion 5β (FIG. 8, FIG. 9) covering the outer circumference of combination unit 10 (FIG. 9, FIG. 12) of coil molded unit 20β and magnetic core 3. Similar to reactor 1α in the first embodiment, this reactor 1β can be used as, for example, a circuit component of a vehicle-mounted converter with the flat bottom surface shown in FIG. 8(II) serving as an installation surface.

Figure 12:
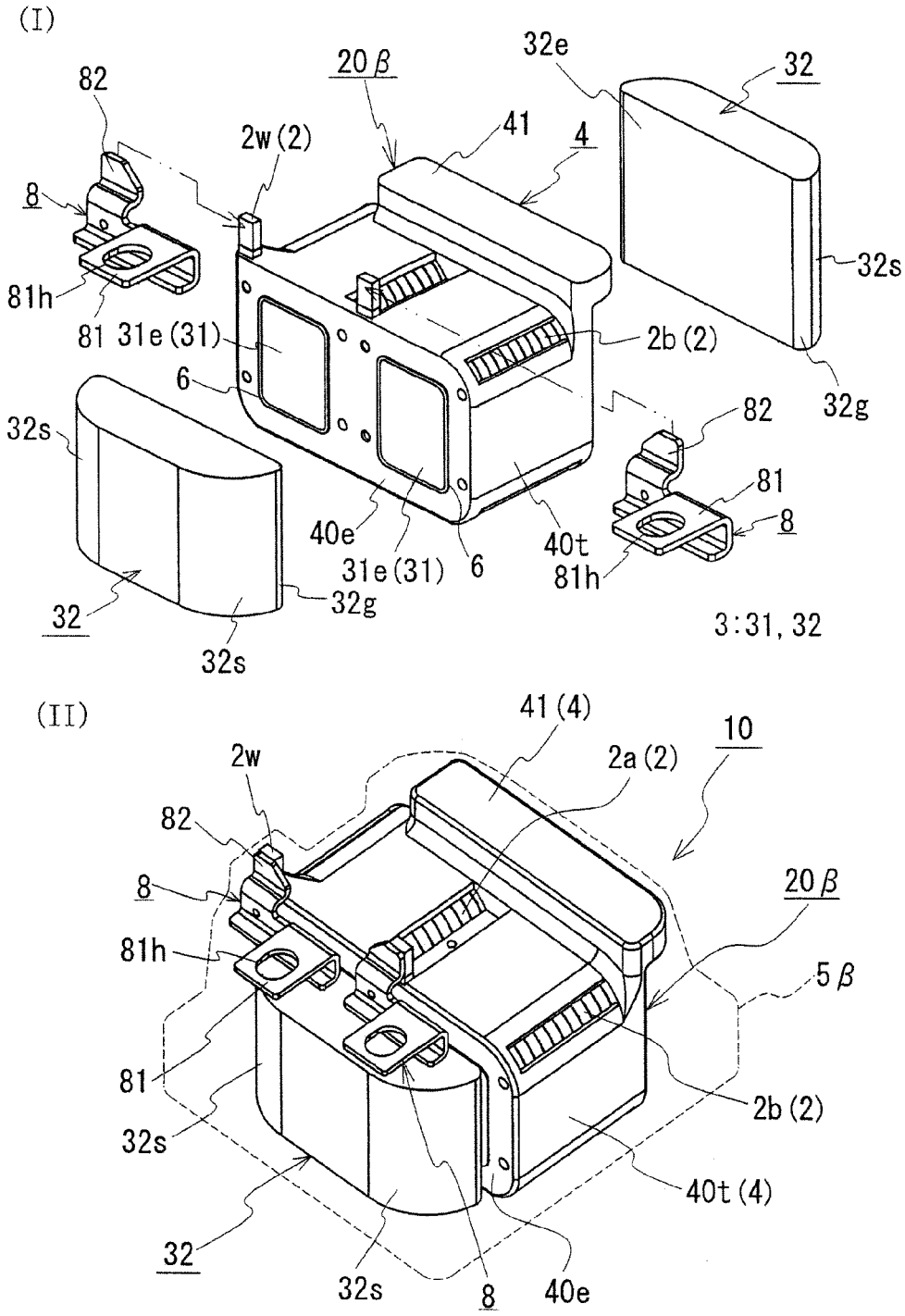
Figure 13:
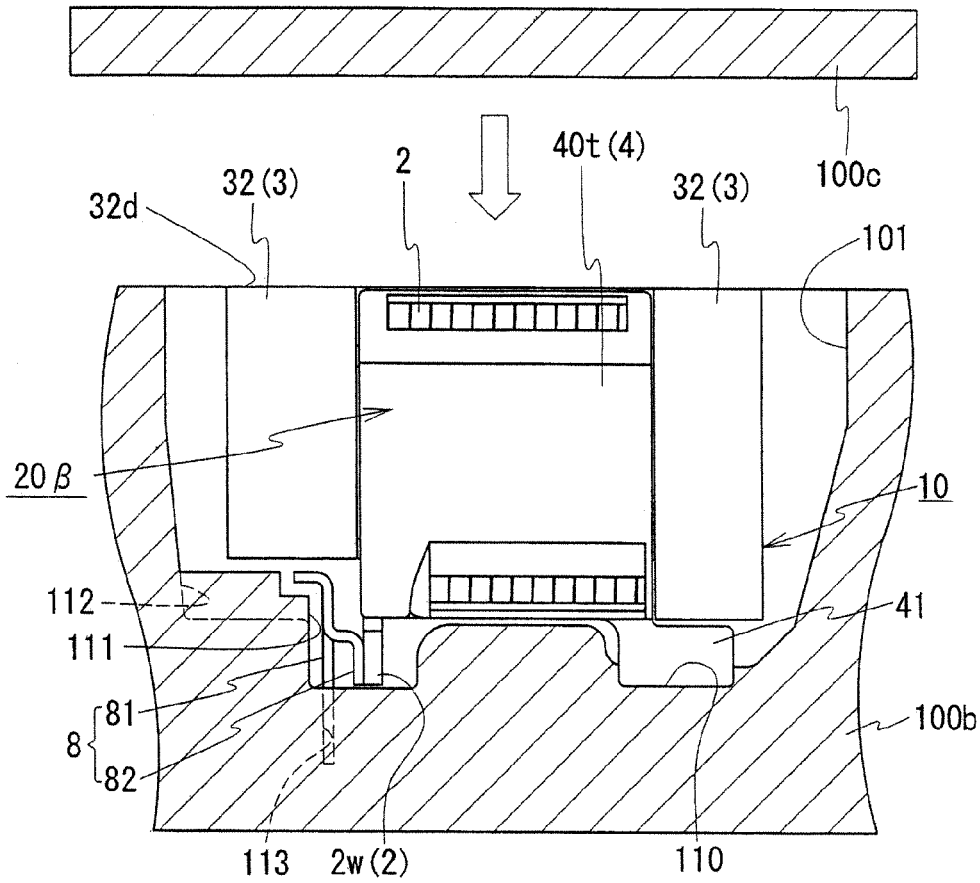
FIG. 13 is a cross-sectional view schematically showing a state in which the combination unit of the coil molded unit and the magnetic core to be included in the reactor in the second embodiment is accommodated in a molding die.

Reactor 1β mainly differs from reactor 1α in the first embodiment in that part of magnetic core 3 is integrally provided in coil molded unit 20β, that a positioning portion is integrally formed in inside resin portion 4, that a cushion member 6 (FIG. 9, FIG. 10) is provided, and that terminal fitting 8 (FIG. 8(I), FIG. 12, FIG. 13) is integrally provided. In the following, the differences and effects thereof will be mainly described, and therefore, a detailed description of the configurations and effects in common with the first embodiment will be omitted.

<Combination Unit>

[Coil Molded Unit]

First, coil molded unit 20β will be described mainly referring to FIG. 11. Coil molded unit 20β includes coil 2, inside resin portion 4 covering most of the outer circumference of coil 2, inside core portions 31 of magnetic core 3, cushion members 6, and the positioning portion formed of the constituent resin of inside resin portion 4.

In particular, in the second embodiment, inside core portions 31 are integrally formed with coil molded unit 20β. Furthermore, in the second embodiment, cushion member 6 is provided on the outer circumference of inside core portion 31 such that cushion member 6 is interposed between coil 2 and inside core portion 31 in order to prevent a crack at that portion (interposed resin portion 4*i* (FIG. 9)) of inside resin portion 4 which is interposed between cushion member 6 and coil 2 even when reactor 1β is subjected to heat cycles. In the second embodiment, the positioning portion (here, coupling portion covering portion 41 described later) formed of the constituent resin of inside resin portion 4 facilitates the positioning of combination unit 10 into a molding die 100 as shown in FIG. 13 in molding of outside molded portion 5β.

(Coil)

Coil 2 is almost similar to that in reactor 1α in the first embodiment except for the manner of coil coupling portion 2*r*. Specifically, coil 2 is formed such that a pair of coil elements 2*a*, 2*b* formed of one continuous wire 2*w* are arranged in parallel and coupled by coil coupling portion 2*r*. The opposite ends of coil 2 are drawn out upward from a turn formation surface 2*f* of coil 2 and connected to terminal fittings 8 (FIG. 12) and are covered with outside resin portion 5β together with terminal fittings 8 (FIG. 8(I)). Coil coupling portion 2*r* is pulled upward from turn formation surface 2*f* further than coil coupling portion 2*r* of coils 2A to 2E illustrated in the modification 1-10.

(Inside Resin Portion)

Similar as in coil molded unit 20α of reactor 1α in the first embodiment, inside resin portion 4 has the function of retaining the shape of coil 2 and holding each coil element 2*a*, 2*b* in the compressed state from its free length. Inside resin portion 4 has a turn covering portion 40*t* covering a turn portion 2*t* of coil 2 and a coupling portion covering portion 41 covering the outer circumference of coil coupling portion 2*r*. Turn covering portion 40*t* and coupling portion covering portion 41 are integrally molded, and turn covering portion 40*t* covers coil 2 at a substantially uniform thickness. Here, inside core portions 31 having cushion members 6 attached thereto are integrated with coil 2 by inside resin portion 4. Of turn covering portion 40*t*, an interposed resin portion 4*i* between cushion member 6 and coil 2 has also a substantially uniform thickness. The corner portions of coil elements 2*a*, 2*b* and the opposite ends of wire 2*w* are exposed from inside resin portion 4.

In particular, turn covering portion 40*t* (interposed resin portion 4*i*) covering the inner circumferential surfaces of coil elements 2*a*, 2*b* mainly has the functions of ensuring insulation between coil elements 2*a*, 2*b* and inside core portions 31, and positioning inside core portions 31 having cushion members 6 attached thereto with respect to coil elements 2*a*, 2*b*.

On the other hand, coupling portion covering portion 41 gives mechanical protection for coil coupling portion 2*r*. Then, at least part of coupling portion covering portion 41 functions as a positioning portion for positioning combination unit 10 with respect to molding die 100 as shown in FIG. 13 when outside resin portion 5β (FIG. 12(II)) is formed on the outside circumference of combination unit 10 (FIG. 12(II)) of coil molded unit 20β and magnetic core 3. Here, as shown in FIG. 11(II) and FIG. 12, coupling portion covering portion 41 is formed in the shape of a rectangular parallelepiped covering the U-shaped coil coupling portion 2*r* as a whole. However, it may be formed in the shape conforming to the shape of coil coupling portion 2*r* and may be formed in any other shape. Then, in the rectangular parallelepiped-shaped coupling portion covering portion 41, the portion used for positioning (in FIG. 8(I), the portion seen as a rectangular plate) is not covered with outside resin portion 5β as shown in FIG. 8(I), and inside resin portion 4 is exposed.

Figure 8:
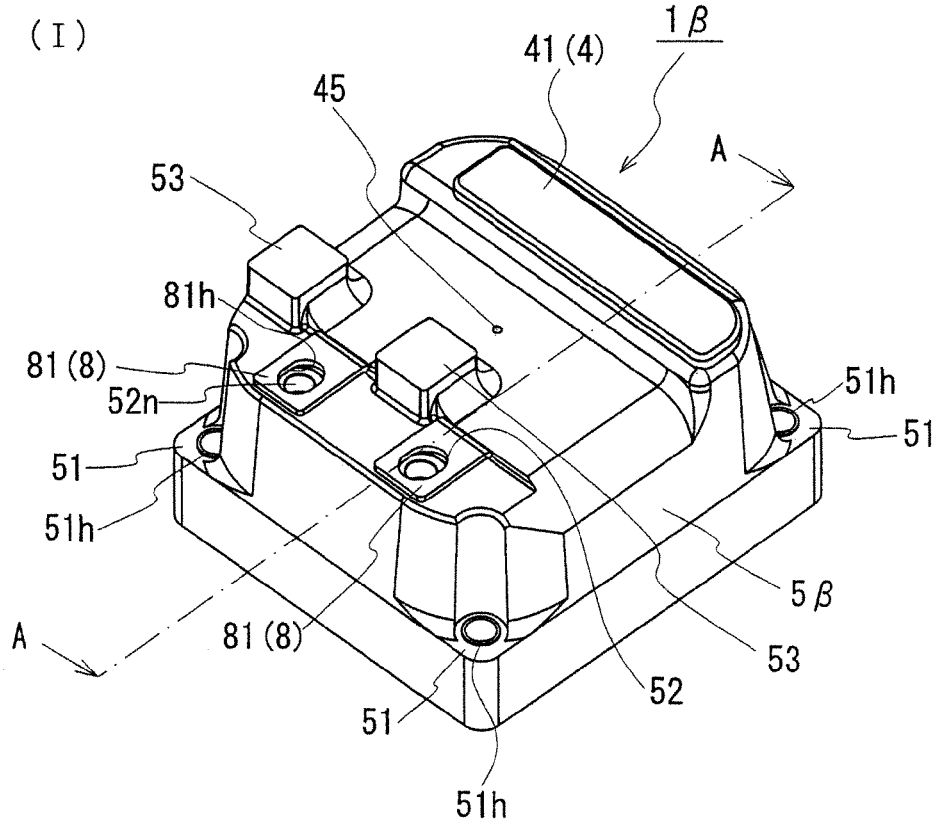
FIG. 8(I) is a perspective view schematically showing a reactor in a second embodiment arranged on a fixed object, and FIG. 8(II) is a plan view showing an installation surface of the reactor.
Figure 8:
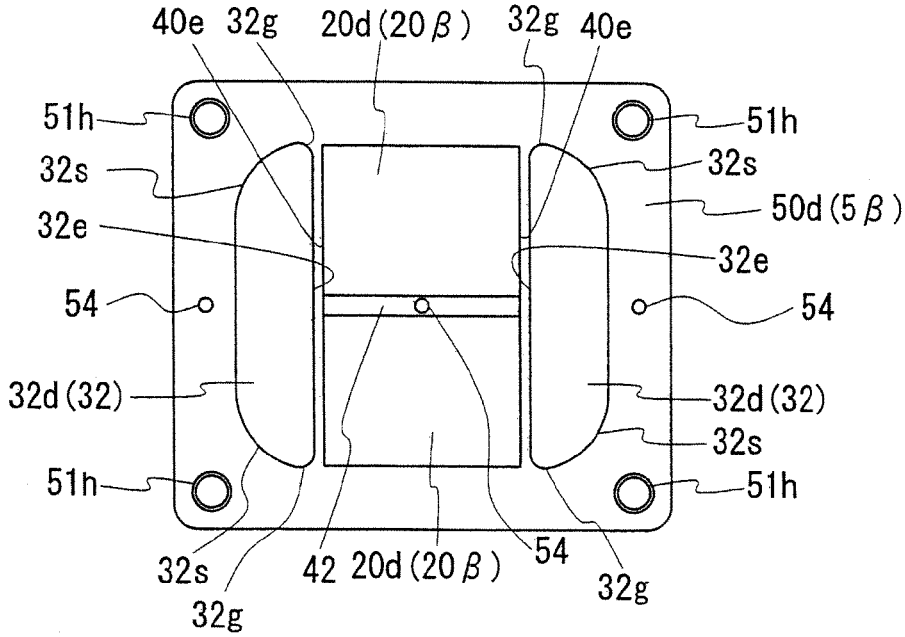

Coil molded unit 20β in the second embodiment also has depression 42 (FIG. 8(II) at that portion of inside resin portion 4 which covers a gap having a triangular cross section formed between coil elements 2*a* and 2*b*.

In addition, in the second embodiment, a sensor hole for accommodating a not-shown temperature sensor (for example, thermistor) is formed between coil elements 2*a* and 2*b* in inside resin portion 4. Here, a part of a sensor accommodating pipe (not shown) is insert-molded in inside resin portion 4, and the remaining part of the sensor accommodating pipe is covered with outside resin portion 5β to form a sensor hole 45 (FIG. 8(I)). The sensor accommodating pipe slightly protrudes from turn covering portion 40*t* of inside resin portion 4 that covers turn formation surface 2*f* of coil 2.

(Cushion Member)

Cushion member 6 has the function of alleviating excessive stress exerted on interposed resin portion 4*i* (FIG. 9) of inside resin portion 4, when reactor 1β (FIG. 8, FIG. 9) receives heat cycle, in particular, when the temperature decreases, and contraction of inside resin portion 4 is hampered by inside core portion 31.

Cushion member 6 is formed on the outer circumferential surface of inside core portion 31. This effectively prevents excess stress from acting on interposed resin portion 4*i* located between inside core portion 31 and coil 2 when reactor 1β receives heat cycle. This cushion member 6 may be a plane-like member covering the entire outer circumferential surface of inside core portion 31 or may be a mesh-like or lattice-like member almost uniformly and partially covering the outer circumferential surface. However, the outer circumferential surface of outside core portion 32 is not covered with cushion member 6. Since outside core portion 32 is not covered with cushion member 6, high heat dissipation performance of reactor 1β is ensured.

The material of cushion member 6 is preferably a material having Young's modulus smaller than the constituent resin of inside resin portion 4. Cushion member 6 formed of such a material functions as a cushion and prevents a crack of interposed resin portion 4*i* since cushion member 6 is elastically deformed when inside resin portion 4 contracts. Here, a heat-shrinkable tube "SUMITUBE K" or "SUMITUBE B2" (SUMITUBE is a registered trademark) manufactured by SUMITOMO ELECTRIC FINE POLYMER, INC. is used for cushion member 6. "SUMITUBE K" is formed of polyvinylidene fluoride (PVDF) as a base resin, and "SUMITUBE B2" is formed of polyolefin resin as a base resin. Young's modulus of epoxy resin is about 3.0 GPa to 30 GPa whereas Young's modulus of these heat-shrinkable tubes is about less than 3.0 GPa. The suitable Young's modulus of the constituent material of cushion member 6 is about 0.5 GPa to 2 GPa.

The constituent material of cushion member 6 preferably has the heat-resistant/cold-resistant characteristic similar to that of the constituent resin of inside resin portion 4. The continuous usable temperature range of "SUMITUBE K" is −55° C. to 175° C., and the continuous usable temperature range of "SUMITUBE B2" is −55° C. to 135° C. Other preferable characteristics of the constituent material of cushion member 6 include insulation performance. Generally, because of the insulating coat such as enamel on wire 2*w*, cushion member 6 is not essentially formed of insulating material, and theoretically, it may be formed of conductive material or semiconducting material. However, assuming that pin holes may be present in the insulating coat such as enamel, cushion member 6 is formed of insulating material to ensure insulation between coil 2 and inside core portion 31 with high reliability. In this respect, either "SUMITUBE" above has high insulation performance. As another example, a heat-shrinkable tube using fluoropolymer (for example, PTFE, usable temperature: about 260° C.) or flame-retardant hard polyvinyl chloride (PVC, usable temperature: about 200° C.) as a material can be expected to be used as cushion member 6 because of its heat resistance and insulation performance.

A variety of manners and methods of forming cushion member 6 can be used, other than heat-shrinkable tubes. For example, a cold-shrinkable tube may be used. The cold-shrinkable tube may be formed of a material with good stretchability, specifically, a material such as silicone rubber (VMQ, FVMQ: usable temperature 180° C.). Other examples of the material include butyl rubber (IIR), ethylene propylene rubber (EPM, EPDM), Hypalon (a registered trade mark, generally known as chlorosulfonated polyethylene rubber, CSM), acrylic rubber (ACM, ANM), and fluoro rubber (FKM). The materials above are preferable in that their usable temperature is 150° C. or higher and the insulation performance is such that the volume resistivity is 1010Ω·m or more. This cold-shrinkable tube is attached to inside core portion 31 using the shrinkage ability of the tube itself. Specifically, a cold-shrinkable tube having an inner circumferential length smaller than the outer circumferential length of inside core portion 31 is prepared and is fitted on the outer circumferential surface of inside core portion 31 with the diameter of the tube being expanded. The expanded diameter is reset in this state, so that the tube is contracted and attached onto the outer circumferential surface of inside core portion 31.

Alternatively, a mold layer molded by a molding die may be used as a cushion member. In this case, inside core portion 31 is held in the molding die with a gap formed between the outer circumferential surface of inside core portion 31 and the inner surface of the molding die, and a molding material such as resin is poured into the molding die to form a mold layer on the outer circumferential surface of inside core portion 31. A thin mold layer suffices as long as it has a cushion performance to such a degree that a crack of interposed resin portion 4*i* can be prevented. Specifically, for example, unsaturated polyester or polyurethane can be expected as the constituent resin of the mold layer.

Alternatively, a coating layer can also be used for the cushion member. In this case, the coating layer may be formed by applying or spraying resin in the form of slurry on the outer circumferential surface of inside core portion 31 or by performing powder coating on the outer circumferential surface of inside core portion 31. Specifically, liquid silicone rubber can be expected as the constituent resin of the coating layer.

Alternatively, a tape winding layer can also be used for the cushion member. In this case, the cushion member can be formed easily by winding a tape material around the outer circumferential surface of inside core portion 31. The tape material is, for example, a PET tape.

In any of the foregoing manners, the thinner cushion member 6 is preferable in terms of heat dissipation as long as cushion member 6 has a thickness that provides such an elastic deformation amount that can prevent cracks of interposed resin portion 4*i* of inside resin portion 4. A multi-layer cushion member may be formed by combining the foregoing manners.

[Magnetic Core]

Magnetic core 3 (FIG. 12) included in reactor 1β in the second embodiment is formed in an annular shape and has a pair of rectangular parallelepiped-shaped inside core portions 31 formed by alternately stacking core pieces 31*m* (FIG. 9, FIG. 10) and gap members 31*g* (FIG. 9, FIG. 10), and a pair of outside core portions 32 (FIG. 12) each having a trapezoidal surface, similar as in reactor 1α in the first embodiment. Then, inside core portions 31 have cushion members 6 on the outer circumferences thereof and are integrated with coil 2 (FIG. 12) by inside resin portion 4 (FIG. 12) to form coil molded unit 20β (FIG. 12) as described above. Opposite end surfaces 31*e* of inside core portion 31 slightly protrude from end surfaces 40*e* of inside resin portion 4 (FIG. 12).

Figure 9:
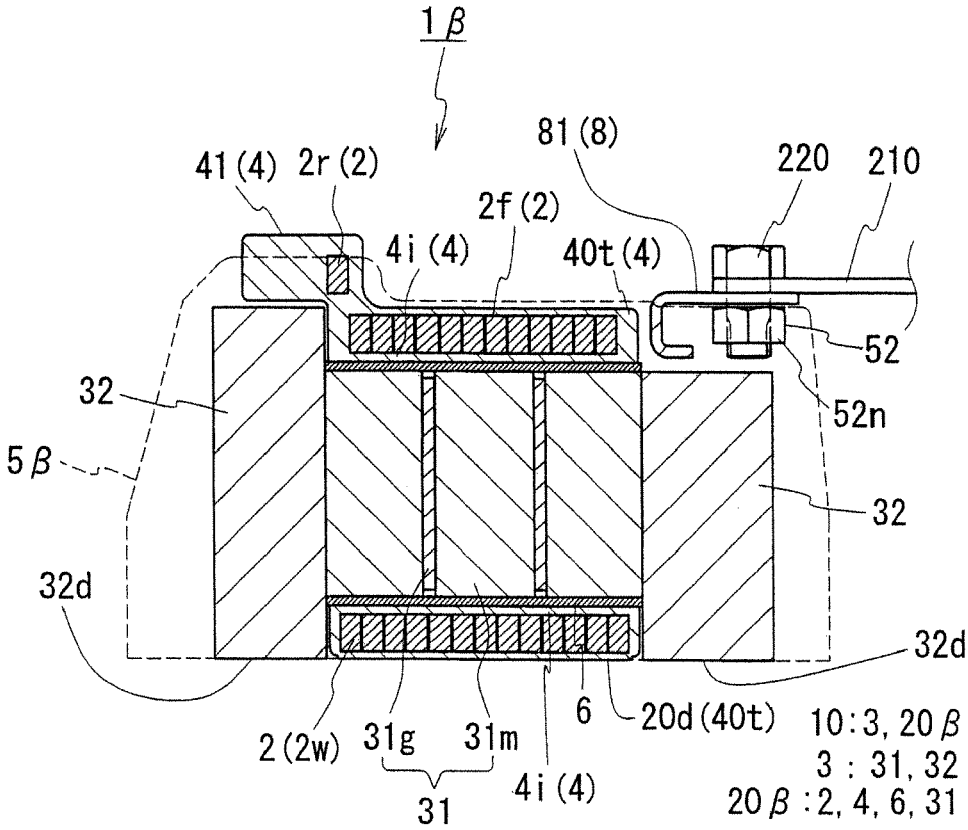
FIG. 9 is a cross-sectional view as viewed from arrows A-A in FIG. 8(I).

Similar as in reactor 1α in the first embodiment, in magnetic core 3, as shown in FIG. 9, core installation surface 32*d* of outside core portion 32 protrudes from the surface of inside core portion 31 that serves as the installation side, and is almost coplanar with molded unit installation surface 20*d* of coil molded unit 20β. Also with this configuration, when reactor 1β is installed on a fixed object, inside resin portion 4 and outside core portions 32 come into direct contact with the fixed object, so that heat generated in reactor 1β is efficiently released to the fixed object during use (in operation) of reactor 1β, resulting in excellent heat dissipation performance.

Furthermore, in magnetic core 3 in the second embodiment, outside core portions 32 have different heights as shown in FIG. 9. The top and bottom surfaces of one outside core portion 32 (the left side in FIG. 9) arranged below coil coupling portion 2*r* protrude from the top and bottom surface of inside core portion 31 and are almost coplanar with the top and bottom surfaces of turn covering portion 40*t* of coil molded unit 20β. By contrast, the bottom surface of the other outside core portion 32 (the right side in FIG. 9) arranged on the wire 2*w* end side protrude downward from the bottom surface of inside core portion 31 and is almost coplanar with the bottom surface of turn covering portion 40*t*, whereas the top surface of this outside core portion 32 is almost coplanar with the top surface of inside core portion 31 and is lower than the top surface of turn covering portion 40*t*. On the other hand, one outside core portion 32 (the left side in FIG. 9) has a thickness (the size in the coil axis direction) smaller than the other outside core portion 32 (the right side in FIG. 9). In other words, both outside core portions 32 have heights and thicknesses different from each other while the volumes of both outside core portions 32 are substantially equal, whereby the magnetic characteristics of outside core portions 32 are substantially equivalent. In addition, since coil coupling portion 2*r* is formed above turn formation surface 2*f*, one outside core portion 32 (the left side in FIG. 9) which is thinner and higher than the other outside core portion 32 (the right side in FIG. 9) can be arranged below coupling portion covering portion 41. This can reduce a projection area of reactor 1β. Furthermore, since the height of the other outside core portion 32 (the right side in FIG. 9) is reduced, terminal fittings 8 can be arranged above, and a terminal base can be formed with outside resin portion 5β. The lower limit of the height of outside core portion 32 is preferably set at such a degree that it is coplanar with the top surface of inside core portion 31. This is because if the top surface of the outside core portion is lower than the top surface of inside core portion 31, a sufficient magnetic path may be not be ensured in the course of transition from inside core portion 31 to the outside core portion.

Then, in magnetic core 3 in the second embodiment, as shown in FIG. 8(II) and FIG. 12, both outside core portions 32 having a trapezoidal cross section have a notched corner portion 32*g* formed by rounding a ridge line formed of an inner end surface 32*e* opposed to both of end surface 31*e* (FIG. 10, FIG. 12) of inside core portion 31 and end surface 40*e* of coil molded unit 20β, and a side surface 32*s* adjacent to this inner end surface 32*e*.

As described above, the rounded ridge line formed of inner end surface 32*e* and side surface 32*s* forms notched corner portion 32*g* having a uniform curvature along the vertical direction of outside core portion 32. This notched corner portion 32*g* is preferably formed when a powder compact is formed using a molding die corresponding to the rounded ridge line. Alternatively, a powder compact having a not-rounded ridge line may be formed, and thereafter the ridge line maybe processed, for example, by cutting, grinding, or polishing to form notched corner portion 32*g*. Here, the arc radius of notched corner portion 32*g* is 3 mm. The arc diameter can be selected as appropriate depending on the size of the reactor itself, and is suitably about not less than 1 mm and not more than 10 mm in the case of the reactor for use in a vehicle-mounted component. Here, the cross-sectional area of the outside core portion is set not to be equal or smaller than the cross-sectional area of the inside core portion. The cross-sectional shape of notched corner portion 32*g* is not limited to an arc shape and may be such that the ridge line is beveled in a flat plane.

Notched corner portion 32*g* forms a groove (FIG. 8(II)) between side surface 32*s* of outside core portion 32 and the side surface of turn covering portion 40*t* of coil molded unit 20β when coil molded unit 20β and outside core portions 32 are combined together to form combination unit 10. This groove functions as a guide groove for introducing the constituent resin of outside resin portion 5β between inner end surface 32*e* of outside core portion 32 and end surface 40*e* of coil molded unit 20β when outside resin portion 5β is molded on the outside of combination unit 10. In the state in which inside core portions 31 and outside core portions 32 are joined together, side surface 32*s* of outside core portion 32 protrudes outward from the outside surface of inside core portion 31, and end surface 40*e* of inside resin portion 4 covering almost the entire circumference of the end surface of coil 2, and end surface 31*e* of inside core portion 31 are opposed to inner end surface 32*e* of outside core portion 32.

<Terminal Fitting and Nut>

In reactor 1β in the second embodiment, as shown in FIG. 8(I), FIG. 9, and FIG. 12, terminal fittings 8 connected to the ends of wire 2*w* forming coil 2 as well as nut holes 52 are integrally molded with outside resin portion 5β, and nuts 52*n* fitted in nut holes 52, terminal fittings 8, and the constituent resin of outside resin portion 5β constitute a terminal base. In other words, reactor 1β is formed to integrally include a terminal base.

Mainly referring to FIG. 12, terminal fitting 8 will be described. Terminal fitting 8 includes a connection surface 81 for connecting to the side of an external device (not shown) such as power supply, a welded surface 82 welded to the end of wire 2*w*, and a buried portion which integrates connection surface 81 and welded surface 82 and is covered with outside resin portion 5β. Most of terminal fitting 8 is covered with outside resin portion 5β, and only connection surface 81 is exposed from outside resin portion 5β (FIG. 8(I)). Connection surface 81 is arranged above the other (the right side in FIG. 12) outside core portion 32 having the lower height as described above, and outside resin portion 5β fills between the top surface of outside core portion 32 and connection surface 81 to form a terminal base. Since terminal fitting 8 is arranged on the above-noted outside core portion 32 having the lower height, the height of the reactor including the terminal fittings can be reduced as compared with when a terminal base is formed with terminal fittings provided above the coil, resulting in a compact reactor 1β.

The shape of the terminal fitting shown in the second embodiment is shown by way of example, although any appropriate shape can be used. The shape of the terminal fitting can be selected as appropriate such that a terminal base is formed at a desired location in the reactor. For example, when a terminal base is provided in the vicinity of one (the right side in FIG. 12) outside core portion 32 on which coupling portion covering portion 41 (FIG. 12) covering coil coupling portion 2*r* is arranged, a terminal fitting may include a coupling portion having an appropriate length which connects between the welded portion of the terminal fitting that is welded to the end of wire 2*w* forming coil 2, and the connection portion connected to a terminal (not shown) provided at the tip end of wiring (not shown). When this coupling portion is formed as a buried portion covered with the outside resin portion, similar to the second embodiment, the outside resin portion can stably hold the terminal fitting.

In the terminal base as described above, nut 52*n* is arranged under connection surface 81 (FIG. 9). Nut 52*n* is accommodated in the anti-rotation lock state in nut hole 52 molded with outside resin portion 5β. The anti-rotation lock is embodied by fitting the hexagonal nut 52*n* into the hexagonal nut hole 52. Then, terminal fitting 8 is arranged such that connection surface 81 covers the opening of nut hole 52.

An insertion hole 81*h* having an inner diameter smaller than the diagonal size of nut 52*n* is formed in connection surface 81, so that connection surface 81 prevents nut 52*n* from pulling out of nut hole 52 (FIG. 8(I)). As shown in FIG. 9, when reactor 1β is used, a terminal 210 provided at the tip end of wiring (not shown) is placed on connection surface 81, and a bolt 220 passing through terminal 210 and connection surface 81 is screwed into to nut 52*n* whereby power is fed from an external device (not shown) connected to the base end of wiring to coil 2. Here, in the state in which terminal 210 and bolt 220 are attached to the terminal base, the height of connection surface 81 is set such that the top surface of bolt 220 is lower than a flat plane of outside resin portion 5β that extends between coupling portion covering portion 41 covering coil coupling portion 2*r* and a protection portion 53 (FIG. 8(I)) covering the welded portion between the end of wire 2*w* and terminal fitting 8. Therefore, the head portion of bolt 220 does not locally protrude from reactor 1β.

<Outside Resin Portion>

Similar as in reactor 1α in the first embodiment, outside resin portion 5β is formed such that molded unit installation surface 20*d* of coil molded unit 20β and core installation surfaces 32*d* of outside core portions 32 are exposed (FIG. 8(II)) and such that most of the top surface and the entire outer side surface of combination unit 10 (FIG. 12) of coil molded unit 20β and magnetic core 3 (outside core portion 32) are covered.

Similar as in reactor 1α in the first embodiment, outside resin portion 5β is formed such that core installation surfaces 32*d* of outside core portions 32, molded unit installation surface 20*d* of coil molded unit 20β, and resin installation surface 50*d* of outside resin portion 5β are coplanar. Therefore, when reactor 1β is installed on a fixed object, these installation surfaces 20*d*, 32*d*, and 50*d* come into contact with the fixed object, so that reactor 1β can be installed stably and heat generated in reactor 1β can be released efficiently, resulting in reactor 1β excellent in heat dissipation.

On the other hand, combination unit 10 can be mechanically protected by covering the top surface and outer side surface of combination unit 10 with outside resin portion 5β as described above. It is noted that the top surface of coupling portion covering portion 41, which is used for positioning combination unit 10 in molding of outside resin portion 5β, is exposed from outside resin portion 5β (FIG. 8(I)).

Outside resin portion 5β has flange portions 51 protruding outward from the outline of combination unit 10, similar as in reactor 1α in the first embodiment. Through holes 51*h* are provided in flange portions 51 (FIG. 8).

Furthermore, the top surface of outside resin portion 5β has protection portion 53 (FIG. 8(I)) which covers a joint portion (FIG. 12(II)) between the end of wire 2*w* forming coil 2 and terminal fitting 8. Protection portion 53 is molded in the shape of an approximately rectangular block. In addition, on the top surface of outside resin portion 5β, sensor hole 45 is formed which is molded coplanar with the tip end of the sensor accommodating pipe protruding from inside resin portion 4.

Then, in the second embodiment, as shown in FIG. 8(I), the side surface of outside resin portion 5β is formed of an inclined surface expanding from the upper portion toward the lower portion of reactor 1β. With the provision of such an inclined surface, when outside resin portion 5β is molded with combination unit 10 of coil molded unit 20β and the magnetic core (outside core portion 32) in a handstand state (FIG. 13), the molded reactor 1β can be easily removed from molding die 100.

Here, unsaturated polyester is used as the constituent resin of outside resin portion 5β. Unsaturated polyester is preferable because it is strong and less likely cause a crack, is heat-resistant, and is relatively cheap.

<Assembly Procedure of Reactor>

Reactor 1β having the configurations as described above can be configured basically similarly to reactor 1α in the foregoing first embodiment. However, in the first molding step of obtaining coil molded unit 20β, inside core portions 31 having cushion members 6 attached thereto are prepared, and these inside core portions 31 and coil 2 are integrated by inside resin portion 4. A brief description will be given below, and a detailed description in common with the first embodiment will be omitted.

(1) First Molding Step: Production of Coil Molded Unit

Figure 10:
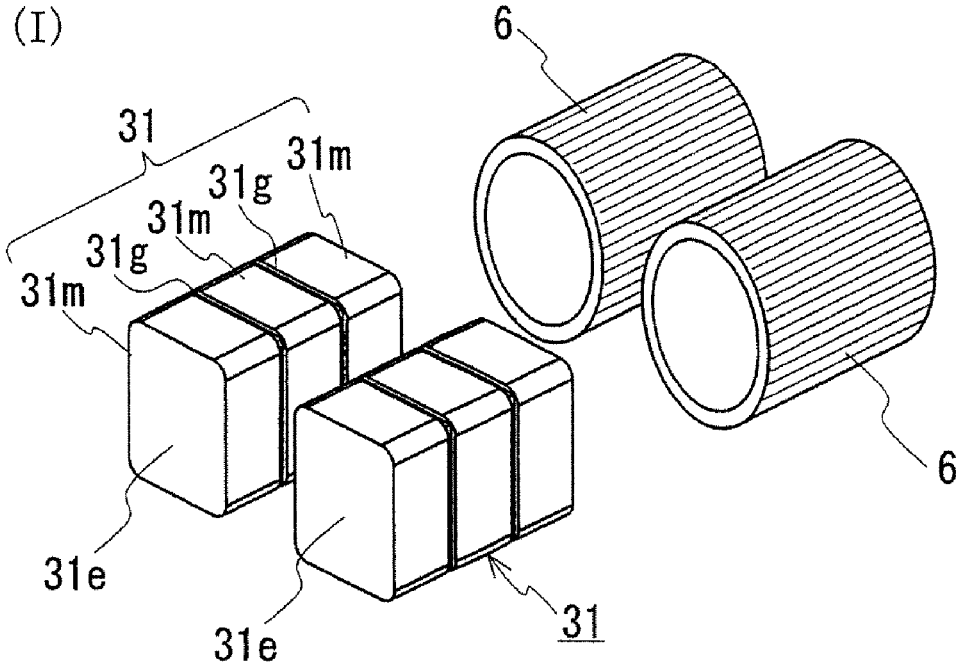
Figure 10:
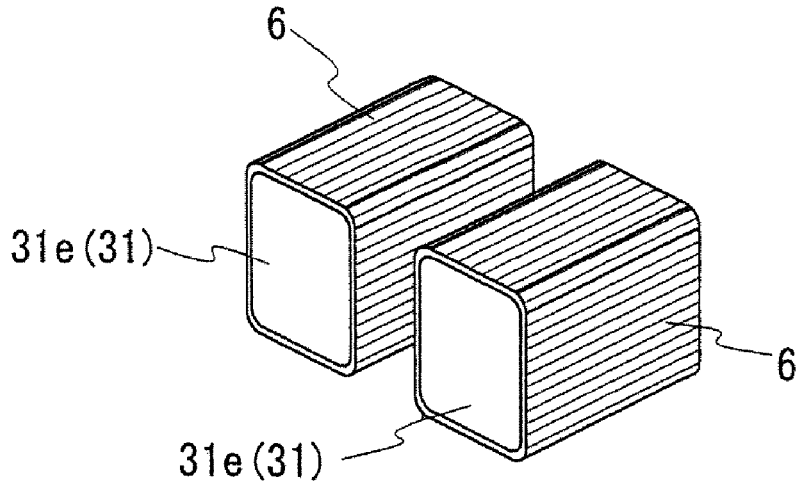

As described in the first embodiment, coil 2 is prepared. In addition, as described in the first embodiment, inside core portions 31 are prepared by fixing core pieces 31*m* and gap members 31*g*, for example, by adhesive (FIG. 10(I)). As shown in FIG. 10(II), heat-shrinkable tubes serving as cushion members 6 are fitted on the outer circumferences of inside core portions 31 and then heated and shrunken so as to be attached on the outer circumferences of inside core portions 31. Then, as shown in FIG. 11(I), inside core portions 31 having cushion members 6 attached are inserted into the inside of coil elements 2*a*, 2*b* of coil 2. Then, in order to mold inside resin portion 4 on the outer circumference of the combination of coil 2 and inside core portions 31 with cushion members 6, the combination is accommodated in a molding die similar to the molding die (formed to include a first die and a second die) described in the first embodiment. However, in the second embodiment, cores are not necessary since inside core portions 31 having cushion members 6 attached are provided in place of the rectangular parallelepiped-shaped cores.

When this combination is accommodated in the molding die, here, the portions corresponding to the corner portions of coil elements 2*a*, 2*b* are supported by convex portions (not shown) of the molding die such that a certain gap is formed between the inner surface of the molding die except the convex portions and the outer circumferential surface of coil 2. Furthermore, end surfaces 31*e* of inside core portions 31 having cushion members 6 attached are supported by concave portions of the molding die such that a certain gap is also formed between cushion members 6 and coil elements 2*a*, 2*b*. The resin filling the gap serves as interposed resin portion 4*i* (FIG. 9).

Next, similar as in the first embodiment, a plurality (here, eight in total) of rods provided for the molding die are advanced in the molding die to press the corner portions of the end surfaces of coil elements 2*a*, 2*b* thereby to compress coil 2. In the second embodiment, the above-noted sensor accommodating pipe (not shown) for forming sensor hole 45 is arranged at a predetermined location of coil 2 in the compressed state in the molding die.

Figure 11:
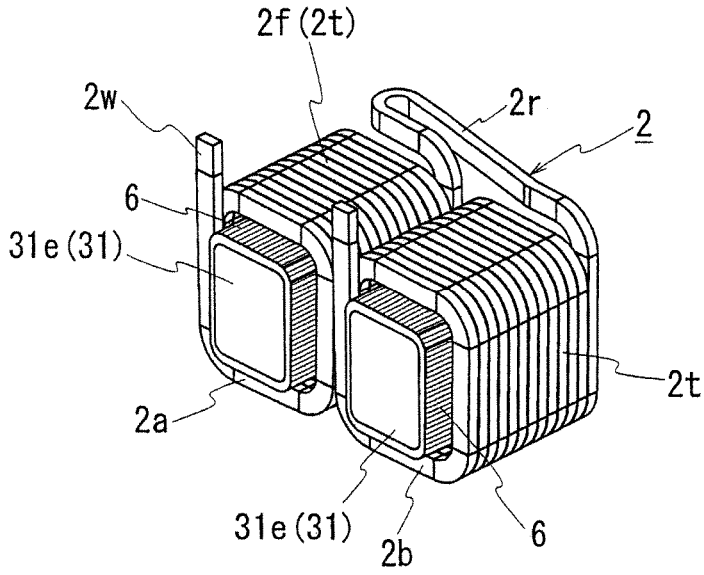
Figure 11:
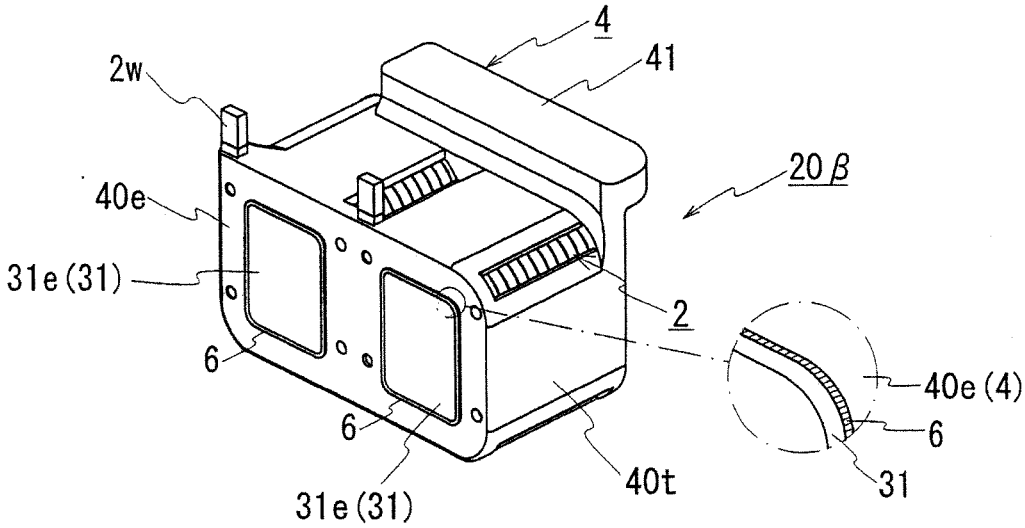

Thereafter, the constituent resin of inside resin portion 4 is poured from the resin injection port into the molding die, and when the resin sets, as shown in FIG. 11 (II), coil molded unit 20β is molded in which coil 2 is held in the compressed state by inside resin portion 4 and inside core portions 31 with cushion members 6 are integrated therein. This coil molded unit 20β is removed from the molding die.

(2) Assembly Step: Production of Combination Unit

First, as shown in FIG. 12(I), terminal fittings 8 are welded to the ends of wire 2*w* of the produced coil molded unit 20β. In the step of welding, as shown in FIG. 13, connection surface 81 of terminal fitting 8 is arranged approximately in parallel with welded surface 82 and extend in the vertical direction in FIGS. 12 and 13. This connection surface 81 is bent approximately at 90° so as to cover nut 52*n* after molding of outside resin portion 5β (FIG. 8(I)).

Then, end surfaces 31*e* of both inside core portions 31 are sandwiched between outside core portions 32, and end surfaces 31*e* of inside core portions 31 and inner end surfaces 32*e* of outside core portions 32 are joined by adhesive to form the annular magnetic core 3, resulting in combination unit 10 of coil molded unit 20β and magnetic core 3.

(3) Second Molding Step

Next, molding die 100 is prepared for forming outside resin portion 5β on the outer circumference of combination unit 10 obtained in the assembly step. Here, molding die 100 has a container-like base portion 100*b* having an opening at the top and a cover portion 100*c* closing the opening of base portion 100*b*, as shown in FIG. 13. Combination unit 10 is accommodated in a cavity 101 of base portion 100*b* in a handstand state with the top surface shown in FIG. 12(II) facedown.

The bottom surface of cavity 101 of base portion 100*b* is formed so as to shape the outer shape of outside resin portion 5β shown in FIG. 8(I), that is, mainly the shape on the top surface side of the outside shape of reactor 1β. Specifically, a concave groove 110 is formed in the bottom surface of cavity 101 of base portion 100*b*, so that part of coupling portion covering portion 41 (the top surface-side portion) of coil molded unit 20β can be fitted in this concave groove 110. Combination unit 10 can be easily positioned at a predetermined location in cavity 101 by fitting coupling portion covering portion 41 into concave 110. In this manner, part of coupling portion covering portion 41 functions as a positioning portion for combination unit 10 with respect to molding die 100.

In addition, in the bottom surface of cavity 101 of base portion 100*b*, formed are a concave portion 111 for forming protection portion 53 (FIG. 8(I)) covering the joint portion between the end of wire 2*w* and terminal fitting 8, a convex portion (not shown) for molding nut hole 52 (FIG. 9) in which nut 52*n* (FIG. 9) is fitted, a concave portion 112 for forming a terminal base, and a concave portion 1β in which connection surface 81 of terminal fitting 8 is inserted in a state extending in parallel with welded surface 82. In cavity 101, the portion for forming the side surface of outside resin portion 5β is formed of an inclined surface expanding toward the opening.

The surface of cover portion 100*c* that is opposed to base portion 100*b* is a flat plane so as to form the installation surface of reactor 1β in a flat surface. When the surface of cover portion 100*c* that is opposed to base portion 100*b* is a flat plane, a defect is less likely to occur in outside resin portion 5β since projections/depressions where the air tends to be accumulated are not present in cover portion 100*c* when resin is poured into molding die 100 sealed by cover portion 100*c*. In addition, because of the absence of projections/depressions, cover portion 100*c* is hardly damaged and easily put when cover portion 100*c* is put on base portion 100*b*.

Here, three resin injection gates in total (not shown) are formed on the same straight line in cover portion 100*c*. When combination unit 10 is arranged in base portion 100*b*, an inside gate located at the middle of the three gates is opened toward the gap between a pair of coil elements 2*a* and 2*b* (FIG. 11) arranged in parallel, and the other two outside gates sandwiching the inside gate are opened each at a location away from outside core portion 32 along the axial direction of coil 2, that is, the location where outside core portion 32 is sandwiched between the outside gate and the inside gate. The arrangement location of the resin injection port, the shape of the opening of the gate, and the number of gates can be selected as appropriate depending on the size of the reactor to be formed. Furthermore, when cover portion 100*c* is closed, a gap for air vent (not shown) is provided as appropriate at a contact surface between base portion 100*b* and cover portion 100*c*.

When the installation surface of reactor 1β is formed to be a flat plane where projections/depressions are not formed at all, resin may be poured into based portion 100*b* without using cover portion 100*c*. In this case, the liquid surface of the poured resin forms the installation surface of reactor 1β.

Combination unit 10 is arranged inside molding die 100. Specifically, part of coupling portion covering portion 41 of coil molded unit 20β of combination unit 10 is fitted in concave groove 110. Through this step, combination unit 10 is positioned in molding die 100. This fitting causes the end surface of the sensor accommodating pipe for forming sensor hole 45 to come into contact with the bottom surface of cavity 101 of base portion 100*b*. With the sensor accommodating pipe and the fitting as described above, combination unit 10 is supported on the bottom surface of cavity 101 and kept being arranged at the predetermined location in cavity 101. Furthermore, the joint portion between the end of wire 2*w* and terminal fitting 8 is inserted into concave portion 111, and connection surface 81 of terminal fitting 8 is inserted into concave portion 113.

Once combination unit 10 is arranged as described above, cover portion 100*c* is put on the opening of base portion 100*b* to close molding die 100. Then, the constituent resin of outside resin portion 5β is poured from the aforementioned resin injection gates into molding die 100. When molding die 100 is closed, a sealed space is produced between base portion 100*b* and cover portion 100*c*, except the gap for air vent.

In the second embodiment, notched corner portion 32*g* of outside core portion 32 forms a groove between end surface 40*e* of coil molded unit 20β and outside core portion 32. The constituent resin of outside resin portion 5β easily intrudes between inner end surface 32*e* of outside core portion 32 and end surface 40*e* of coil molded unit 20β through this groove. As a result, the constituent resin of outside resin portion 5β sufficiently fills between coil molded unit 20β and outside core portion 32 without an empty hole being formed in outside resin portion 5β. Here, in addition to the provision of notched corner portion 32*g*, a slight gap (0.5 mm) is provided between inner end surface 32*e* of outside core portion 32 and end surface 40*e* of coil molded unit 20β. This gap facilitates the intrusion of the constituent resin of outside resin portion 5β between coil molded unit 20β and outside core portion 32.

Furthermore, here, the constituent resin of outside resin portion 5β is poured from both the inside and the outside of annular magnetic core 3 through a plurality of resin injection gates as described above, so that the pressure acting on core 3 from the inside toward the outside of core 3 and the pressure acting on core 3 from the outside toward the inside of core 3 are cancelled with each other. Therefore, the filling of the resin can be performed promptly without damage to magnetic core 3. This effect is particularly prominent when the injection pressure of the resin is high. The injection amounts of resin from the inside gate and from the outside gate may be equal. However, the injection amount of resin from the outside gate is preferably greater than the injection amount of resin from the inside gate since the outer circumference of combination unit 10 can be covered promptly. Furthermore, the injection amount of resin from the outside gate may be adjusted such that the outward pressure is higher than the inward pressure so as to press outside core portion 32 toward inside core portion 31, or the outward pressure and the inward pressure may be mostly cancelled out with each other.

When the molding of outside resin portion 5β is finished, molding die 100 is opened to remove reactor 1β from the inside. Here, the opening side of cavity 101 is formed to be an inclined surface thereby facilitating removal of reactor 1β. On resin installation surface 50*d* of the resulting reactor 1β, three gate marks 54 are formed in which the shape of the openings of the resin injection gates is transferred, as shown in FIG. 8(II).

Nut 52*n* (FIG. 9) is fitted in nut hole 52 of the removed reactor 1β. Connection surface 81 of terminal fitting 8 is then bent approximately at 90° as shown in FIG. 12 such that connection surface 81 covers the top portion of nut 52*n* (FIG. 8(I)). Reactor 1β is thus completed.

<Effects>

Reactor 1β in the second embodiment achieves the following effects, in addition to the effects achieved by reactor 1α in the first embodiment (typically, mechanical protection with a compact and case-free structure, good productivity with ease of handling of the coil, and excellent heat dissipation because of part of the magnetic core being exposed).

Since the outer circumference of inside core portion 31 is covered with cushion member 6, the stress caused by contraction of interposed resin portion 4*i* located between coil 2 and cushion member 6 is alleviated even when a heat cycle acts on reactor 1β, thereby preventing a crack in interposed resin portion 4*i*.

Reactor 1β has a positioning portion (here, coupling portion covering portion 41) which is integrally formed in inside resin portion 4 of coil molded unit 20β, so that combination unit 10 can be easily positioned in molding die 100 without separately using pins or bolts when outside resin portion 5β is formed. In this respect, reactor 1β is excellent in productivity.

In reactor 1β, since the positioning is performed without using pins separately prepared, the portions not covered with outside resin portion 5β in combination unit 10 can be effectively reduced. Although part of the positioning portion is exposed from outside resin portion 5β, this exposed portion is formed of inside resin portion 4. Therefore, reactor 1β sufficiently provides protection of coil 2 and magnetic core 3 from the external environment and mechanical protection with inside resin portion 4 and outside resin portion 5β.

Furthermore, in reactor 1β, since notched corner portion 32*g* is formed at the ridge line formed of inner end surface 32*e* and side surface 32*s* of outside core portion 32, the constituent resin of outside resin portion 5β sufficiently fills between inner end surface 32*e* of outside core portion 32 and coil molded unit 20β through this notched corner portion 32*g*. In particular, in reactor 1β, since notched corner portion 32*g* is provided at the ridge line with side surface 32*s* as described above, it can be reversely avoided that the magnetic path area formed in magnetic core 3 when coil 2 is excited is reduced because of the formation of this notched corner portion 32*g*. When the outside core portion is formed of a powder compact, the direction extending along the ridge line formed by the inner end surface and the side surface can correspond to the direction in which the outside core portion is removed from the molding die. If the notched corner portion is formed at the ridge line, the ridge line does not form an acute angle, so that the outside core portion can be easily removed from the molding die. Therefore, the outside core portion having such a notched corner portion is excellent in moldability, thereby contributing improvement of productivity of the reactor.

In addition, in reactor 1β, core installation surface 32*d* of outside core portion 32 of magnetic core 3 protrudes to increase the area of inner end surface 32*e* that is opposed to end surface 40*e* of coil molded unit 20β. Therefore, the gap between coil molded unit 20β and magnetic core 3 on the end surface side of the coil is closed, which makes it more difficult to fill the constituent resin of outside resin portion 5β between coil molded unit 20β and magnetic core 3 (outside core portion 32). However, even with magnetic core 3 having such a three-dimensional shape, the filling of the constituent resin can be performed smoothly because of the provision of notched corner portion 32*g* at the ridge line formed of inner end surface 32*e* and side surface 32*s*. Furthermore, since the corner portion of outside core portion 32 is rounded because of the formation of notched corner portion 32*g*, the handling ability is excellent, and chipping of outside core portion 32 hardly occurs when outside core portion 32 is grasped during assembly or conveyance.

In addition to the notched corner portion 32*g* described above, reactor 1β has a slight gap between end surface 40*e* of coil molded unit 20β and inner end surface 32*e* of outside core portion 32, thereby further facilitating the filling of the constituent resin of outside resin portion 5β between outside core portion 32 and coil molded unit 20β. The gap is preferably 0.5 mm or more. However, if it is too big, the reactor is too long in the axial direction of the coil, which makes size reduction difficult. Therefore, 4 mm or less is preferable. It is noted that a magnetic core not having the notched corner portion may be used, and only the gap having the above-noted specific size may be provided between the end surface of the coil molded unit and the inner end surface of the outside core portion. In the foregoing first embodiment, the gap is about 0.5 mm.

Reactor 1β is configured such that coil 2 and inside core portion 31 are integrated by inside resin portion 4. Therefore, the step of fitting inside core portions 31 into the coil molded unit can be omitted, so that the productivity of the reactor can be further enhanced.

Since sensor hole 45 is molded through molding of inside resin portion 4 and outside resin portion 5β, there is no need for forming sensor hole 45 through subsequent processing. Therefore, reactor 1β can be manufactured efficiently and is excellent in productivity. In addition, damage to coil 2 and magnetic core 3, which is a problem in the case where a sensor hole is subsequently processed, can be avoided.

The heights of a pair of outside core portions 32 are set different, and terminal fittings 8 are arranged on the outside core portion 32 having the lower height. Outside core portions 32 and coil molded unit 20β are integrally molded together with terminal fittings 8 by outside resin portion 5β. Therefore, the height of reactor 1β including terminal fittings 8 is not increased. Reactor 1β is thus compact.

Since terminal fittings 8 are integrally molded by outside resin portion 5β, the terminal base can be formed simultaneously with molding of outside resin portion 5β, thereby eliminating the member or operation for fixing a separately produced terminal base to reactor 1β. In this respect, reactor 1β is excellent in productivity.

In reactor 1β in the second embodiment, coil coupling portion 2*r* of coil 2 is set higher than turn formation surface 2*f* so that the height of outside core portion 32 is increased, while the thickness (the length in the coil axial direction) is reduced. Therefore, the projection area of reactor 1β can be reduced as described in the modification 1-10. In particular, when magnetic core 3 is formed of a powder compact of powder of soft magnetic material similar to that of the first embodiment, magnetic core 3 can be easily molded in which the height of outside core portion 32 and the height of inside core portion 31 are different.

Nut hole 52 is molded rather than integrally molding nut 52*n* by outside resin portion 5β, so that nut 52*n* is not present at the time of molding of outside resin portion 5β, thereby preventing intrusion of the constituent resin of outside resin portion 5β into the inside of the nut. On the other hand, after nut 52*n* is accommodated in nut hole 52, connection surface 81 of terminal fitting 8 is bent so that connection surface 81 covers the opening of nut hole 52, thereby easily preventing nut 52*n* from dropping off.

In molding of outside resin portion 5β, a plurality of resin injection gates are provided so as to pour resin more quickly than when one resin injection gate is provided. Also in this respect, reactor 1β is excellent in productivity. The use of a plurality of resin injection gates as described above prevents damage to magnetic core 3.

(Modification 2-1)

Figure 14:
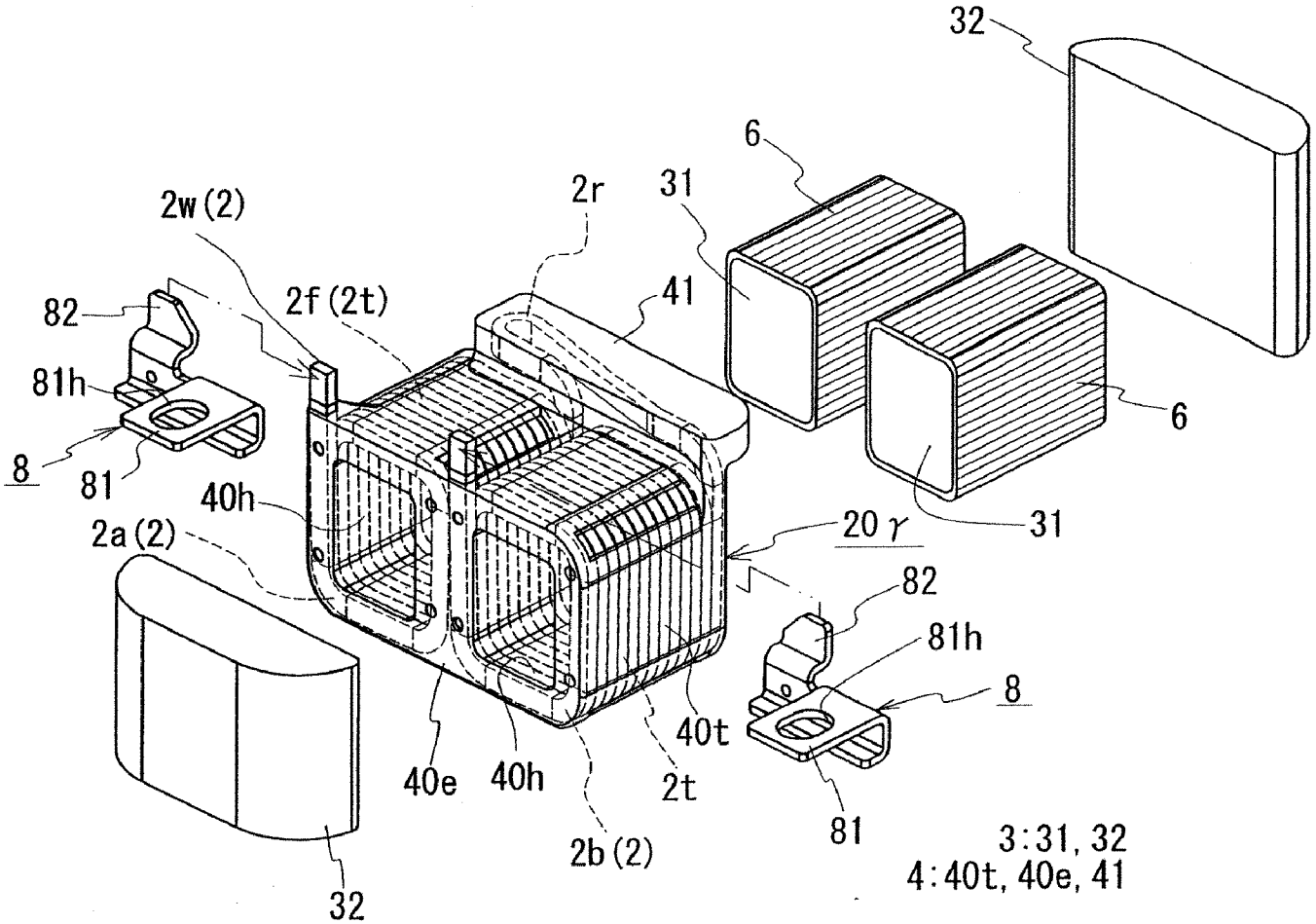
FIG. 14 is an exploded perspective view showing an assembly procedure of the combination unit of the coil molded unit and the magnetic core to be included in a modification of the second embodiment.

In the second embodiment, coil molded unit 20β is formed such that inside core portions 31 having cushion members 6 attached are integrated with coil 2 by inside resin portion 4. However, as in coil molded unit 20α described in the first embodiment, inside resin portion 4 may be molded so as to include hollow holes 40*h* through which inside core portions 31 are inserted. A coil molded unit 20γ shown in FIG. 14 is configured similarly to coil molded unit 20β of the second embodiment, except that inside core portions 31 are not integrally molded by inside resin portion 4, and includes hollow holes 40*h* as in coil molded unit 20α in the first embodiment. However, in coil molded unit 20γ, hollow hole 40*h* is sized such that inside core portion 31 having cushion member 6 attached can be inserted thereto. In this manner, coil 2 is arranged in a molding die for forming inside resin portion 4, and inside resin portion 4 is molded by pouring the constituent resin of inside resin portion 4 into the inside of coil 2 with cores arranged similarly to the first embodiment. Hollow holes 40*h* having the above-noted predetermined size are thus formed. Then, inside core portions 31 having cushion members 6 attached are inserted into hollow holes 40*h* formed of inside resin portion 4, and outside core portions 32 are then joined to inside core portions 31. Thereafter, the outside resin portion (not shown) is molded, resulting in a reactor including cushion members 6.

(Modification 2-2)

In the configuration described in the second embodiment, coil coupling portion 2*r* coupling a pair of coil elements 2*a* and 2*b* is elevated from turn portion 2*t*, and that portion (coupling portion covering portion 41) of inside resin portion 4 which covers the outer circumference of coil coupling portion 2*r* serves as a positioning portion. In another manner, the positioning portion may be formed only with the constituent resin of the inside resin portion. For example, a projection portion protruding from upper turn formation surface 2*f* of turn portion 2*t* of coil 2 can be integrally formed with the inside resin portion, and this projection portion can be used as the positioning portion. A plurality of such projections may be provided. A concave groove for forming the projection portion is provided as appropriate in a molding die for molding the inside resin portion.

Also in this manner, the positioning portion integrally formed with the inside resin portion is provided to facilitate the positioning of the combination unit of the coil molded unit and the magnetic core with respect to the molding die, resulting in good productivity of the reactor. In this manner, the coil coupling portion does not have to be elevated so high.

Alternatively, as described in the modification 1-4, when the coil is formed such that the coil elements are formed of separate wires and the coil coupling portion is formed by joining the ends of those wires by welding or the like, or when the coil molded unit has a pair of coil element molded units, the positioning portion is formed only with the constituent resin of the inside resin portion as described above, so that the coil molded unit having the positioning portion can be manufactured easily. In this manner, when the positioning portion is formed only with the constituent resin of the inside resin portion, the degree of freedom of the manner of the coil molded unit can be increased.

When the coil has the coil coupling portion joined by welding or the like as described above, similar as in the second embodiment, the positioning portion may have this coil coupling portion contained in the inside resin portion.

A variety of manners as to the positioning portion can also be applied as appropriate to reactor 1α not having a cushion member and the modifications 1-1 to 1-10.

(Modification 2-3)

In the configuration described in the second embodiment, the terminal base includes terminal fittings 8. However, the terminal fittings and the terminal base may be separate members as in reactor 1α in the first embodiment. The configuration as to the terminal fitting and the terminal base described in the second embodiment and a variety of manners as to the terminal fitting and the terminal base described later can also be applied to reactor 1α in the first embodiment without a cushion member and the modifications 1-1 to 1-10.

In the second embodiment, terminal fittings 8 are directly covered with the constituent resin of outside resin portion 5β. However, an intermediate molded unit may be produced separately beforehand by insert-molding terminal fittings 8 and nuts 52*n* with resin, and combination unit 10 of coil molded unit 20β and magnetic core 3 (outside core portion 32) and the intermediate molded unit may be integrated by the outside resin portion. The intermediate molded unit may be, for example, a block-shaped molded unit which is formed to cover the buried portion of fixing 8 and is placed on the top surface of outside core portion 32 having the lower height as described in the second embodiment. A nut hole for accommodating nut 52*n* described in the second embodiment may be formed in this intermediate molded unit, and connection surface 81 of terminal fitting 8 may be folded to face nut 52*n*. The constituent resin of the outside resin portion or the inside resin portion may be suitably used for the constituent resin of the intermediate molded unit. When resin of the same quality as the constituent resin of the outside resin portion is used, the contact with the outside resin portion is good. The use of the intermediate molded unit can protect terminal fittings 8 at the time of accommodation in a molding die, simplify the shape of the molding die, and facilitates accommodation of combination unit 10 in the molding die. In particular, when the terminal fitting has a complicated structure, the periphery of the terminal fitting can be sufficiently covered with resin using the intermediate molded unit. In the use of the intermediate molded unit, an arrangement groove in which the intermediate molded unit is arranged may be provided in part of the inside resin portion depending on the formation place of the terminal base, or a positioning portion for the inside resin portion may be formed with the constituent resin of the intermediate molded unit, so that the intermediate molded unit can be easily positioned, and the intermediate molded unit can be held stably in forming the outside resin portion.

In the configuration described in the second embodiment, nut 52*n* is fixed by bolt 220. However, the constituent resin of the outside resin portion or the constituent resin of the intermediate molded unit may be threaded, without a nut.

In a manner described in the second embodiment, the terminal base is provided on the upper side of reactor 1β. However, the terminal base may be provided on the side surface side of the reactor, for example, using a coil having the ends of wire 2*w* drawn out in a variety of directions as described in the modification 1-10.

Furthermore, in the second embodiment, protection portion 53 covering the welded portion between the end of wire 2*w* and terminal fitting 8 is formed of the constituent resin of outside resin portion 5β. However, the welded portion may be exposed from the outside resin portion. In this exposed manner, the end of the wire may be connected with the terminal fitting either before or after the terminal fitting is integrated with the outside resin portion.

Figure 15:
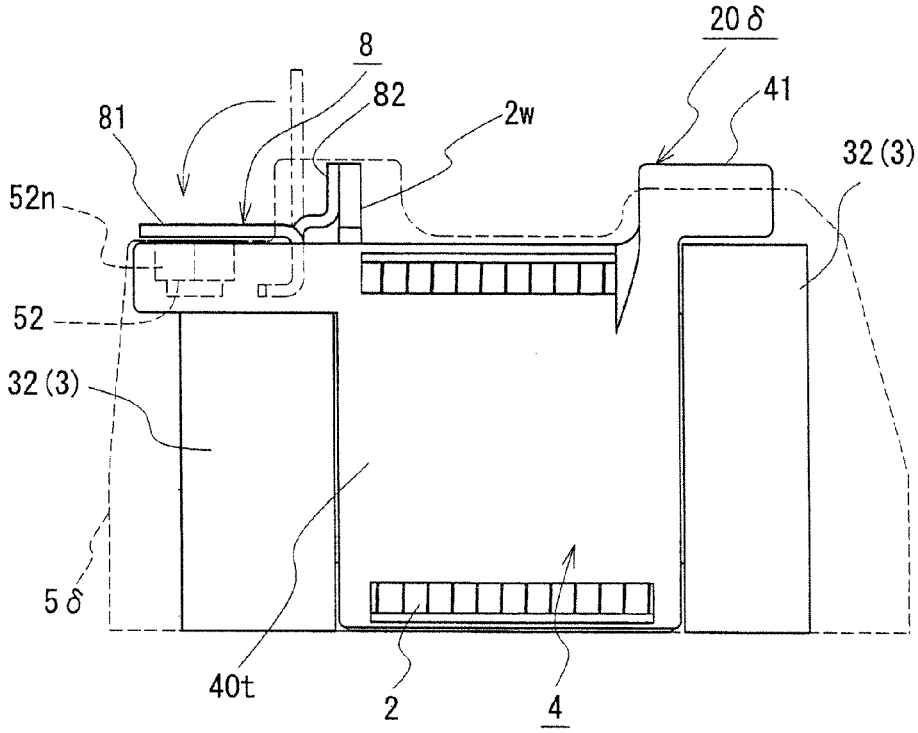
FIG. 15 is a side view of the combination unit of the coil molded unit and the magnetic core to be included in the reactor in the modification of the second embodiment, showing an arrangement state of the terminal fitting and the inside resin portion.

In the second embodiment, the terminal base is formed with outside resin portion 5β. However, as in a coil molded unit 20δ shown in FIG. 15, the terminal base may be formed with inside resin portion 4. Coil molded unit 20δ is configured such that inside resin portion 4 extends further below connection surfaces 81 of terminal fittings 8. Such coil molded unit 20δ can be manufactured by welding terminal fittings 8 beforehand to the ends of wire 2*w* forming coil 2, arranging the inside core portions (not shown) with the cushion members (not shown) in this coil 2, and molding inside resin portion 4 such that the portions of terminal fittings 8 other than connection surfaces 81 and welded portions 82 are buried in inside resin portion 4 and nut holes 52 for accommodating nuts 52*n* are simultaneously molded. After the inside core portions of the resulting coil molded unit 20δ and the outside core portions 32 are joined together, an outside resin portion 5δ is molded. In molding of outside resin portion 5δ, connection surface 81 and welded surface 82 of terminal fitting 8 are kept parallel to each other such that the constituent resin of outside resin portion 5δ does not intrude into nut hole 52. After outside resin portion 5δ is molded, similarly as in the second embodiment, nut 52*n* is accommodated in nut hole 52 and thereafter connection surface 81 is bent approximately at 90° to cover the opening of nut hole 52. According to this manner, terminal fitting 8 can also be handled as a member integrated with coil molded unit 20δ, thereby facilitating manufacturing of the reactor, resulting in good productivity of the reactor.

(Modification 2-4)

Figure 16:
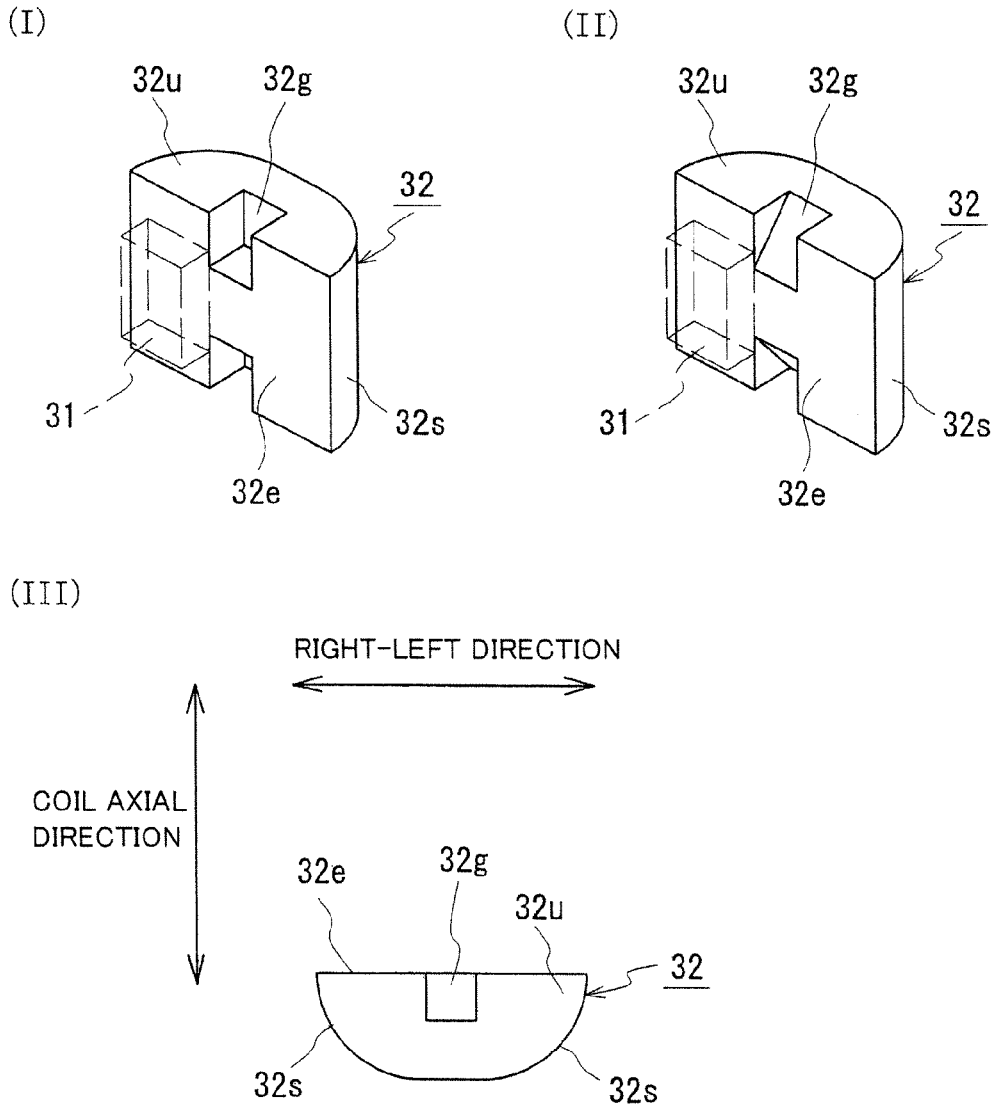

In the manner described in the second embodiment, notched corner portion 32*g* is formed by rounding the ridge line of inner end surface 32*e* and side surface 32*s* of magnetic core 3. In another manner, the notched corner portion may be formed in the following manner as shown in FIG. 16. In FIG. 16, outside core portion 32 is shown by a solid line, and only one side of inside core portions 31 is partially shown by a broken line while the other side is omitted. For the sake of convenience of illustration, the shown notched corner portion 32*g* is exaggerated to be larger than the actual size.

The cross-sectional shape of outside core portion 32 shown in FIG. 16(I) is approximately trapezoidal as in the second embodiment. Notched corner portions 32*g* are formed at the ridge lines consisting of inner end surface 32*e* and the top and bottom surfaces (only a top surface 32*u* is given a reference character in FIG. 16(I)) of outside core portion 32. More specifically, at an intermediate portion of outside core portion 32 in the right-left direction (here, the horizontal direction orthogonal to the coil axial direction) in FIG. 16(I), a notch rectangular in cross section is provided, and this notch serves as notched corner portion 32*g*. This notched corner portion 32*g* is formed at a portion between a pair of coil elements that is opposed to the end surface of the coil molded unit when inside core portions 31 and the coil molded unit (not shown) are arranged on outside core portion 32. In another manner, when notches are provided at the same portions as the aforementioned portions at the ridge lines of inner end surface 32*e* and the top and bottom surfaces of outside core portion 32, as shown in FIG. 16(II), the notches may be triangular, and these notches serve as notched corner portions 32*g*.

Also in the reactor having the magnetic core provided with notched corner portions 32*g* as described above, the constituent resin of the outside resin portion can be guided in the gap between the end surface of the coil molded unit and inner end surface 32*e* of outside core portion 32 from the portions provided with notched corner portions 32*g*. Therefore, as compared with the case where notched corner portion 32*g* is not present, the constituent resin of the outside resin portion can fill between the coil molded unit and the magnetic core more reliably. Notched corner portions 32*g* are formed at the intermediate portions of the ridge lines of inner end surface 32*e* and the top and bottom surfaces of outside core potion 32, more specifically, in the region between the coil elements in the state in which the coil elements are arranged in parallel. Therefore, it can be reversely avoided that the magnetic path area formed in the magnetic core when the coil is excited is reduced because of the presence of notched corner portions 32*g*.

In the reactor of the present invention, at least the core installation surface of the outside core portion is shaped to protrude from the installation-side surface of the inside core portion. However, even in the magnetic core in which the core installation surface and the surface opposed thereto of the outside core portion and the installation-side surface and the surface opposed thereto of the inside core portion are coplanar, the notched corner portion may be provided in a region between the coil elements as described above. Also in this manner, the constituent resin of the outside resin portion can easily fill in the gap between the end surface of the coil molded unit and the inner end surface of the outside core portion.

A variety of configurations as to the notched corner portion described above can also be applied as appropriate to reactor 1α in the first embodiment without a cushion member.

(Modification 2-5)

In the manner described in the second embodiment, cover portion 100*c* of molding die 100 has a plurality of resin injection gates. However, a plurality of resin injection gates may be provided in the bottom surface in the cavity of the base portion. For example, three resin injection gates, in total, provided on the same straight line are provided in the bottom surface. When the combination unit of the coil molded unit and the magnetic core is arranged in the base portion, an inside gate located at the middle of the three gates is opened toward the gap between a pair of coil elements arranged in parallel, while the other two gates sandwiching the inside gate are each opened toward a location where the outside core portion is sandwiched between the other gate and the inside gate. Resin is poured into the molding die so as to spring from the bottom surface of the molding die, thereby preventing bubbles from getting into the resin. In the case of this manner, a concave groove and a concave portion may be provided in the cover portion, similar to the aforementioned concave groove which is provided in the bottom surface in cavity 101 of base portion 100*b* of molding die 100 and in which coupling portion covering portion 41 serving as a positioning portion is fitted, and the concave portion in which terminal fitting 8 and the like is inserted. Alternatively, window portions may be provided in place of these concave grooves. This cover portion may also have an appropriate outer shape such that a gap for air vent is provided as appropriate when the molding die is closed, or may have a through hole for air vent.

Here, when the combination unit of the coil molded unit and the magnetic core is accommodated in the molding die in order to form the outside resin portion, the gate arrangement location can be selected as appropriate as long as at least one resin injection gate is provided in the molding die. For example, the gate may be provided between a pair of coil elements as described above, or in the outside of the coil element, or on a wall surface of the molding die. Then, for example, when one resin injection gate is provided between a pair of coil elements, the resin poured from the resin injection gate pours into the depression (see FIG. 1) of the coil molded unit between the coil elements, flows through the gap between the end surface of the coil molded unit and the magnetic core, flows out of the combination unit. As a result, the outer circumference of the combination unit is covered with the outside resin portion.

Here, it is expected that the productivity of the reactor can be enhanced by using resin that sets quickly, as the constituent resin of the outside resin portion. However, when resin having a high setting speed is used, the resin poured in the molding die gels before injection of resin into the molding die is not completed. Therefore, it is necessary to set the resin injection pressure high. Here, the injection pressure of resin may damage, for example, the magnetic core, starting from a portion having a low physical strength in the combination unit. The reason may be that the resin injection gate is opened toward the gap between the coil elements in order to distribute the resin to the part difficult for resin to enter, such as the gap between the coil molded unit and the magnetic core, and as a result, a great pressure acts on the magnetic core from the inside toward the outside of the combination unit. In particular, as described in the first and second embodiments, when the magnetic core is formed of a plurality of separate pieces for the sake of ease of the combination process with the coil molded unit, the joint portion between the separate pieces may be a starting point of damage or breakdown. Specifically, for example, the inside core portion and the outside core portion become separated, or the outside core portion is damaged. Other starting points of damage or breakdown are, for example, a part where the bonding of soft magnetic material of a powder compact is weak in the case where the magnetic core is a powder compact, and an adhered part between adjacent thin plates in the case where the magnetic core is a stack of thin plates.

Even when damage or breakdown does not occur in the production stage, stress acting in such a direction that damages the magnetic core may cause distortion to be accumulated in the magnetic core, which possibly causes damage in the magnetic core in the future, for example, with vibrations during use of the reactor.

In this respect, as described in the second embodiment, damage to the magnetic core can be prevented when the constituent resin of the outside resin portion is poured into the molding die both from the inside gate opened toward the gap between the coil elements and from the outside gates opened toward the space between the combination unit and the molding die. The reason can be assumed as follows. The pressure (outward pressure) of resin pressing the magnetic core from the inside to the outside of the annular magnetic core and the pressure (inward pressure) of resin pressing the annular magnetic core from the outside toward the inside of the annular magnetic core are cancelled out with each other, so that unnecessary pressure is less likely to act on the magnetic core when resin is poured into the molding die. Then, in the reactor thus obtained, stress does not substantially act in such a direction that damages the magnetic core, and it is expected that the magnetic core is hardly damaged in the future.

In particular, in the manner in which a plurality of outside gates are provided and the combination unit is sandwiched between at least two outside gates which are arranged opposed to each other, it is possible to prevent pressure of resin acting from the outside of the combination unit from being localized in a particular direction on the combination unit in the molding die when resin is poured into the molding die. Furthermore, since the outside gates are located opposed to each other, pressure of the resin can act relatively uniformly from the outer circumferential side toward the inner circumferential side of the combination unit.

Furthermore, the two outside gates located as opposed to each other are provided away from the combination unit further from the end portions of the magnetic core in the coil axial direction (see gate marks 54 in FIG. 8(II)), so that the inward pressure and outward pressure described above can be cancelled out easily.

In addition, in the manner described in the second embodiment, a pair of outside gates are arranged to sandwich the outside core portions. However, the present invention is not limited to such a location. As long as the inside gate is typically opened toward the gap between a pair of coil elements and the outside gates are each opened toward the space between the combination unit and the molding die, the resin injection gates may be formed, for example, not only in the bottom surface or the cover portion of the molding die but also in the sidewall of the molding die. Specifically, for example, a plurality of inside gates may be provided, and a plurality of outside gates may be provided to surround the side surfaces of the combination unit, wherein at least one of the inside gates and the outside gates may be formed both in the bottom surface and in the cover portion of the molding die, or the outside gate may be provided on the sidewall of the molding die. The manner in which three injection gates are provided on the same straight line as described in the second embodiment is particularly preferable. In addition to this manner, it is particularly preferable that one or more pairs of outside gates are present in at least one of the cover portion and the bottom surface of the molding die so as to sandwich the opposite side surfaces of the coil molded unit, or that a pair of outside gates are present in the sidewall so as to sandwich the side surfaces of the outside core portion that are orthogonal to the coil axial direction. In any of these combination manners, the outward pressure by injection of resin from the inside gate is effectively cancelled out by the inward pressure by injection of resin from the outside gates, and the resin sufficiently fills between the molded unit and the molding die, so that the outside resin portion can be formed quickly without damaging the magnetic core.

The manner of using a plurality of resin injection gates can also be applied to the first embodiment without a cushion member and the modifications 1-1 to 1-10.

(Modification I)

Figure 17:
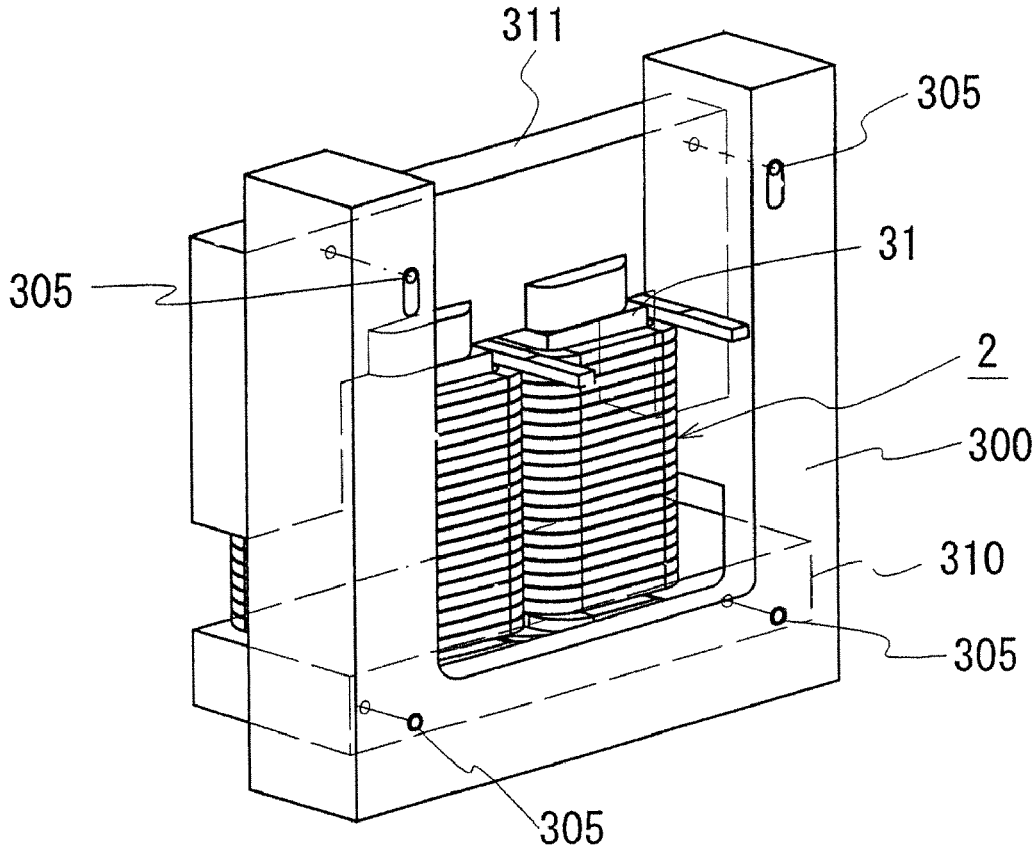
FIG. 17 is a perspective view schematically illustrating a state in which a shape retainer is arranged for the combination unit of the coil and the inside core portion.

In the manner described in the first and second embodiments, a plurality of rods press coil 2 into compression in formation of the coil molded unit. Alternatively, a shape retaining jig may be separately used to press coil 2 into a compressed state before it is accommodated in a molding die, and the compressed coil may be accommodated in the molding die. For example, a shape retaining jig 300 shown in FIG. 17 may be used. Shape retaining jig 300 is a bracket-shaped (] shaped) block and can be fixed by bolts 305 to a pair of sandwiching members 310 and 311 to be accommodated in the molding die (not shown). The distance between sandwiching members 310 and 311 is fixed when shape retaining jig 300 is attached to sandwiching members 310 and 311. Long holes into which bolts 305 are inserted are provided in shape retaining jig 300, and bolt holes (not shown) into which bolts 305 are screwed are provided in sandwiching member 310, 311.

Shape retaining jig 300 is used as follows. First, shape retaining jig 300 is fixed to one sandwiching member 310 in the shape of a letter I by bolts 305. The combination of inside core portion 31 and coil 2 is arranged on the integrated, I-shaped sandwiching member 310, and this combination is sandwiched between sandwiching member 310 and the other bracket-shaped sandwiching member 311. Then, the other bracket-shaped sandwiching member 311 is slid toward the one I-shaped sandwiching member 310 to press coil 2. Once the distance between sandwiching members 310 and 311 reaches a predetermined size (coil 2 in a predetermined compressed state), bolts 305 are inserted through the long holes of shape retaining member 300 and screwed tight, and shape retaining member 300 is also fixed to the other sandwiching member 311. Sandwiching members 310, 311 thus fixed to shape retaining jig 300 are arranged in the molding die.

The molding die having concave grooves in which sandwiching members 310, 311 attached to the combination are fitted is used. Then, because of the fitting of sandwiching members 310, 311 in the concave grooves, the compressed state of coil 2 in a predetermined length can be easily kept even after removal of shape retaining jig 300. Here, a molding die having the concave grooves is used. The molding die having the concave grooves may be an integral unit having concave grooves or may be integrally formed by combining a plurality of separate pieces. For example, when the concave grooves are formed by combining separate pieces with sandwiching members 310, 311 being arranged in part of the molding die, the state in which sandwiching members 310, 311 are fitted in the concave grooves can be easily formed. Sandwiching members 310, 311 may be fixed to the molding die using a fixing member such as a bolt after sandwiching members 310, 311 are arranged in the molding die. After sandwiching members 310, 311 fixed to shape retaining jig 300 are arranged in the concave grooves of the molding die, shape retaining jig 300 is removed and the molding die is closed. The inside resin portion is formed with sandwiching members 310, 311 left in the molding die.

With the use of shape retaining jig 300, the combination of coil 2 and the magnetic core (inside core portion 31) can be easily accommodated in the molding die. Therefore, as compared with when coil 2 and the magnetic core are separately arranged in the molding die, the time taken to arrange the combination in the molding die can be shortened, thereby improving the productivity of the coil molded unit and thus the productivity of the reactor. If a plurality of shape retaining jigs 300 and sandwiching members 310, 311 are prepared, while the constituent resin of the inside resin portion is setting, shape retaining jig 300 and sandwiching members 310, 311 are attached to the combination in preparation for manufacturing the next coil molded unit. Also in this respect, the productivity of the reactor can be improved. In addition, when sandwiching members 310, 311 arranged in the molding die have a function of pressing the coil, the need for the rods is eliminated, for example, and the structure of the molding die is thus simplified.

(Modification Ii)

In the manner described in the first and second embodiments, coil 2 includes a pair of coil elements 2*a*, 2*b*. However, in a manner in which only one coil (element) is included, the reactor can be further reduced in size. Since there is one coil in this manner, the coil coupling portion is not present, and the coil molded unit can be formed easily, resulting in good productivity of the reactor.

In the manner including only one coil, the magnetic core may be, for example, a pot-type core such as an E-E shaped core formed by combining a pair of E-shaped sections or an E-I shaped core formed by combining an E-shaped section and an I-shaped section. In this magnetic core, an inside core portion is inserted in the inside of the coil, and an outside core portion is formed to cover at least part of the outer circumference of the coil and is coupled to the inside core portion, so that these core portions form a closed magnetic circuit. The outside core portion may be formed to cover the entire surface of the coil. In this case, for example, the outside core portion is formed as a molded hardened body as described above, and, for example, the outside core portion may cover the outer circumference of the combination of the inside core portion and the coil molded unit.

In addition, in the manner including only one coil, when the coil is shaped like a cylinder, it can be easily formed even in the case of edgewise winding, resulting in good formability of the coil. When the inside core portion is shaped in a circular cylinder in conformity with the cylindrical coil, the gap provided between the inner circumferential surface of the inside core portion and the outer circumferential surface of the coil can be reduced, thereby further reducing the size of the reactor. In the manner of including only one coil, the core installation surface of the outside core portion is also exposed from the outside resin portion thereby achieving excellent heat dissipation performance.

Reference Example

In the configuration described in the first and second embodiments, a case is omitted. However, the reactor may have a case. The case functions as a mechanical protection member for the combination unit of the coil molded unit and the magnetic core and is also used as a heat dissipation path. In this respect, lightweight metal materials with excellent heat dissipation performance, such as aluminum or aluminum alloys, can be suitably used as the constituent material of the case. In the manner having a case, the case may be used in place of molding die 100. Then, concave grooves as described in the second embodiment are formed in this case, and appropriate projections, for example, are formed with the inside resin portion of the coil molded unit and then fitted in the concave grooves, so that the positioning of the combination unit with respect to the case is performed. By doing so, the positioning of the combination unit with respect to the case is performed easily and reliably, thereby increasing the productivity of the reactor as in reactor 1β having the positioning portion in the second embodiment. The case accommodating the combination unit is filled with resin (outside resin portion) for sealing the combination unit.

Furthermore, as described in the second embodiment, the reactor including the magnetic core having the notched corner portion may include a case in place of molding die 100 as described above. In this case, using the notched corner portion as a guide, the constituent resin of the outside resin portion to fill the case easily fills between the coil molded unit and the magnetic core.

It is noted that the foregoing embodiments are modified as appropriate without departing from the concept of the present invention and the present invention is not limited to the configurations described above. For example, the configurations in the foregoing embodiments and the configurations in the modifications can be combined in a variety of manners.

INDUSTRIAL APPLICABILITY

The reactor of the present invention can be suitably used, for example, as a component of a vehicle-mounted part such as a vehicle-mounted converter mounted on vehicles such as hybrid cars, electric cars, or fuel-cell cars.

REFERENCE SIGNS LIST

1α, 1β reactor
10 combination unit
2, 2A, 2B, 2C, 2D, 2E, 2F, 2G, 2H coil
- 2*w* wire, 2*a*, 2*b* coil element, 2*r* coil coupling portion, 2*t* turn portion,
- 2*f* turn formation surface, 21 beginning end, 22 terminal end,
- 20α, 20β, 20γ, 20δ, 20B, 20C, 20D, 20E coil molded unit,
- 20*d* molded unit installation surface

3 magnetic core
- 31 inside core portion, 31*e* end surface, 31*m* core piece,
- 31*g* gap material, 32 outside core portion, 32*d* core installation surface,
- 32*e* inner end surface, 32*s* side surface, 32*u* top surface
- 32*g* notched corner portion

4 inside resin portion
- 4*i* interposed resin portion, 40*h* hollow hole, 40*t* turn covering portion,
- 40*e* end surface
- 41 coupling portion, 42 depression, 43C, 43D, 43E concave groove
- 45 sensor hole

5α, 5β, 5δ outside resin portion
- 50*d* resin installation surface, 51 flange portion, 51*h* through hole,
- 52 nut hole,
- 52*n* nut, 53 protection portion, 54 gate mark

6 cushion member
7 heat dissipation plate
8 terminal fitting
- 81 connection surface, 81*h* insertion hole, 82 welded surface

100 molding die, 100*b* base portion, 100*c* cover portion, 101 cavity,
110 concave groove
111, 112, 113 concave portion
210 terminal, 220 bolt
300 shape retaining jig, 305 bolt, 310, 311 sandwiching member

The invention claimed is:

1. A reactor including a coil formed by spirally winding a wire, and a magnetic core having an inside core portion inserted into said coil and an outside core portion coupled to the inside core portion to form a closed magnetic circuit, comprising:
- a coil molded unit having said coil and an inside resin portion covering an outer circumference of said coil to hold its shape; and
- an outside resin portion covering at least part of an outer circumference of a combination unit of said coil molded unit and said magnetic core,
- wherein a surface of said outside core portion that serves as an installation side when said reactor is installed protrudes from a surface of said inside core portion that serves as an installation side, and is exposed from said outside resin portion,
- said inside resin portion has an interposed resin portion interposed between said coil and said inside core portion, and
- said reactor further comprises a cushion member which is interposed between said interposed resin portion and said inside core portion and does not cover said outside core portion.

2. The reactor according to claim 1, further comprising a positioning portion which is integrally formed in said inside resin portion and is used for positioning said combination unit with respect to a molding die when said outside resin portion is formed using a molding die,
- wherein at least part of said positioning portion is not covered with said outside resin portion.

3. The reactor according to claim 2, wherein
- said coil includes a pair of coil elements and a coil coupling portion coupling the coil elements with each other,
- said coil coupling portion is provided to protrude from a turn formation surface of said coil elements, and
- said positioning portion is formed at a portion that covers said coil coupling portion in said inside resin portion.

4. The reactor according to claim 2, wherein said positioning portion is formed only with constituent resin of said inside resin portion.

5. The reactor according to claim 1, further comprising a notched corner portion formed at a ridge line formed by an inner end surface of said outside core portion that is opposed to an end surface of said coil molded unit and an adjacent surface connected to the inner end surface, for introducing constituent resin of said outside resin portion into between the end surface of said coil molded unit and the inner end surface of said outside core portion.

6. The reactor according to claim 1, wherein a surface of said outside core portion that serves as an installation side when said reactor is installed and a surface of said coil molded unit that serves as an installation side are coplanar, and these surfaces are exposed from said outside resin portion.

7. The reactor according to claim 1, wherein said coil includes a pair of coil elements, said coil elements being arranged side by side such that axial directions thereof are parallel with each other, and said inside resin portion has a depression at a portion that covers a gap between said coil elements and that serves as an installation side when said reactor is installed.

8. The reactor according to claim 1, wherein a constituent material of said cushion member has Young's modulus smaller than constituent resin of said inside resin portion.

9. The reactor according to claim 1, wherein said cushion member is at least one kind selected from a heat-shrinkable tube, a cold-shrinkable tube, a mold layer, a coating layer, and a tape winding layer.

10. The reactor according to claim 1, wherein a gap of not less than 0.5 mm and not more than 4 mm is formed between an inner end surface of said outside core portion that is opposed to an end surface of said coil molded unit and the end surface of said coil molded unit, and constituent resin of said outside resin portion is present in this gap.

11. A reactor including a coil formed by spirally winding a wire, and a magnetic core having an inside core portion inserted into said coil and an outside core portion coupled to the inside core portion to form a closed magnetic circuit, comprising:

a coil molded unit having said coil and an inside resin portion covering an outer circumference of said coil to hold its shape; and an outside resin portion covering at least part of an outer circumference of a combination unit of said coil molded unit and said magnetic core, wherein a surface of said outside core portion that serves as an installation side when said reactor is installed protrudes from a surface of said inside core portion that serves as an installation side, and is exposed from said outside resin portion, said reactor further comprises a positioning portion which is integrally formed in said inside resin portion and is used for positioning said combination unit with respect to a molding die when said outside resin portion is formed using a molding die, and at least part of said positioning portion is not covered with said outside resin portion.

12. The reactor according to claim 11, further comprising a notched corner portion formed at a ridge line formed by an inner end surface of said outside core portion that is opposed to an end surface of said coil molded unit and an adjacent surface connected to the inner end surface, for introducing constituent resin of said outside resin portion into between the end surface of said coil molded unit and the inner end surface of said outside core portion.

13. The reactor according to claim 12, wherein said notched corner portion is formed by rounding said ridge line.

14. The reactor according to claim 11, wherein a surface of said outside core portion that serves as an installation side when said reactor is installed and a surface of said coil molded unit that serves as an installation side are coplanar, and these surfaces are exposed from said outside resin portion.

15. The reactor according to claim 11, wherein said coil includes a pair of coil elements, said coil elements being arranged side by side such that axial directions thereof are parallel with each other, and said inside resin portion has a depression at a portion that covers a gap between said coil elements and that serves as an installation side when said reactor is installed.

16. The reactor according to claim 11, wherein said coil includes a pair of coil elements and a coil coupling portion coupling the coil elements with each other, said coil coupling portion is provided to protrude from a turn formation surface of said coil elements, and said positioning portion is formed at a portion that covers said coil coupling portion in said inside resin portion.

17. The reactor according to claim 11, wherein said positioning portion is formed only with constituent resin of said inside resin portion.

18. The reactor according to claim 11, wherein a gap of not less than 0.5 mm and not more than 4 mm is formed between an inner end surface of said outside core portion that is opposed to an end surface of said coil molded unit and the end surface of said coil molded unit, and constituent resin of said outside resin portion is present in this gap.

19. A reactor including a coil formed by spirally winding a wire, and a magnetic core having an inside core portion inserted into said coil and an outside core portion coupled to the inside core portion to form a closed magnetic circuit, comprising:

a coil molded unit having said coil and an inside resin portion covering an outer circumference of said coil to hold its shape; and an outside resin portion covering at least part of an outer circumference of a combination unit of said coil molded unit and said magnetic core, wherein a surface of said outside core portion that serves as an installation side when said reactor is installed protrudes from a surface of said inside core portion that serves as an installation side, and is exposed from said outside resin portion, and said reactor further comprises a notched corner portion formed at a ridge line formed by an inner end surface of said outside core portion that is opposed to an end surface of said coil molded unit and an adjacent surface connected to the inner end surface, for introducing constituent resin of said outside resin portion into between the end surface of said coil molded unit and the inner end surface of said outside core portion.

20. The reactor according to claim 19, wherein a surface of said outside core portion that serves as an installation side when said reactor is installed and a surface of said coil molded unit that serves as an installation side are coplanar, and these surfaces are exposed from said outside resin portion.

21. The reactor according to claim 19, wherein said coil includes a pair of coil elements, said coil elements being arranged side by side such that axial directions thereof are parallel with each other, and said inside resin portion has a depression at a portion that covers a gap between said coil elements and that serves as an installation side when said reactor is installed.

22. The reactor according to claim 19, wherein said notched corner portion is formed by rounding said ridge line.

23. The reactor according to claim 19, wherein a gap of not less than 0.5 mm and not more than 4 mm is formed between an inner end surface of said outside core portion that is opposed to an end surface of said coil molded unit and the end surface of said coil molded unit, and constituent resin of said outside resin portion is present in this gap.

* * * * *